US005597683A

United States Patent [19]

Uchida et al.

[11] Patent Number: 5,597,683

[45] Date of Patent: Jan. 28, 1997

[54] SILVER HALIDE COLOR PHOTOGRAPHIC MATERIAL

[75] Inventors: Minoru Uchida; Shunichi Tomita; Toshio Kawagishi, all of Kanagawa, Japan

[73] Assignee: Fuji Photo Film Co., Ltd., Kanagawa, Japan

[21] Appl. No.: 250,338

[22] Filed: May 26, 1994

Related U.S. Application Data

[63] Continuation of Ser. No. 843,166, Feb. 28, 1992, abandoned.

[30] Foreign Application Priority Data

Mar. 1, 1991 [JP] Japan ..... 3-057694

[51] Int. Cl.[6] ..... G03C 1/035; G03C 7/38; G03C 7/305

[52] U.S. Cl. ..... 430/544; 430/551; 430/558; 430/567; 430/571; 430/957

[58] Field of Search ..... 430/544, 558, 430/567, 571, 957, 551

[56] References Cited

U.S. PATENT DOCUMENTS

| | | | |
|---|---|---|---|
| 4,248,962 | 2/1981 | Lau | 430/558 |
| 4,755,455 | 7/1988 | Iwasa | 430/558 |
| 4,797,354 | 1/1989 | Jaitou et al. | 430/567 |
| 4,824,772 | 4/1989 | Ichijima et al. | 430/544 |
| 4,873,179 | 10/1989 | Abe et al. | 430/957 |
| 4,952,491 | 8/1990 | Nishikawa et al. | 430/570 |
| 4,985,350 | 1/1991 | Ikeda et al. | 430/567 |
| 5,215,872 | 6/1993 | Goto et al. | 430/544 |
| 5,360,709 | 11/1994 | Ohkawa et al. | 430/544 |

OTHER PUBLICATIONS

Patent Abstracts of Japan, vol. 14, No. 148, Mar. 20, 1990, JPA 2 008 840, (Jan. 12, 1990).

Chemical Abstracts, vol. 105, No. 5, p. 607; abstract No. 124164N, JPA 61 017 143 (Jan. 25, 1986).

Chemical Abstracts, vol. 107, No. 4, p. 634; abstract No. 106202K, JPA 62 055 652 (Mar. 11, 1987).

Patent Abstracts of Japan, vol. 12, No. 016, Jan. 19, 1988, JPA 62 172 351, (Jul. 29, 1987).

Chemical Abstracts, vol. 107, No. 7, p. 703, abstract No. 208694Q, JPA 62 058 246 (Mar. 13, 1987).

Chemical Abstracts, vol. 108, No. 2, p. 601, abstract No. 46780F, JPA 62 172 345 (Jul. 29, 1987).

*Primary Examiner*—Lee C. Wright

*Attorney, Agent, or Firm*—Sughrue, Mion, Zinn, Macpeak & Seas

[57] ABSTRACT

Disclosed is a silver halide color photographic photosensitive material comprising a support, having thereon at least one photosensitive silver halide layer. At least 50% of the total projected area of the silver halide grains in the emulsion layer is accounted for by tabular grains of an aspect ratio at least 2:1, and a compound which can be represented by formula (I) below is in at least one layer.

(I)

In this formula R represents a hydrogen atom or a substituent group; Z represents a group of non-metal atoms which is required to form a five-membered azole ring which contains from 2 to 4 nitrogen atoms, and said azole ring may have substituent groups;

X represents a group which may be eliminated by a coupling reaction with the oxidized form of a developing agent during development to form a development inhibitor or a precursor thereof, or a group which, after elimination, reacts during development with another molecule of the oxidized form of the developing agent to form a development inhibitor or a precursor thereof.

11 Claims, No Drawings

SILVER HALIDE COLOR PHOTOGRAPHIC MATERIAL

This is a Continuation of Application Ser. No. 07/843,166 filed Feb. 28, 1992 now abandoned.

FIELD OF THE INVENTION

The present invention concerns silver halide color photographic photosensitive materials. More precisely, it concerns silver halide color photographic photosensitive materials which have excellent sharpness and graininess with high speed and for which the color reproduction and the sensitive material storage properties are especially good.

BACKGROUND OF THE INVENTION

Sensitive materials which have excellent sharpness, graininess and color reproduction at high speed and which have good storage properties are desirable as silver halide color photographic photosensitive materials. Development inhibitor releasing compounds (DIR compounds) have been used in the past as a means of improving photographic performance in terms of sharpness, graininess and color reproduction, etc.

The dyes, which are formed from these compounds preferably have a hue which has little unwanted absorption from the point of view of color reproduction. Pyrazoloazole type compounds have been disclosed in JP-A-61-28947 and JP-A-62-24252 as magenta color forming compounds which have good color reproducing properties and which are chemically stable. (The term "JP-A" as used herein signifies an "unexamined published Japanese patent application.) However, when these compounds are used alone they are not satisfactory from the point of view of sharpness and graininess.

Furthermore, the use of tabular silver halide grains for which the ratio of the diameter and the thickness (i.e., the aspect ratio) is at least 8:1 has been proposed in JP-A-58-113934, for example, as a method of providing sensitive materials which have excellent sharpness and graininess with high speed.

However, when tabular silver halide grains are used, the interlayer effect which is important for improving picture quality is reduced and it has become clear that there is a worsening of color reproduction. The conjoint use of compounds which release diffusible development inhibitors with these tabular silver halide grains in order to overcome this weakness has been proposed in JP-A-59-129849 and JP-A-61-14635. However, the specific examples of magenta color forming DIR compounds disclosed in the above mentioned JP-A-59-129849 and JP-A-61-14635 are all 5-pyrazolone type compounds which are not always satisfactory for color reproduction. Moreover, the 5-pyrazolone type compounds have the further disadvantage that a marked increase in coloration occurs during storage, and especially during storage under conditions of high temperature and high humidity, after development processing.

Moreover, a technique for improving sharpness, graininess and color reproduction by using (i) compounds which cleave a development inhibitor via a reaction of a compound which has been cleaved after reaction with the oxidized form of the developing agent with another molecule of the developing agent and (ii) tabular silver halide grains has been disclosed in JP-A-63-19654. However, the storage stability of the sensitive material is inadequate with the magenta color forming compounds of that reference.

SUMMARY OF THE INVENTION

An object of the present invention is to provide sensitive materials which have excellent sharpness and graininess with high speed and, moreover, to provide sensitive materials which have excellent color reproduction and storage stability, by using pyrazoloazole type compounds which have excellent storage properties and hue, conjointly with tabular silver halide emulsions.

This and other objects of the present invention have been realized by the silver halide photographic photosensitive materials described below.

The silver halide color photographic photosensitive material of the present invention comprises a support having thereon at least one photosensitive silver halide emulsion layer. At least 50% of the total projected area of the silver halide grains in the emulsion layer is accounted for by tabular grains of an aspect ratio at least 2:1. A compound which can be represented by formula (I) is included in at least one layer:

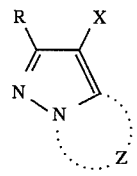

(I)

In this formula, R represents a hydrogen atom or a substituent group. Z represents a group of nonmetal atoms which is required to form a five-membered azole ring which contains from 2 to 4 nitrogen atoms. The azole ring may have substituent groups.

X represents a group which may be eliminated by a coupling reaction with the oxidized form of a developing agent during development to form a development inhibitor or a precursor thereof, or a group which, after elimination, reacts during development with another molecule of the oxidized form of a developing agent to form a development inhibitor or a precursor thereof.

DETAILED DESCRIPTION OF THE INVENTION

The compounds of formula (I) which are used in the present invention are described in detail below. The preferred skeletons for the coupler skeleton represented by formula (I) are 1H-imidazo[1,2-b]pyrazole, 1H-pyrazolo[1,5-b][1,2,4]triazole, 1H-pyrazolo[5,1-c][1,2,4]triazole and 1H-pyrazolo[1,5-d]tetrazole, and these are represented by formulae (P-1), (P-2), (P-3) and (P-4), respectively:

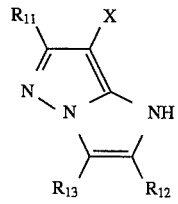

(P-1)

-continued

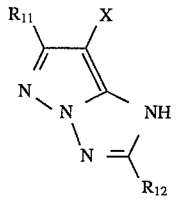

(P-2)

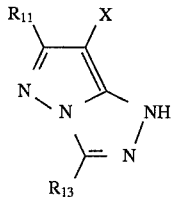

(P-3)

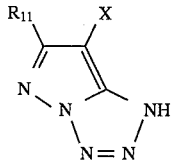

(P-4)

The substituent groups $R_{11}$, $R_{12}$, $R_{13}$ and X in these formulae are described in detail below.

$R_{11}$ represents a hydrogen atom, a halogen atom an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and $R_{11}$ may be a divalent group and present as a bisform.

More precisely, $R_{11}$ represents a hydrogen atom, a halogen atom (for example, chlorine, bromine), an alkyl group (for example, a straight chain or branched chain alkyl group, aralkyl group, alkenyl group, alkynyl group, cycloalkyl group or cycloalkenyl group which has from 1 to 32 carbon atoms, for example ethyl, propyl, isopropyl, tert-butyl, tridecyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl, 3-(2,4-di-tert-amylphenoxy)propyl), an aryl group (for example phenyl, 4-tert-butylphenyl, 2,4-di-tert-amylphenyl, 4-tetradecanamidophenyl), a heterocyclic group (for example, 2-furyl, 2-thienyl, 2-pyrimidyl, 2-benzothiazolyl), a cyano group, a hydroxyl group, a nitro group, a carboxyl group, an amino group, an alkoxy group (for example, methoxy, ethoxy, 2-methoxyethoxy, 2-dodecylethoxy, 2-methanesulfonylethoxy), an aryloxy group (for example, phenoxy, 2-methylphenoxy, 4-tert-butylphenoxy, 3-nitrophenoxy, 3-tert-butyloxycarbamoylphenoxy, 3-methanecarbamoylphenoxy), an acylamino group (for example, acetamido, benzamido, tetradecanamido, 2-(2,4-di-tert-amylphenoxy)butanamido, 4-(3-tert-butyl-4-hydroxyphenoxy)butanamido, 2-{4-(4-hydroxyphenylsulfonyl)phenoxy}dodecanamido), an alkylamino group (for example, methylamino, butylamino, dodecylamino, diethylamino, methylbutylamino), an anilino group (for example, phenylamino, 2-chloroanilino, 2-chloro-5-tetradecanaminoanilino, 2-chloro-5-dodecyloxycarbonylanilino, N-acetylanilino, 2-chloro-5-{α-(3-tert-butyl-4-hydroxyphenoxy)dodecanamido}anilino), a ureido group (for example, phenylureido, methylureido, N,N-dibutylureido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propyl-thio), an arylthio group (for example, phenylthio, 2-butoxy-5-tert-octylphenylthio, 3-pentadecylphenylthio, 2-carboxyphenylthio, 4-tetradecanamidophenylthio), an alkoxycarbonylamino group (for example, methoxycarbonylamino, tetradecyloxycarbonylamino), a sulfonamido group (for example, methanesulfonamido, hexadecanesulfonimido, benzenesulfonamido, p-toluenesulfonamido, octadecanesulfonamido, 2-methyloxy-5-tert-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl), a sulfamoyl group (for example, N-ethylsulfamoyl, N,N-dipropylsulfamoyl, N-(2-dodecylethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), an alkoxycarbonyl group (for example, methoxycarbonyl, butyloxycarbonyl, dodecyloxycarbonyl, octadecyloxycarbonyl), a heterocyclic oxy group (for example, 1-phenyltetrazol-5-oxy group, 2-tetrahydropyranyloxy), an azo group (for example, phenylazo, 4-methoxyphenylazo, 4-pivaloylaminophenylazo, 2-hydroxy-4-propanoylphenylazo), an acyloxy group (for example, acetoxy), a carbamoyloxy group (for example, N-methylcarbamoyloxy, N-phenyl-carbamoyloxy), a silyloxy group (for example, trimethylsilyloxy, dibutylmethylsilyloxy), an aryloxycarbonylamino group (for example, phenoxycarbonylamino), an imido group (for example, N-succinimido, N-phthalimido, 3-octadecenylsuccinimido), a heterocyclic thio group (for example, 2-benzothiazolylthio, 2,4-diphenoxy-1,3,5-triazole-6-thio, 2-pyridylthio), a sulfinyl group (for example, dodecanesulfinyl, 3-pentadecyphenyl-sulfinyl, 3-phenoxypropylsulfinyl), a phosphonyl group (for example, phenoxyphosphonyl, octyloxyphosphonyl, phenylphosphonyl), an aryloxycarbonyl group (for example, phenoxycarbonyl), an acyl group (for example, acetyl, 3-phenylpropanoyl, benzoyl, 4-dodecyloxybenzoyl) or an azolyl group (for example imidazolyl, pyrazolyl, 3-chloropyrazol-1-yltriazolyl). Where possible, the above groups may have halogen atoms or organic substituent groups which are connected to a carbon atom, an oxygen atom, a nitrogen atom or a sulfur atom.

Among the above groups, the hydrogen atom, the alkyl groups, the aryl groups, the alkoxy groups, the aryloxy groups, the alkylthio groups, the ureido groups, and the acylamino groups are preferred for $R_{11}$.

$R_{12}$ may be any of the substituent groups indicated for $R_{11}$, and it is preferably a hydrogen atom, an alkyl group, an aryl group, a heterocyclic group, an alkoxycarbonyl group, a carbamoyl group, a sulfamoyl group, a sulfinyl group, an acyl group or a cyano group.

Furthermore, $R_{13}$ may be any of the substituent groups indicated for $R_{11}$, and it is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, and most desirably it is an alkyl group, an aryl group, a heterocyclic group, an alkylthio group or an arylthio group.

X is preferably a group which can be represented by formula (X-1) below:

$$-\{(L_1)_a\text{-}(B)_m\}_p\text{-}(L_2)_n\text{-}DI \qquad (X\text{-}1)$$

In this formula, $L_1$ represents a group with which the bond on the right hand side (the bond to $(B)_m$) is cleaved after cleavage of the bond on the left hand side of $L_1$ in formula (X-I); B represents a group which reacts with the oxidized form of a developing agent and cleaves the bond on the right hand side of B shown in formula (X-1); $L_2$ represents a group with which the bond on the right hand side (the bond to DI) is cleaved after cleavage of the bond on the left hand side of $L_2$ in formula (X-1); DI represents a development inhibitor and a, m and n each represent 0 or 1, and p represents an integer from 0 to 2. Here, the individual $(L_1)_a\text{-}(B)_m$ moieties may be the same or different when p is a plural number.

The course of the reaction when the compounds represented by formula (X-1) release DI during development can be represented by the following reaction equations. An example of a case in which p=1 is illustrated here.

$$A-(L_1)_a-(B)_m-(L_2)_n-DI \xrightarrow{QDI^+}$$

$$(L_1)_a-(B)_m-(L_2)_n-DI \longrightarrow$$

$$(B)_m-(L_2)_n-DI \xrightarrow{QDI^+} (L_2)_n-DI \longrightarrow DI$$

In these equations, $L_1$, a, B, m, $L_2$, n and DI have the same meaning as described in connection with formula (X-1), and $QDI^+$ signifies the oxidized form of a developing agent. A represents a pyrazoloazole magenta coupler residual group as described earlier, which is to say the part other than X of formula (X-1).

In formula (X-1), the linking groups represented by $L_1$ and $L_2$ may be, for example, (i) groups that utilize a hemiacetal cleavage reaction as disclosed in U.S. Pat. Nos. 4,146,396, 4,652,516 or 4,698,297, (ii) timing groups with which a cleavage reaction occurs utilizing an intramolecular nucleophilic reaction as disclosed in U.S. Pat. No. 4,248,962, (iii) timing groups with which a cleavage reaction occurs utilizing an electron transfer reaction as disclosed in U.S. Pats. 4,409,323 or 4,421,845, (iv) groups with which a cleavage reaction occurs utilizing a hydrolysis reaction of an ester as disclosed in West German Patent (laid open) 2,626,317 or (v) groups with which a cleavage reaction occurs utilizing the hydrolysis reaction of an iminoketal as disclosed in U.S. Pat. No. 4,546,073. $L_1$ and $L_2$ are each linked to A or $A\text{-}(L_1)_a\text{-}(B)_m$ at a hetero atom, and preferably at an oxygen atom, a sulfur atom or a nitrogen atom, which is included therein.

Groups which are preferred when the groups represented by $L_1$ and $L_2$ are used are described below.

(1) Groups Which Utilize a Hemi-acetal Cleavage Reaction

Examples are disclosed in U.S. Pat. No. 4,146,396, JP-A-60-249148 and JP-A-60-249149. These groups can be represented by the formula (T-1) shown below, where * indicates the bond on the left hand side of $L_1$ or $L_2$ of the group represented by general (X-1) and ** indicates the bond on the right hand side of $L_1$ or $L_2$ of the group which is represented by formula (X-1):

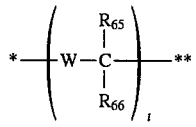

(T-1)

In this formula, W represents an oxygen atom, a sulfur atom or an $—NR_{67}—$ group, $R_{65}$ and $R_{66}$ represent hydrogen atoms or substituent groups, $R_{67}$ represents a substituent group and t represents 1 or 2. When t is 2, the two $—W—CR_{65}(R_{66})$ groups may be the same or different. Typical examples of $R_{65}$ and $R_{66}$, when they represent substituent groups, and $R_{67}$, include the $R_{69}$, $R_{69}CO—$, $R_{69}SO_2—$, $R_{69}NR_{70}CO—$ and $R_{69}NR_{70}SO_2—$ groups. Here, $R_{69}$ represents an aliphatic group, an aromatic group or a heterocyclic group, and $R_{70}$ represents an aliphatic group, an aromatic group, a heterocyclic group or a hydrogen atom. Cases in which $R_{65}$, $R_{66}$ and $R_{67}$ respectively represent divalent groups which are joined together to form a ring structure are also included. Examples of groups represented by formula (T-1) are shown below:

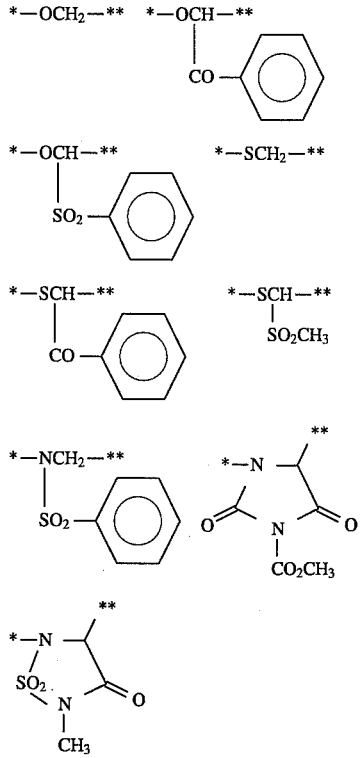

(2) Groups With Which a Cleavage Reaction Occurs Utilizing an Intramolecular Nucleophilic Substitution Reaction For example, the timing groups disclosed in U.S. Pat. No. 4,248,962. These can be represented by the following formula (T-2):

*-Nu-Link-E-** (T-2)

In this formula, * and  have the same meaning as described in connection with formula (T-1), Nu represents a nucleophilic group, with oxygen or sulfur, for example, as the nucleophilic species, E represents an electrophilic group, being a group which is the subject of a nucleophilic attack by Nu so that the bond marked  can be cleaved, and Link represents a linking group which enables Nu and E to have a steric arrangement such that an intramolecular nucleophilic substitution reaction can occur.

Examples of the groups represented by formula (T-2) are shown below:

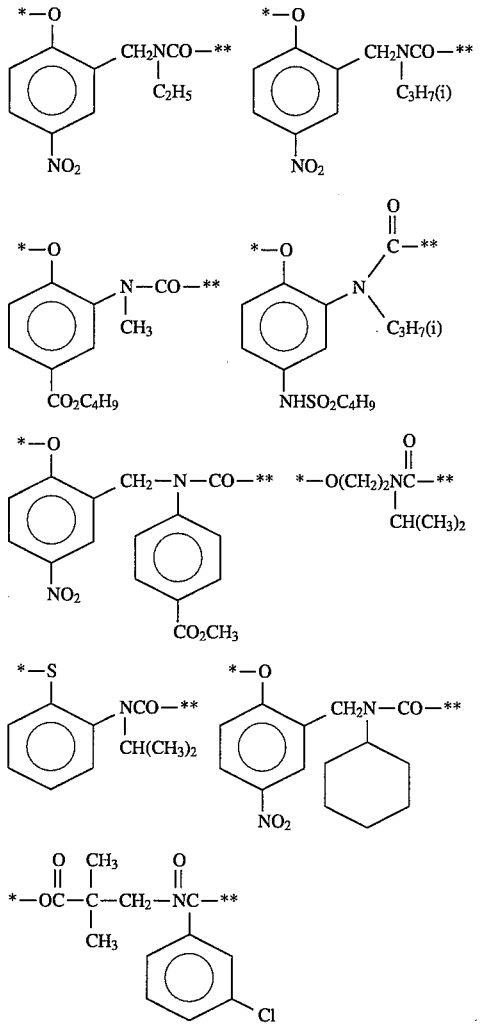

(3) Groups in Which a Cleavage Reaction Occurs Utilizing an Electron Transfer Reaction Along a Conjugated System For example, groups which can be represented by formula (T-3) shown below as disclosed in U.S. Pat. Nos. 4,409,323 and 4,421,845:

$$*—W—(V_1=V_2)_t—CH_2—** \quad \text{(T-3)}$$

In this formula, $V_1$ and $V_2$ represent $=CR_{65}—$ or a nitrogen atom. Moreover, *, **, W, $R_{65}$, $R_{66}$ and t all have the same meaning as described in connection with (T-1). Examples of these groups are shown below:

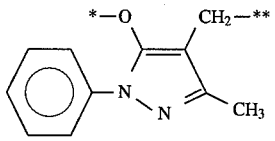

-continued

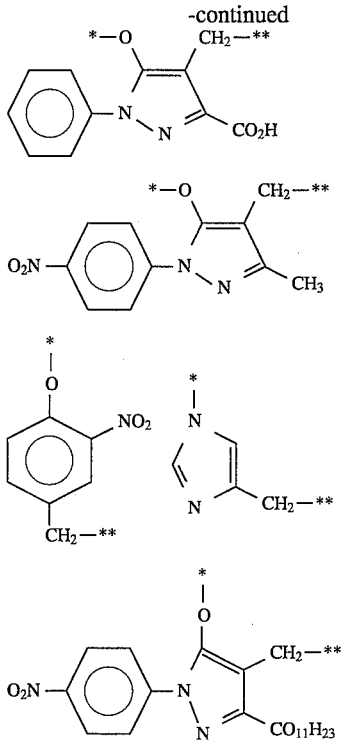

(4) Groups With Which a Cleavage Reaction due to Ester Hydrolysis is Utilized

For example, the linking groups disclosed in West German Patent Laid Open No. 2,626,315 as shown below. In these formulae, * and ** have the same meaning as described in connection with formula (T-1):

$$*—O—C—** \quad \text{(T-4)}$$

$$*—S—CS—** \quad \text{(T-5)}$$

(5) Groups With Which an Iminoketal Cleavage Reaction is Utilized

For example, the linking groups disclosed in U.S. Pat. No. 4,546,073, groups which are represented by formula (T-6) shown below:

$$*—W—C(=NR_{68})—** \quad \text{(T-6)}$$

In this formula, *, ** and W have the same meaning as described in connection with formula (T-1), and $R_{68}$ has the same meaning as $R_{67}$ in formula (T-1). Examples of groups represented by formula (T-6) are shown below:

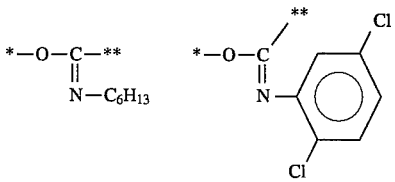

-continued

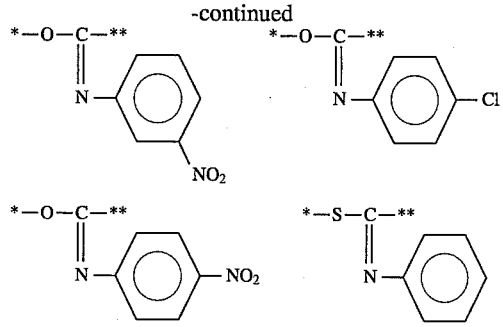

The group represented by B in formula (X-1) is, more precisely, represented by formulae (B-1), (B-2), (B-3) or (B-4) which are shown below:

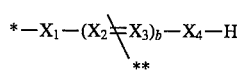

(B-1)

In this formula, * indicates the bond on the left hand side of B in formula (X-1), and  indicates the bond on the right hand side of B in formula (X-1). $X_1$ and $X_4$ each represents an oxygen atom or —N(—$SO_2R_{71}$)—($R_{71}$ represents an aliphatic group, an aromatic group or a heterocyclic group), $X_2$ and $X_3$ each represents a methine group or a nitrogen atom, and b represents an integer of 1 to 3. At least one of the $X_2$ groups and $X_3$ groups is a methine group which has a bond as shown by . Furthermore, when b is greater than 1, the $X_2$ groups and $X_3$ groups may be the same or different. When $X_2$ and $X_3$ are methine groups which have substituent groups, these groups may or may not be joined together to form a ring structure (for example a benzene ring or a pyridine ring). The groups represented by formula (B-1) form compounds to which the Kendall-Pelz rule applies (see T. H. James, "*The Theory of the Photographic Process*", 4th Edition, Macmillan Publishing Co. Inc., page 299) after cleavage of the * bond, and oxidation occurs by reaction with the oxidized form of the developing agent.

Examples of groups which can be represented by (B-1) are shown below:

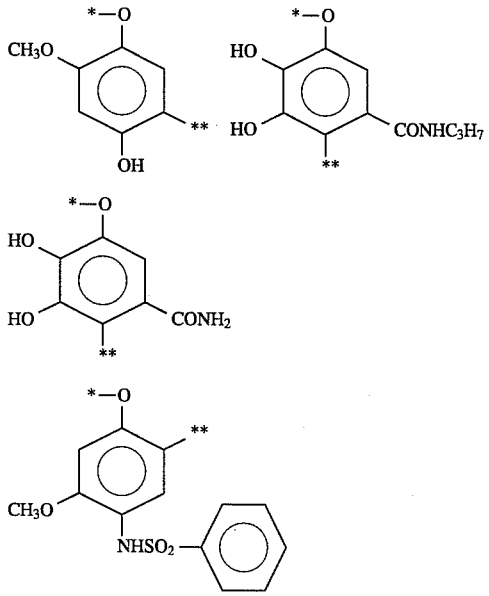

-continued

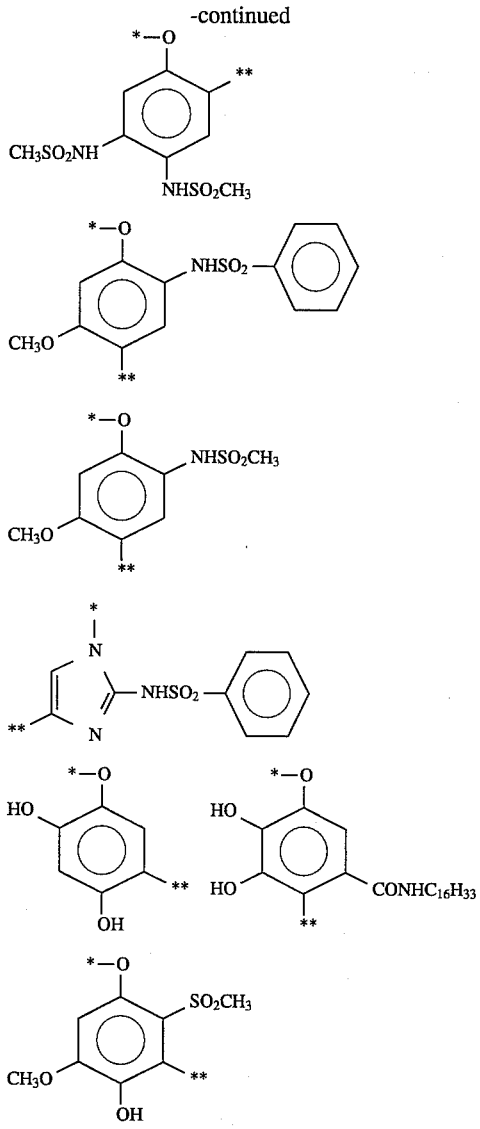

(B-2)

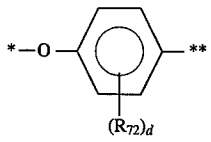

(B-3)

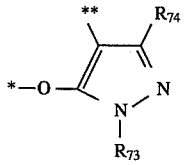

In these formulae, * and  have the same meaning as described in connection with (B-1), and $R_{72}$, $R_{73}$ and $R_{74}$ are groups which enable the groups represented by (B-2) and (B-3) to function as couplers which have a coupling leaving group at  after cleavage at *. Moreover, d represents an integer of 0 to 4, and when d is greater than 1, the plurality of $R_{72}$ groups may be the same or different. Furthermore, these $R_{72}$ groups may be joined to form a ring structure (for example a benzene ring). $R_{72}$ may be an acylamino group, an alkyl group or a halogen atom, $R_{74}$ is an acylamino group, an alkyl group, an anilino group, an amino group or an alkoxy group, and $R_{73}$ is a phenyl group or an alkyl group.

Examples of groups represented by (B-2) and (B-3) are shown below:

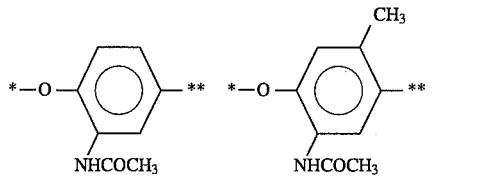

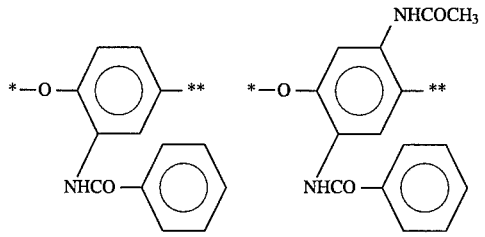

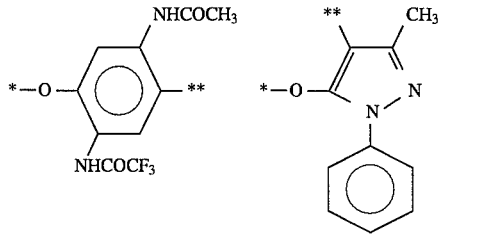

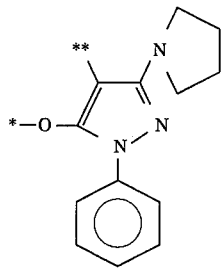

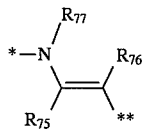

(B-4)

In this formula * and  have the same meaning as described in connection with (B-1), $R_{75}$, $R_{76}$ and $R_{77}$ each represent a substituent group. The $R_{77}$ and $R_{76}$ groups may or may not be joined together to form a nitrogen containing heterocyclic ring, and $R_{77}$ and $R_{75}$ may or may not be joined together to form a nitrogen containing heterocyclic ring. The group shown by (B-4) forms a coupler which has a coupling leaving group at  after cleavage at *.

Examples of groups which can be represented by (B-4) are shown below:

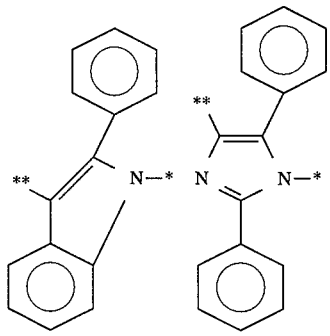

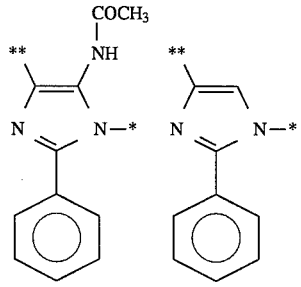

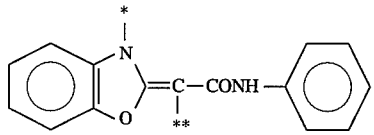

(II)

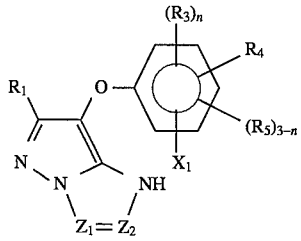

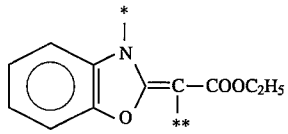

The group represented by DI in formula (X-1) is, for example, a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group or a benzimidazolyl group. These groups have been disclosed, for example, in U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563 and 4,782,012 or British Patent 1,450,479.

Examples of groups represented by DI are shown below. In these groups * represents the position which is bonded on the left hand side of the group represented by DI in general (X-1).

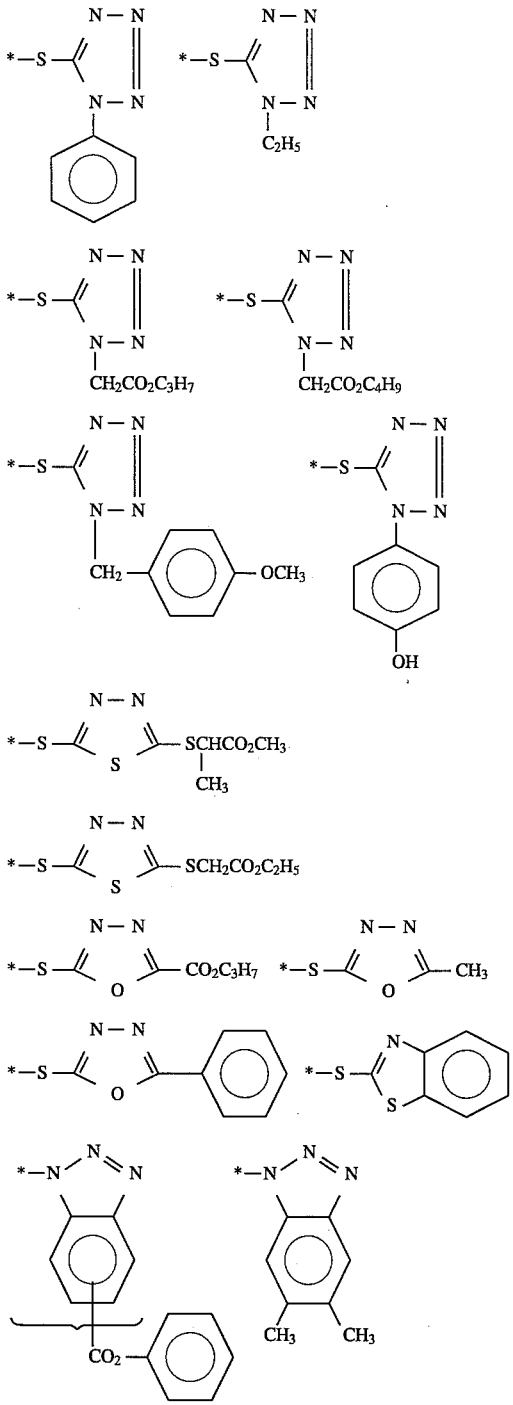

-continued

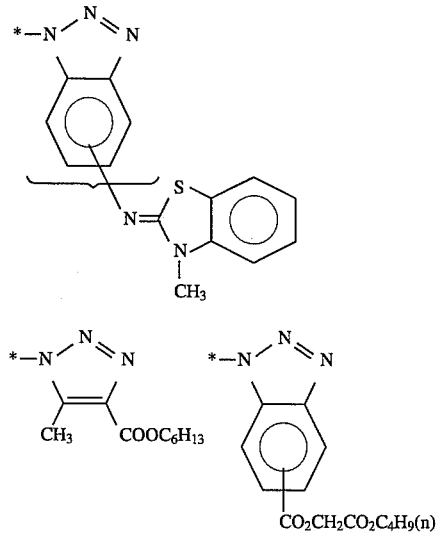

Among the groups represented by formula (X-1), those which can be represented by the formulae (X-2), (X-3) and (X-4) shown below are particularly preferred:

$$-(L_1)-B-DI \quad (X-2)$$

$$-(L_2)-DI \quad (X-3)$$

$$-DI \quad (X-4)$$

In these formulae, $L_1$, $L_2$, B and DI have the same meaning as $L_1$, $L_2$, B and DI in formula (X-1).

In those cases where X is a group which is eliminated at an oxygen atom in a compound represented by formula (I), R is preferably a hydrogen atom, an alkyl group or an aryl group from the point of view of the rate of the coupling reaction with the oxidized form of the developing agent.

Particularly, the compound represented by formula (II) in which X is eliminated with a group represented by formula (B-1) is preferred.

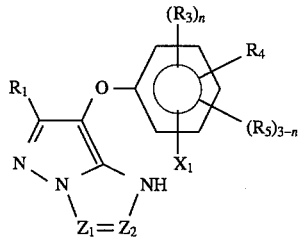

(II)

In this formula $R_1$ represents a hydrogen atom, an alkyl group or an aryl group and specifically $R_1$ represents a substituent group having the same meaning as an alkyl or aryl group exemplified for R in formula (I); $R_2$ represents a hydrogen atom or a substituent group and specifically $R_2$ represents a substituent group having the same meaning as R in formula (I); $R_3$ represents a hydroxyl group or a sulfonamido group and the sulfonamido group may further be substituted with an alkyl or aryl group exemplified for R in formula (I); $R_4$ represents a substituent group; $R_5$ represents a hydrogen atom or a group which may be substituted on a benzene ring and specifically $R_5$ represents a substituent group having the same meaning as R in formula (I); $X_1$ represents a development inhibitor or a precursor thereof and specifically $X_1$ represents the same group as X in formula (I); $Z_1$ and $Z_2$ each represents a nitrogen atom or $=C(R_2)$-, and when $Z_1$ is a nitrogen atom then $Z_2$ is $=C(R_2)$- and when $Z_1$ is $=C(R_2)$- then $Z_2$ is a nitrogen atom; and n represent 1 or 2.

In formula (II) $R_4$ has a substituent group having a Hammett $\sigma_p$ of at least 0.3 and the presence of such a substituent group is especially desirable for increasing storage stability of the compound of formula (II) in the phlotographic material.

Substituent groups which have a Hammett $\sigma_p$ value of at least 0.3 include halogenated alkyl groups (for example, trichloromethyl, trifluoromethyl, heptafluoropropyl), a cyano group, acyl groups (for example, formyl, acetyl, benzoyl), alkoxycarbonyl groups (for example, methoxycarbonyl, propoxycarbonyl), aryloxycarbonyl groups (for example, phenoxycarbonyl), carbamoyl groups (for example, N-methylcarbamoyl, N-propylcarbamoyl), sulfamoyl groups (for example N,N-dimethylsulfamoyl), sulfonyl groups (for example, methanesulfonyl, benzenesulfonyl), a thiocyanato group, a nitro group, phosphinyl groups (for example, diethylphosphinyl, dimethylphosphinyl) and heterocyclic groups (for example, 1-pyrrolyl, 2-benzoxazolyl). Examples of groups which have a Hammett $\sigma_p$ value of at least 0.3 are shown below, but the invention is not limited to these examples: The numerical value shown in brackets is the $\sigma_p$ value: $—CO_2C_2H_5$ (0.45), $—CONHCH_3$ (0.36), $—CF_2CF_2CF_2CF_3$ (0.52), $—C_6F_5$ (0.41), $—COCH_3$ (0.50), $—COC_6H_5$ (0.43), $—P(O)(OCH_3)_2$ (0.53), $—SO_2NH_2$ (0.57), —SCN (0.52), $—CO_2C_6H_5$ (0.44), $—CO_2CH_3$(0.45), $—CONH_2$ (0.36), $—(CF_2)_3CF_3$ (0.52), —CN (0.66). The $\sigma_p$ values are cited from *Structure/Activity Correlation for Reagents*, Kagaku no Ryochi Zokan No. 122, Nanedo).

Furthermore, when X is a group which is eliminated at a nitrogen atom or sulfur atom in the compound represented by formula (I), the compound represented by formula (III) in which R is an alkoxy group or an aryloxy group is desirable as the compound represented by formula (I) from the point of view of the rate of the coupling reaction with the oxidized form of the developing agent.

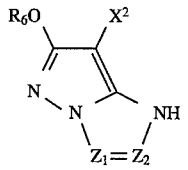

(III)

In this formula $R_6$ has the same meaning as $R_1$ in formula (II); $Z_1$ and $Z_2$ have the same meaning as $Z_1$ and $Z_2$ in formula (II), respectively; $R_2$ has the same meaning as $R_2$ in formula (II); and $X^2$ has the same meaning as X in formula (I) provided that $X^2$ does not include a group represented by formula (B-1) for X in formula (I).

Moreover, the compound of formula (III) in which substituent group $R_2$ to an azole ring moiety is a hydrogen atom, an alkyl group, an aryl group or a heterocyclic group is desirable for increasing storage stability of the compound of formula (III) in the photographic material, with an aryl group being particularly desirable.

The compound represented by formulas (II) or (III) may also form dimers or oligomers like the compound represented by formula (I).

Among the compounds which can be represented by formulae (P-1), (P-2), (P-3) and (P-4), those represented by formula (P-1), (P-2) and (P-3) are preferred from the viewpoint of the hue of the magenta dye which is formed, and those represented by formula (P-2) or (P-3) are especially desirable.

Furthermore, the compounds represented by formula (I) may form dimers or oligomers via divalent groups or groups having valence of more than two among the substituent R groups or the substituent groups on the azole ring represented by Z.

When the compound represented by formula (I) is an oligomer, it is typically a homopolymer or a copolymer of an addition polymerizable ethylenically unsaturated compound which has the aforementioned compound as a residual group (i.e., a color forming monomer). In this case the oligomer comprises a repeating unit of formula (V). One type of color forming repeating unit may be included in the oligomer, or the oligomer may be a copolymer which contains one or more types of non-color forming ethylenic monomers as copolymer units.

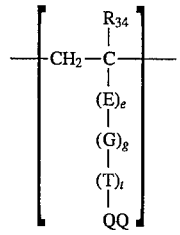

(V)

In this formula, $R_{34}$ represents a hydrogen atom, an alkyl group which has from 1 to 4 carbon atoms or a chlorine atom, E represents —CONH—, $—CO_2—$ or a substituted or unsubstituted phenylene group, G represents a substituted or unsubstituted alkylene group, phenylene group or aralkylene group, and T represents —CONH—, —NHCONH—, $—NHCO_2—$, —NHCO—, —OCONH—, —NH—, $—CO_2—$, —OCO—, —CO—, —O—, —S—, $—NHSO_2—$ or $—SO_2NH—$. Moreover, e, g and t represent 0 or 1, but not all of e, g and t are 0. QQ represents a compound residual group in which a hydrogen atom has been eliminated from a compound which can be represented by formula (I) to permit a bond with E, G or T.

Copolymers of compound monomers which comprise a compound unit of formula (V) and non-color forming ethylenic monomers mentioned below are preferred for the oligomers.

These preferred monomers are non-color forming ethylenic monomers which do not couple with the oxidized form of a primary aromatic amine developing agent, such as acrylic acid, α-chloroacrylic acid, α-alacrylic acids (for example, methacrylic acid), esters and amides derived from these acrylic acids (for example, acrylamide, methacrylamide, n-butylacrylamide, tert-butylacrylamide, diacetoneacrylamide, methylene-bis-acrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (for example, vinyl acetate, vinyl propionate and vinyl laurate), acrylonitrile, methacrylonitrile, aromatic vinyl compounds (for example, styrene and derivatives thereof, such as vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone and N-vinylpyridine.

The acrylic acid esters, methacrylic acid esters and maleic acid esters are especially desirable. Two or more of the non-color forming ethylenic monomers used here can be used conjointly. For example, methyl acrylate and butyl acrylate, butyl acrylate and styrene, butyl methacrylate and methacrylic acid, and methyl acrylate and diacetoneacrylamide can be used.

When a polymeric coupler which contains repeating units which can be represented by the aforementioned formula (V) is prepared, (as is well known in the field of polymeric couplers), the non-color forming ethylenic monomer which is copolymerized with the ethylenic monomer which has a coupler residual group of formula (I) can be selected in such a way as to affect the physical and/or chemical properties of the copolymer which is formed. In other words, one may affect the solubility, the compatibility with the binding agents, such as gelatin for example, of photographic colloid compositions, the plasticity or the thermal stability, for example.

The polymer compounds which can be used in the present invention (lipophilic polymer compounds in which vinyl based monomers which provide compound units which can be represented by the aforementioned formula (V) have been polymerized) may be dissolved in an organic solvent and emulsified and dispersed in the form of a latex in an aqueous gelatin solution or the direct emulsion polymerization method can be used.

The method disclosed in U.S. Pat. No. 3,451,820 can be used to form an emulsified dispersion in the form of a latex in an aqueous gelatin solution of a lipophilic polymer compound, and the methods disclosed in U.S. Pat. Nos. 4,080,211 and 3,370,952 can be used for emulsion polymerization.

Examples of compounds which can be represented by formula (I) which can be used in this present invention are indicated below, but the invention is not limited to these examples:

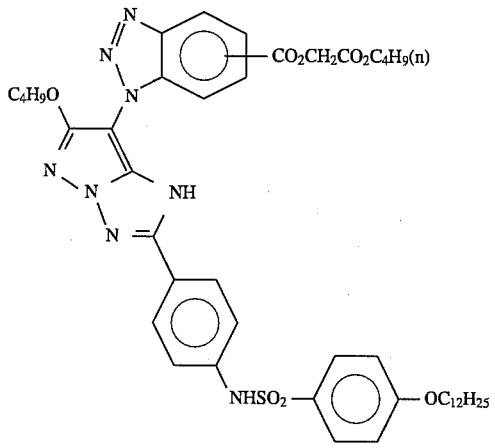

(1)

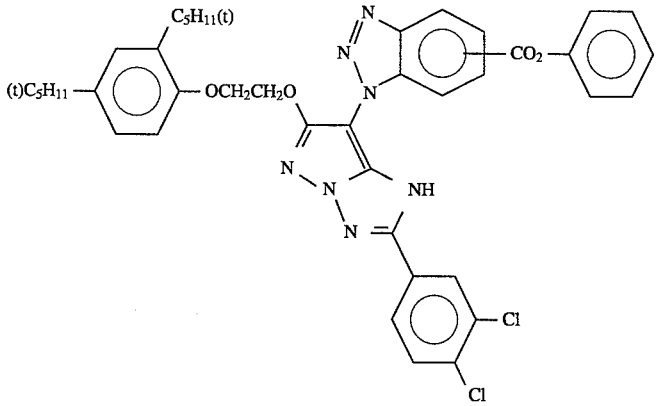

(2)

-continued
(3)
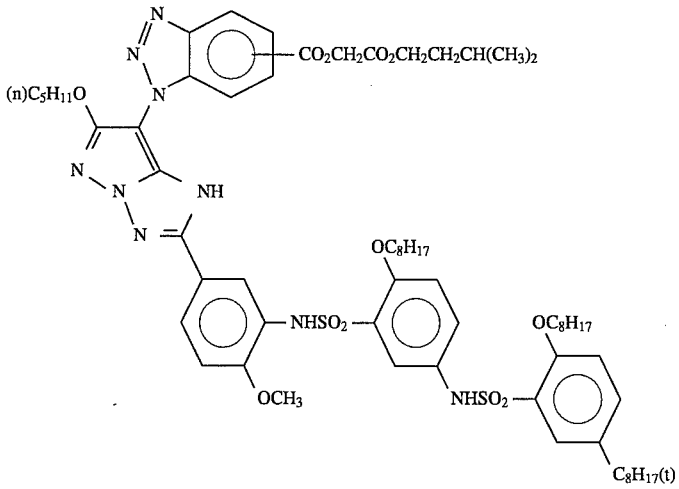
(4)
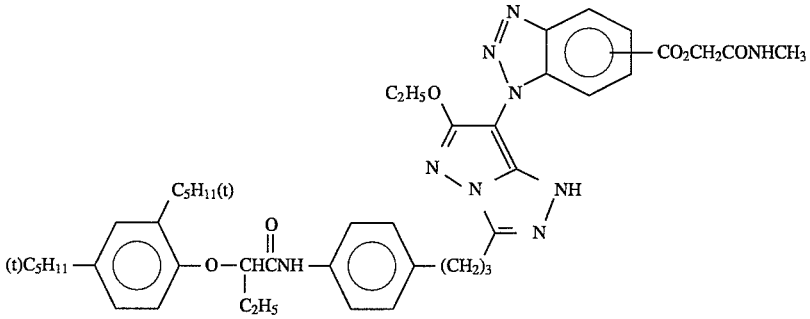
(5)
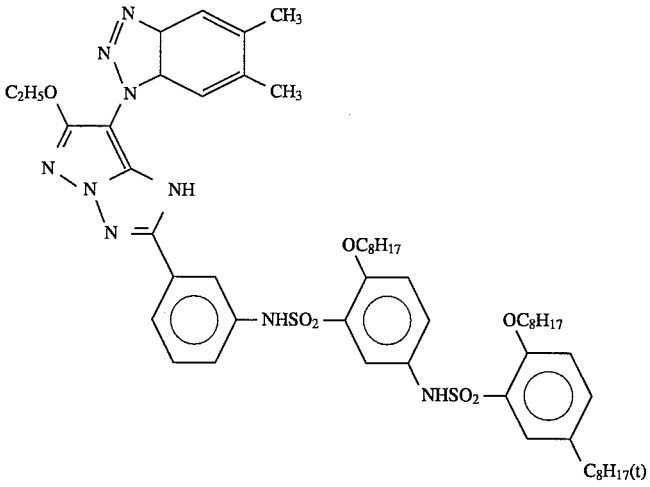

-continued
(6)
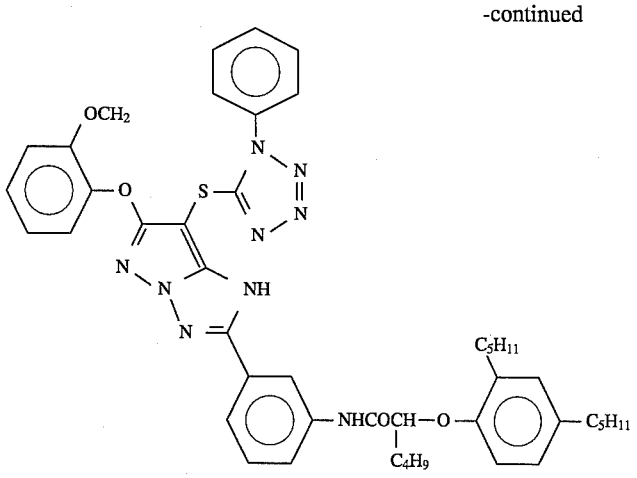
(7)
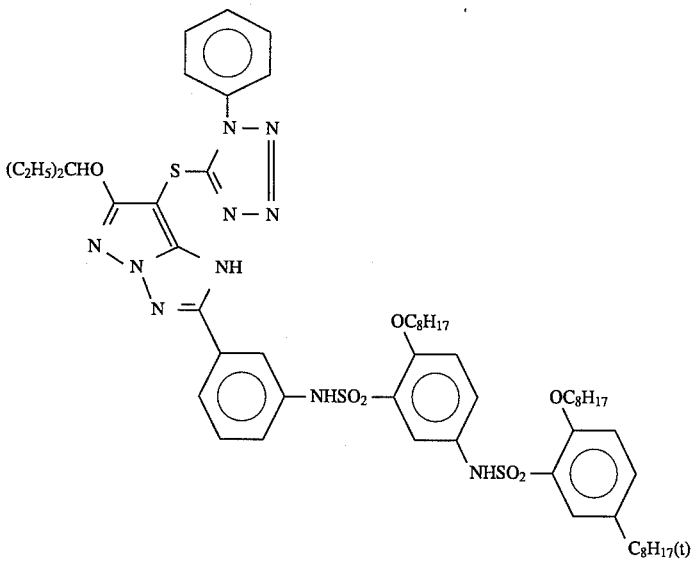
(8)
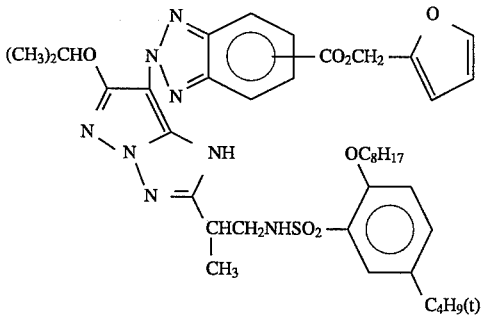

-continued
(9)
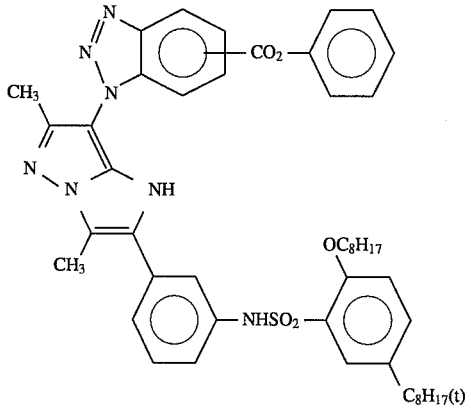
(10)
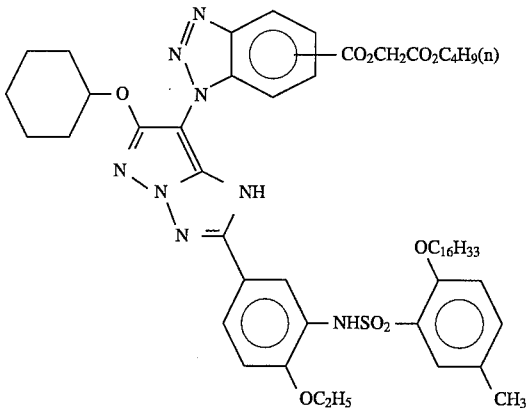
(11)
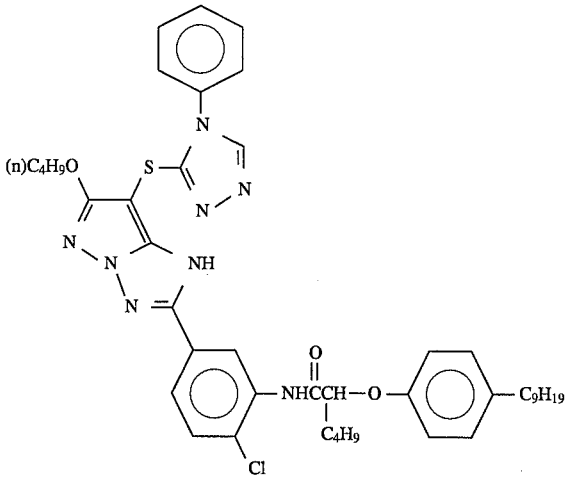

-continued
(12)
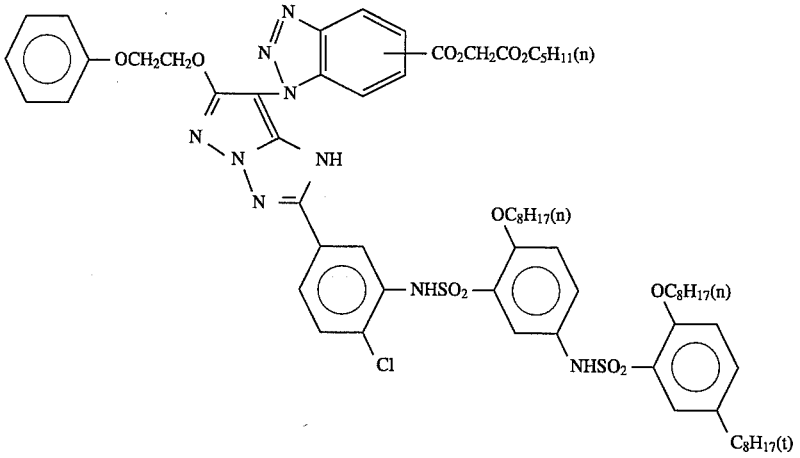
(13)
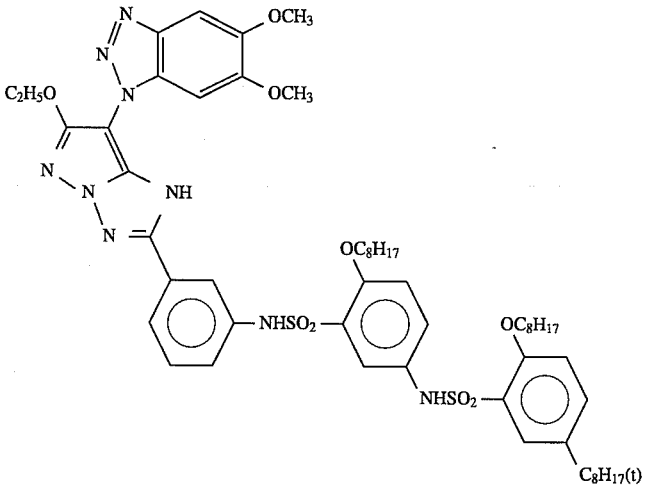
(14)
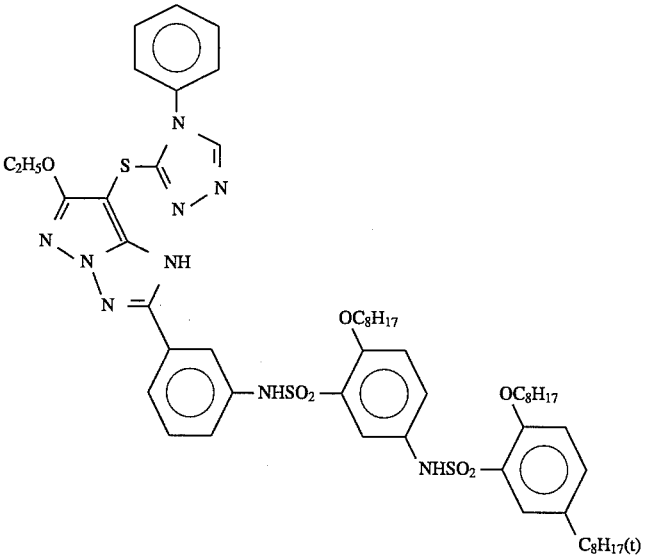

-continued
(15)
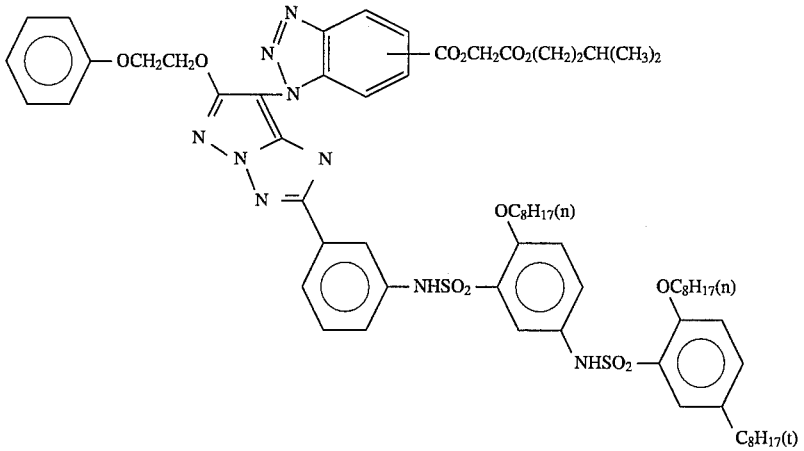
(16)
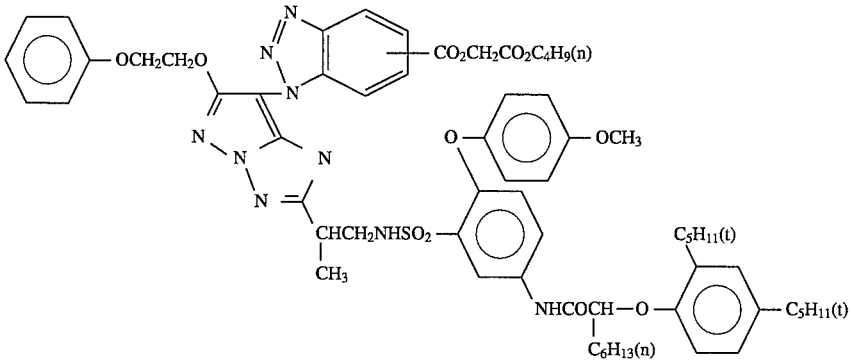
(17)
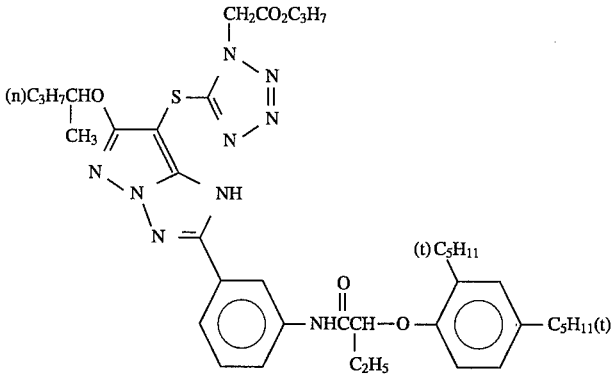
(18)
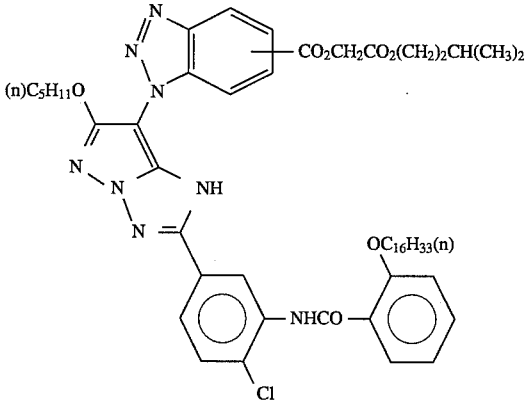

-continued
(19)
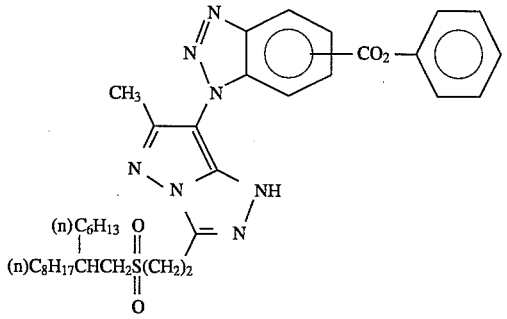
(20)
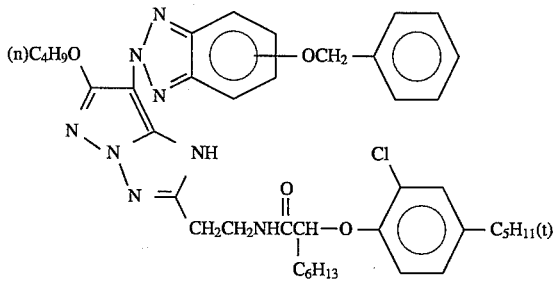
(21)
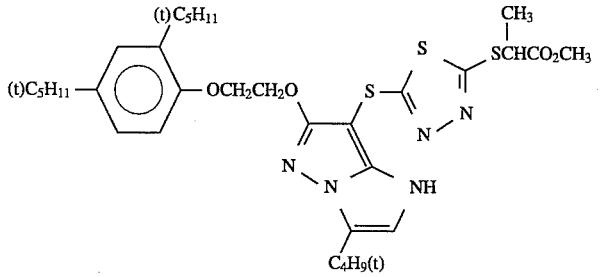
(22)
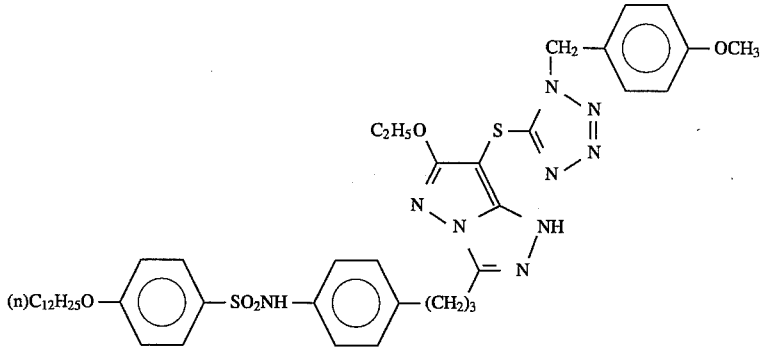
(23)
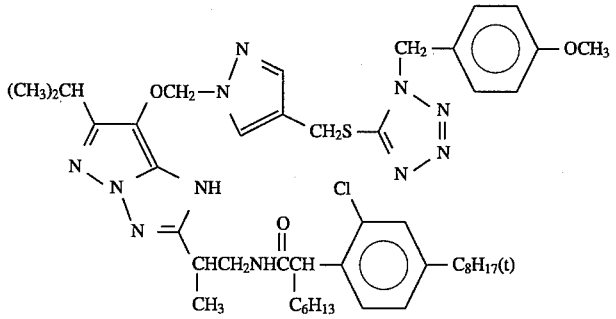

-continued
(24)
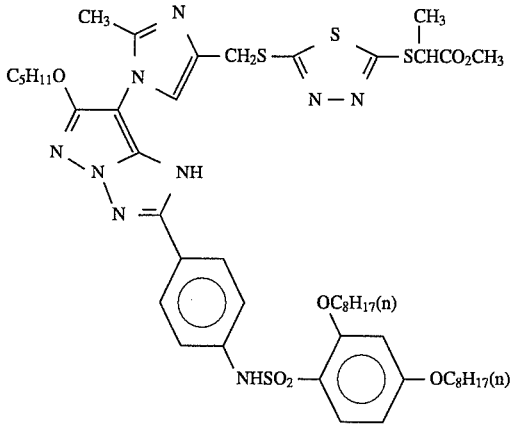
(25)
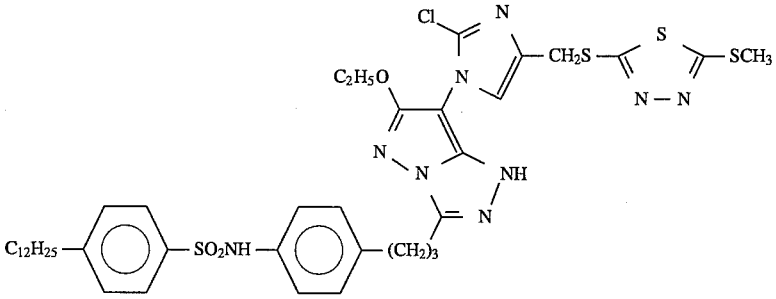
(26)
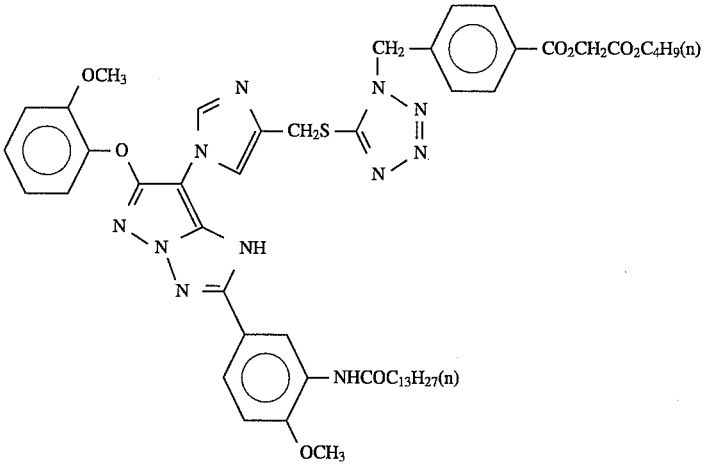
(27)
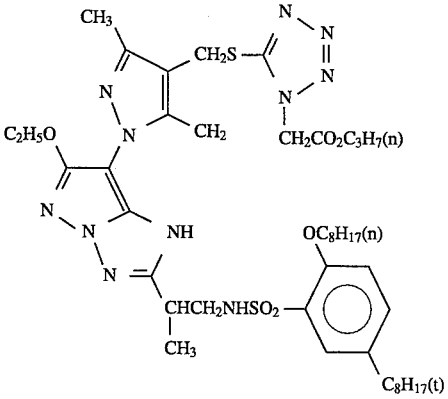

-continued
(28)
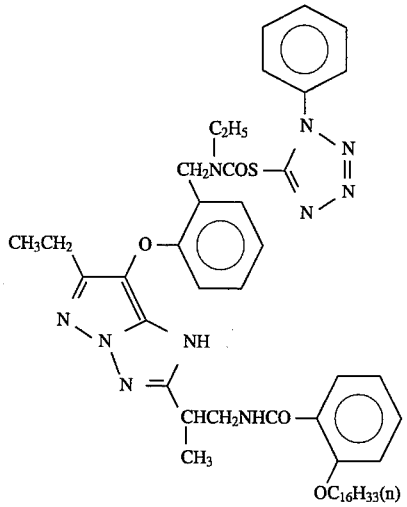
(29)
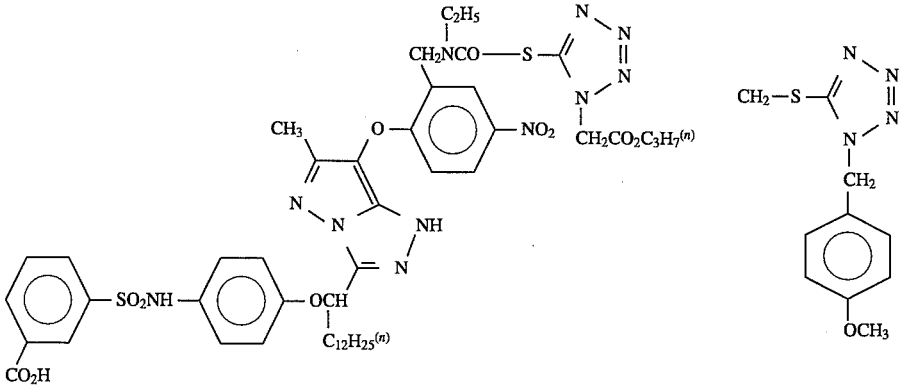
(30)
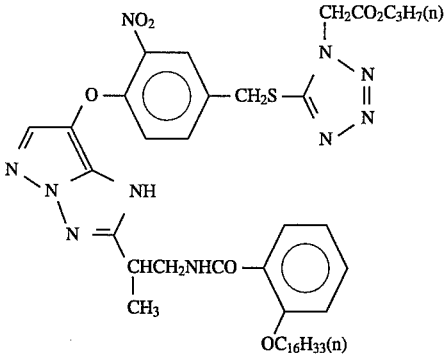
(31)
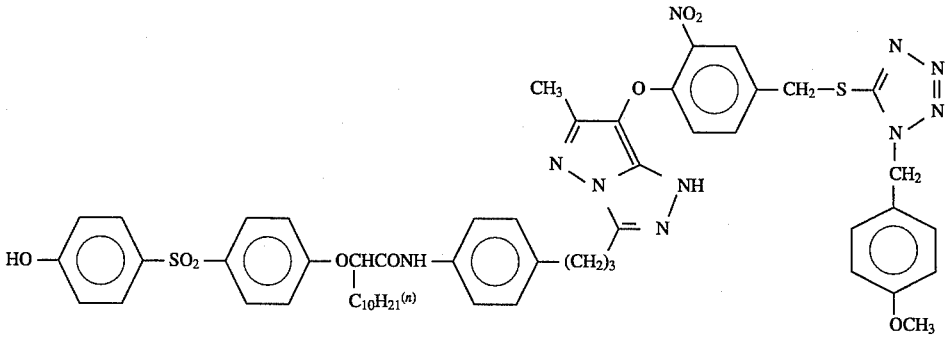

-continued
(32)
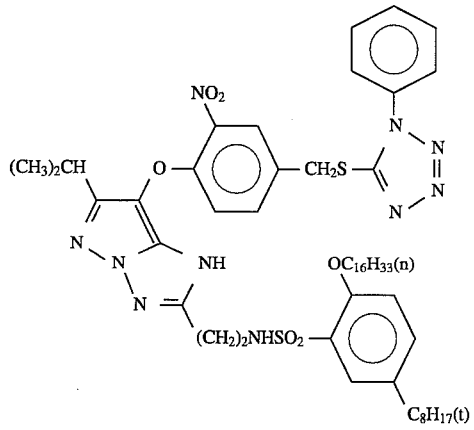
(33)
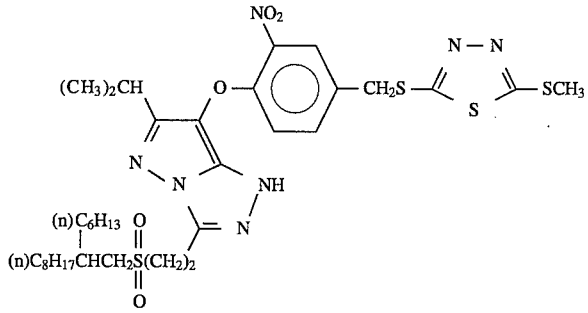
(34)
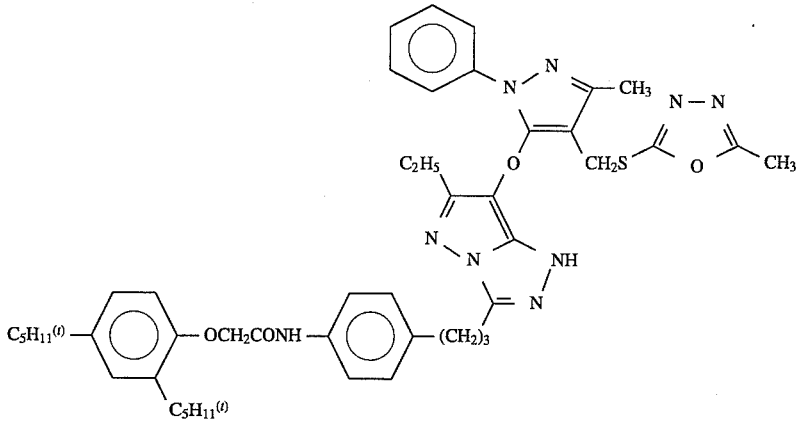
(35)
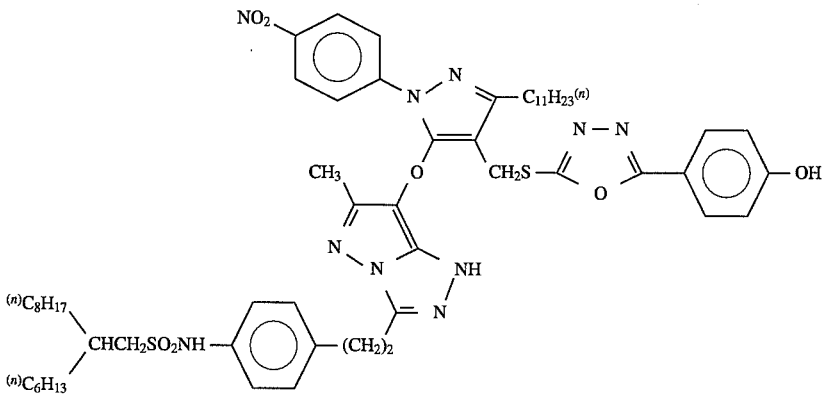

-continued
(36)
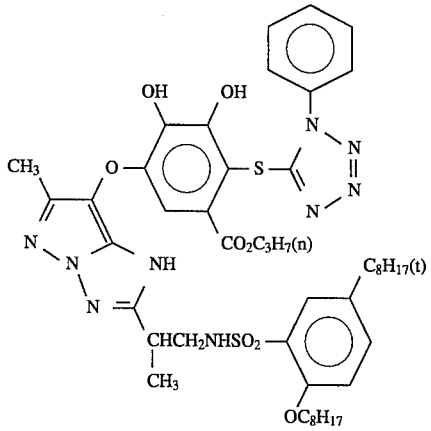
(37)
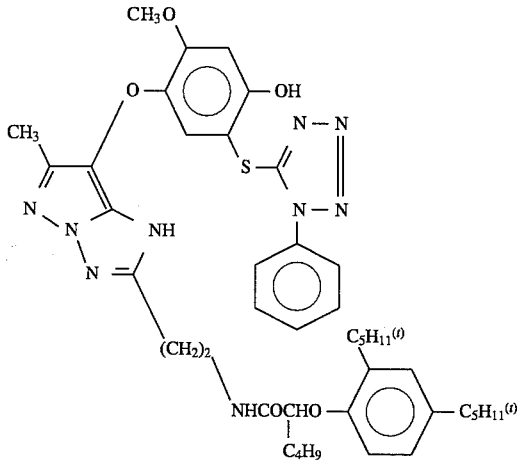
(38)
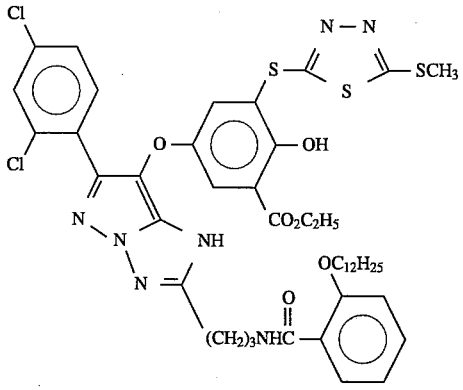
(39)
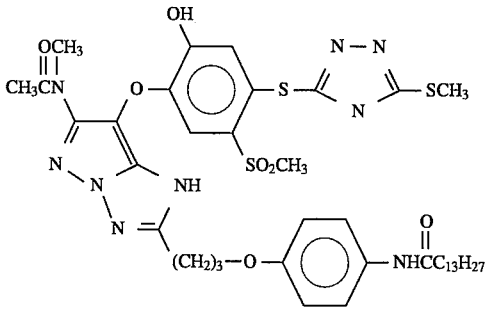

-continued
(40)
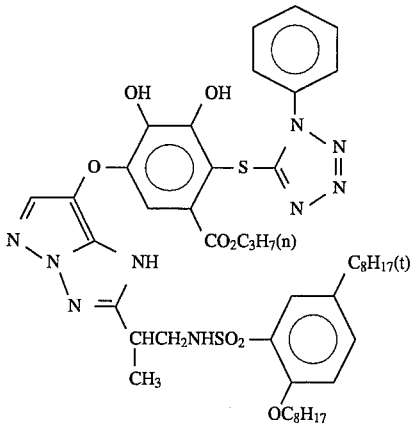
(41)
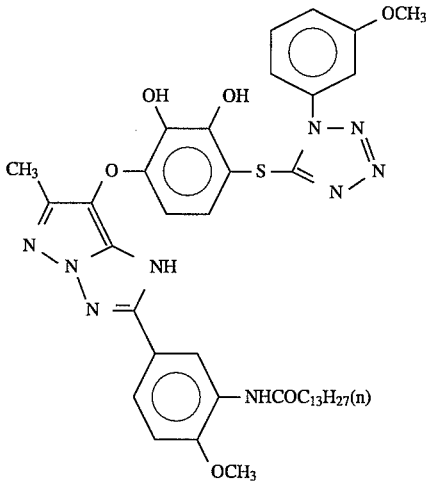
(42)
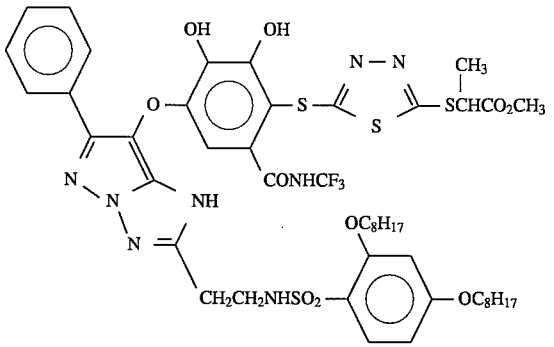
(43)
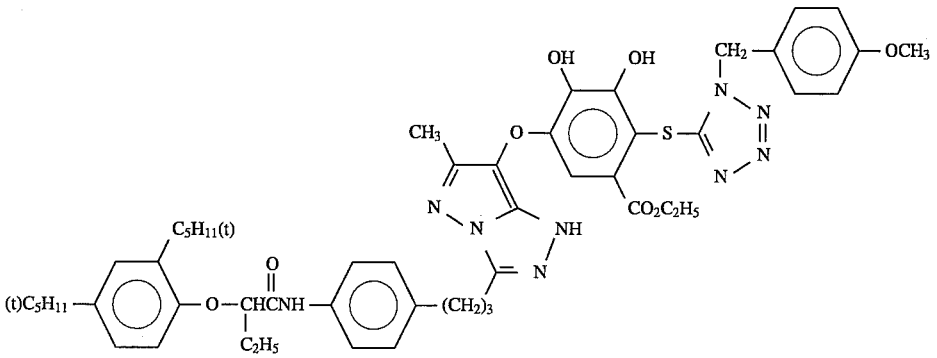

-continued
(44)
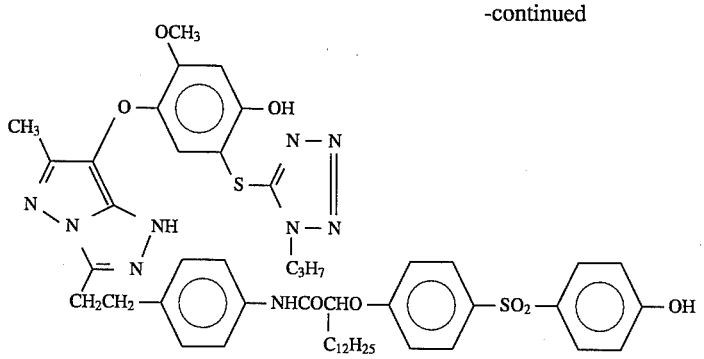
(45)
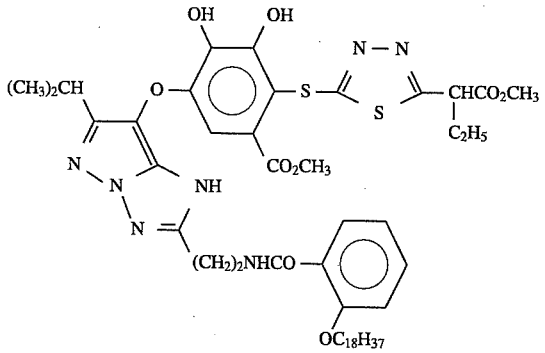
(46)
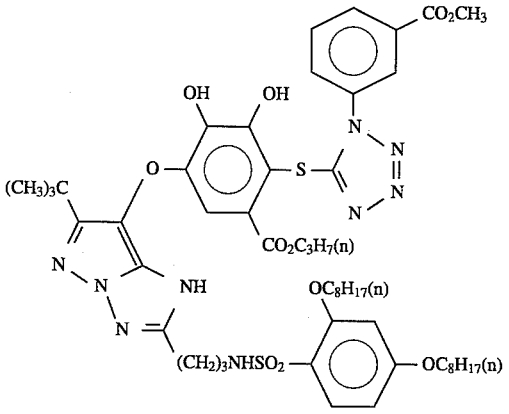
(47)
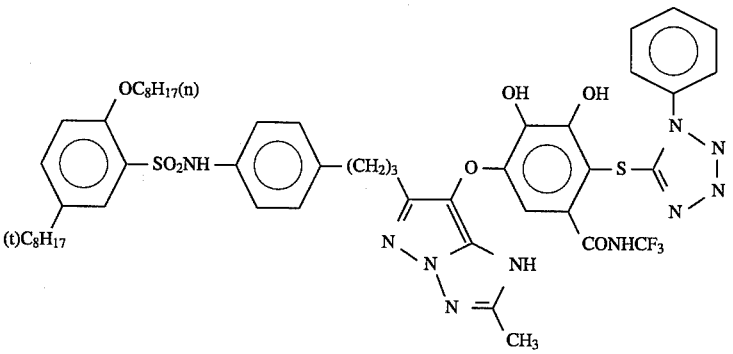

-continued
(48)
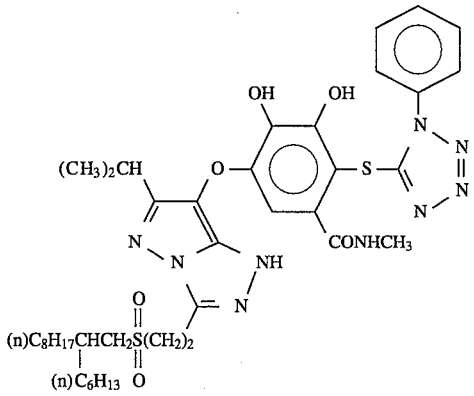
(49)
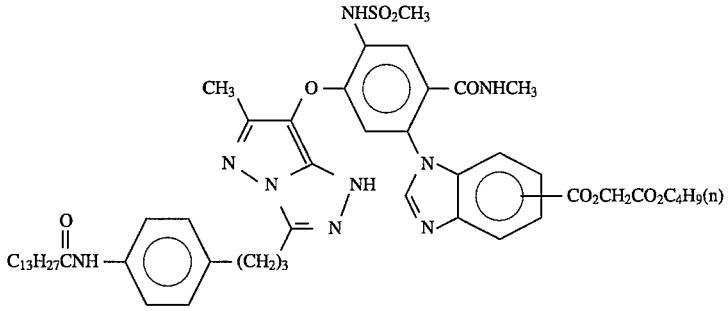
(50)
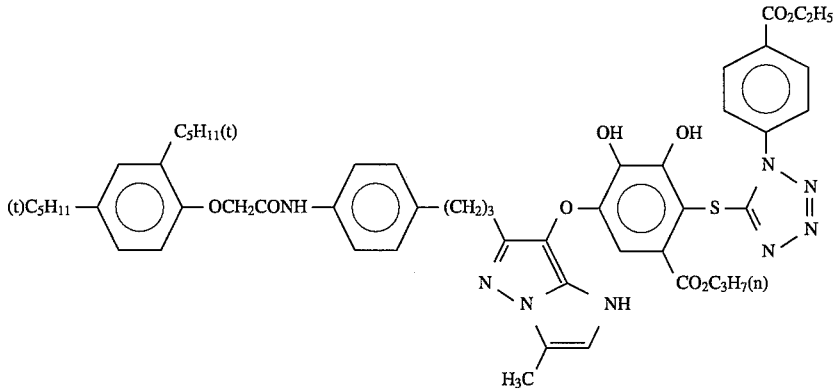
(51)
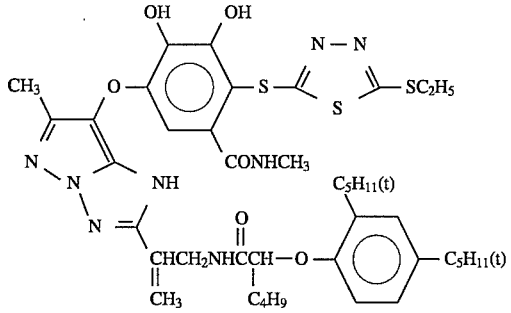

-continued
(52)
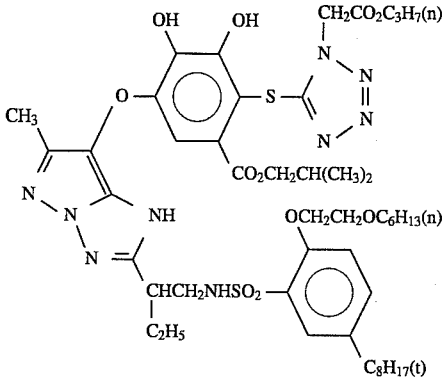
(53)
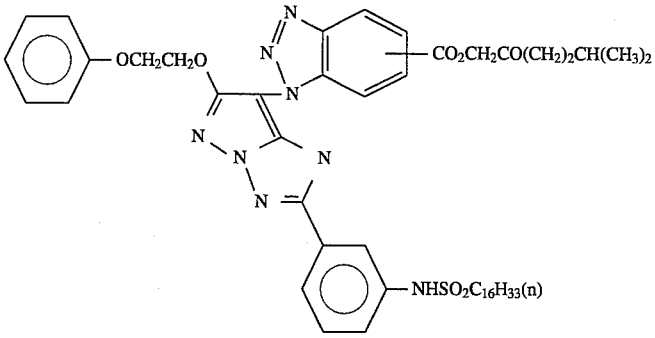
(54)
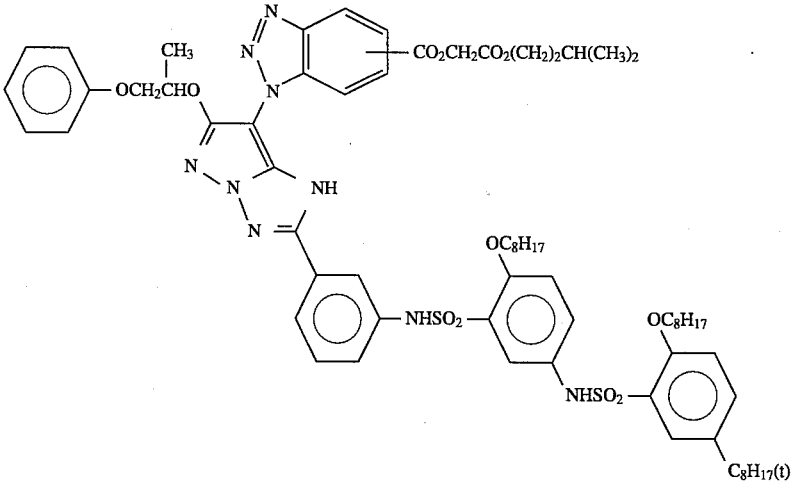
(55)
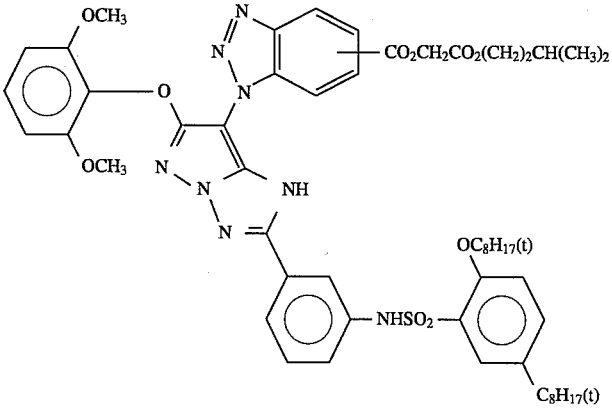

-continued
(56)
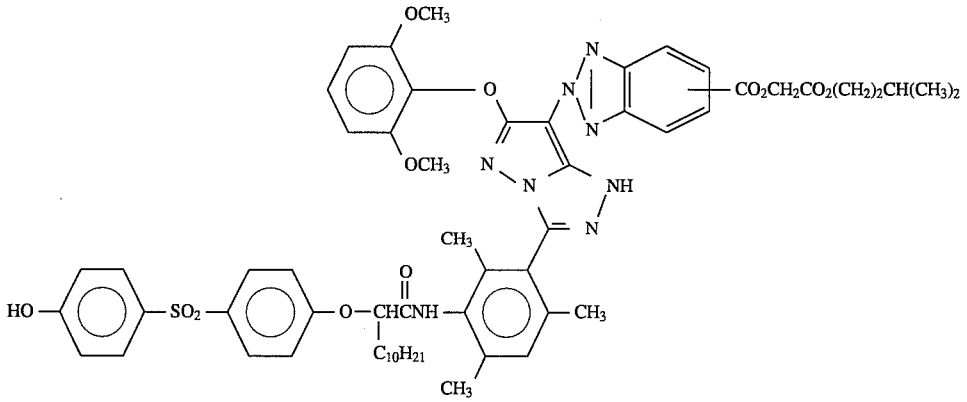
(57)
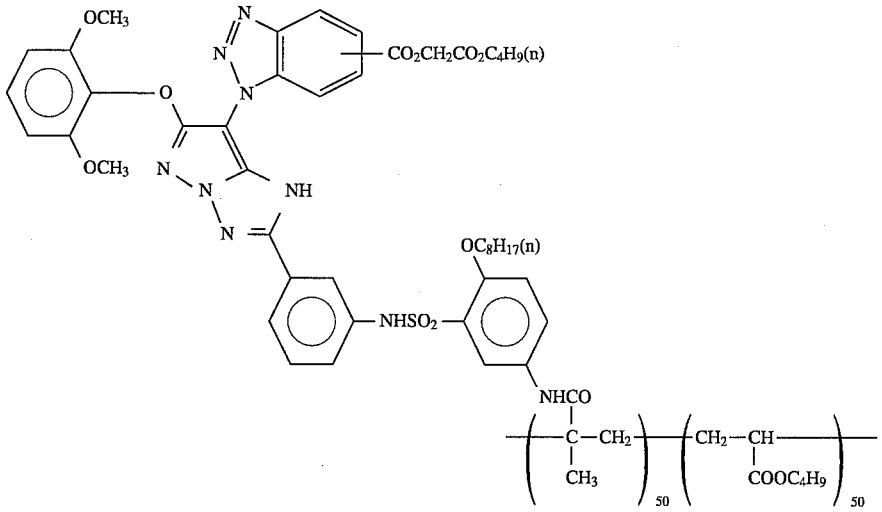
The compounds represented by formula (I) can be prepared using the methods disclosed, for example, in U.S. Pat. Nos. 4,500,630, 4,540,654 and 4,705,863, JP-A-61-65245, JP-A-62-209457, JP-A-62-249155, U.S. Pat. No. 3,725,067, JP-A-60-33552, JP-A-61-28947, JP-A-63-284159, JP-A-2-59584 and U.S. Pat. No. 4,659,625.
Examples of the preparation of compounds of formula (I) are described below.
EXAMPLE OF SYNTHESIS 1
(The Preparation of Illustrative Coupler (5))
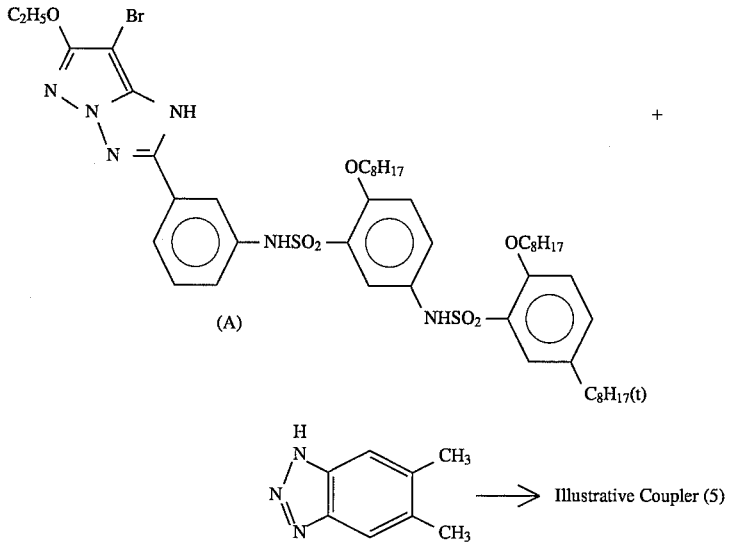

Sodium hydride (1.95 grams, 0.049 mol) was added to 100 ml of 1,3-dimethylimidazolidin-2-one and stirred while cooling in an ice/water bath. 5,6-Dimethylbenzotriazole (7.18 gram, 0.049 mol) was added to this mixture in several portions over a period of 20 minutes. After stirring for a further 10 minutes, 19.2 grams of compound (A) (0.020 mol) was added and the mixture was stirred at 80° C. for 40 minutes. After cooling, 300 ml of ethyl acetate, 300 ml of water and 8 ml of concentrated hydrochloric acid were added and the mixture was extracted. The organic layer was washed sequentially with water, saturated aqueous sodium bicarbonate solution and saturated aqueous salt solution, and then dried over anhydrous magnesium sulfate. The oily material obtained by concentration was separated using silica gel column chromatography (eluant: chloroform/ethyl acetate), and 14.1 grams of illustrative coupler (5) (yield 69%) was obtained as a glass like solid. This was added to 20 ml of ethyl acetate and dissolved, 80 ml of hexane was added, and the mixture was left to stand. The crystals which precipitated out were recovered by filtration and 10.9 grams of Illustrative Coupler (5) was obtained as colorless crystals. Melting point 131°–133° C.

$^1$H-NMR Spectrum (200 MHz, $CDCL_3$) δ: 12.92 (brs, 1H), 7.67 (d, 1H, J=2.2 Hz), 7.5–7.3 (m, 4H), 7.26 (s, 1H), 7.08 (brs, 1H), 6.90 (d, 1H, J=8.7 Hz), 6.81 (d, 1H, J=8.8 Hz), 5.66 (brs, 1H), 4.39 (q, 2H, J=7.1 Hz), 4.15 (t, 2H, J=6.7 Hz), 4.00 (brt, 2H), 3.4–3.1 (m, 3H), 2.36 (s, 3H), 2.30 (S, 3H), 2.0–1.8 (m, 5H), 1.60 (S, 2H), 1.5–1.2 (m, 32H), 0.85 (m, 6H), 0.51 (s, 9H)

EXAMPLE OF SYNTHESIS 2

(The Preparation of Illustrative Coupler (13)

Sodium hydride (2.01 grams, 0.050 mol) was added to 80 ml of 1,3-dimethylimidazolidin-2-one and cooled in an ice/water bath. 5,6-Dimethoxybenotriazole (8.99 grams, 0.050 mol) was divided into five portions and added to this mixture over a period of 20 minutes. After stirring for a further 10 minutes, 25.0 grams (0.023 mol) of compound (A) of Example of Synthesis 1 was added, and the mixture was stirred for 10 minutes at room temperature, and then it was heated to 65° to 70° C. in an oil bath and stirred for 2.5 hours. After cooling, 300 ml of ethyl acetate, 300 ml of water and 5 ml of concentrated hydrochloric acid were added and the mixture was extracted. The organic layer was washed sequentially with water, and saturated aqueous salt solution and then dried over anhydrous magnesium sulfate. The gum-like substance obtained on concentration was separated using silica gel column chromatography (eluant: hexane/ethyl acetate). After concentration, a solution was obtained by heating in 60 ml of ethyl acetate, 180 ml of hexane was added to the solution, and the mixture was cooled. The crystals which precipitated out were recovered by filtration, and 12.0 grams (yield 49%) of Illustrative Coupler (13) was obtained as faintly orange colored crystals. Melting point 144°–148° C.

$^1$H-NMR Spectrum (200 MHz, $CDCL_3$) δ: 13.2 (brs, 1H), 7.82 (d, 1H), 7.74 (S, 1H), 7.67 (d, 1H, J=2.2 Hz), 7.4–7.1 (m, 6H), 7.02 (s, 1H), 6.92 (s, 1H), 6.91 (d, 1H, J=3.7 Hz), 6.79 (d, 1H, J=8.7 Hz), 6.72 (d, 1H, 9 Hz), 4.49 (q, 2H, J=7.0 Hz), 4.1–3.9 m, 4H), 3.95 (s, 3H), 3.78 (s, 3H), 1.78 (br, 8H), 1.58 (S, 2H), 1.41 (t, 3H, J=7.0 Hz), 1.3–1.1 (m, 22H), 0.83 (m, 6H), 0.47 (s, 9H)

EXAMPLE OF SYNTHESIS 3

(The Preparation of Illustrative Coupler (14))

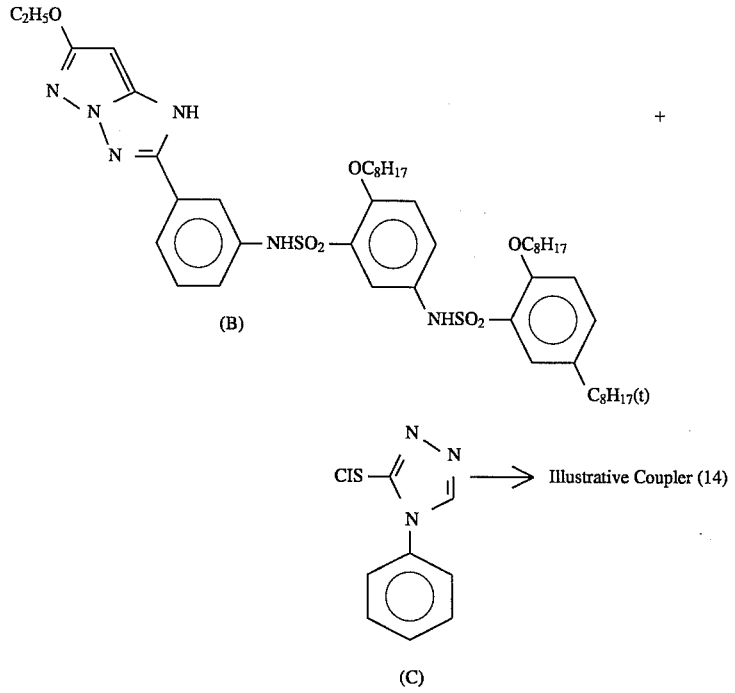

4-Phenyl-3-mercapto-1,2,4-triazole (4.4 grams, 0.025 mol) was dissolved in 50 ml of dichloromethane and stirred while cooling in water at 18° C. Sulfuryl chloride (2.2 ml, 0.027 mol) was added dropwise to this solution over a period of 10 minutes, and the mixture was then stirred for a further 15 minutes. The dichloromethane was distilled off under reduced pressure, and Compound (C) was obtained as light yellow crystals. Compound (B) (15.0 grams, 0.017 mol) was added to 30 ml of N,N-dimethylformamide and stirred at room temperature. The crystals of Compound (C) prepared beforehand were added in several portions over a period of 1 hour. After being left to stand overnight, 150 ml of ethyl acetate and 150 ml of water were added and the mixture was extracted. The organic layer was washed twice with saturated sodium bicarbonate solution and once with saturated salt water and then dried over anhydrous magnesium sulfate. The oily material obtained on concentration was separated using silica gel column chromatography (eluant: chloroform/ethyl acetate) and Illustrative Coupler (14) was obtained as a glass-like solid. This coupler was dissolved with heating in 20 ml of ethyl acetate, 40 ml of hexane was added, and the mixture was left to stand. The crystals which precipitated out were recovered by filtration and 13.8 grams (yield 77%) of Illustrative Coupler (14) was obtained as colorless crystals. Melting point 158°–162° C.

$^1$H-NMR Spectrum (200 MHz, $CDCL_3$), δ: 13.89 (brs, 1H), 8.39 (s, 1H), 7.65 (d, 1H, J=2.3 Hz), 7.6–7.3 (m, 11H), 7.2–7.0 (m, 3H), 6.77 (m, 2H), 4.1–3.9 (m, 7H), 1.84 (m, 4H), 1.6–1.3 (m, 31H), 0.86 (m, 6H), 0.46 (s, 9H)

EXAMPLE OF SYNTHESIS 4

(The Preparation of Illustrative Compound (36)

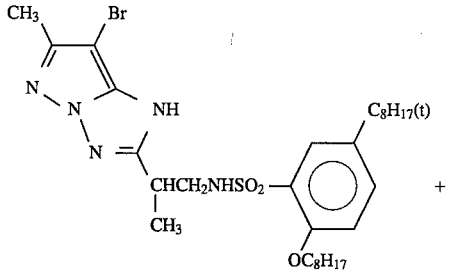

Intermediate (P)

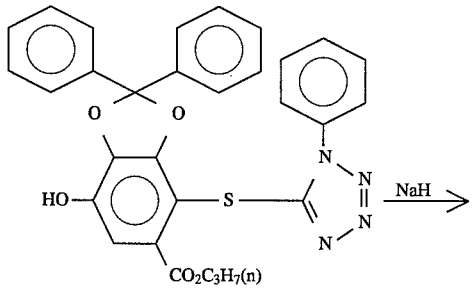

Intermediate (Q)

-continued

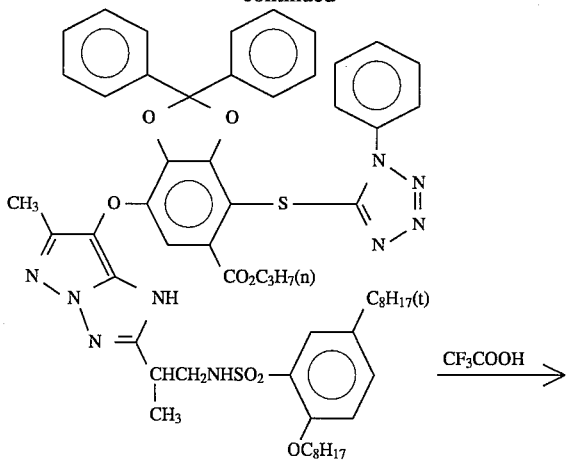

Intermediate (R)

Illustrative Coupler (36)

Preparation of Intermediate (R)

Sodium hydride (dispersed in mineral oil, content 60 wt %) (6.00 grams) was added to 150 ml of 1,3-dimethyl-2-imidazolidone, and the mixture was cooled in a water bath with stirring. Intermediate (Q) (82.9 grams) was divided into several portions and added over a period of about 10 minutes. After the water bath was removed the mixtuure was stirred for 10 minutes. Intermediate (P) (31.9 grams) was then added, and the mixture was stirred for 10 minutes at room temperature, after which the mixture was heated to 120° to 130° C. and stirred for about 1 hour. The heating was then stopped and, after returning to room temperature, 400 ml of ethyl acetate, 400 ml of water and 6 ml of concentrated hydrochloric acid were added and the mixture was extracted. The organic layer was washed with 400 ml of water, washed twice with 400 ml of saturated salt water, and dried over anhydrous magnesium sulfate. After concentration under reduced pressure, the residue was refined using silica gel column chromatography (eluant: hexane/ethyl acetate solvent mixture) and 18.7 grams (34%) of intermediate (R) was obtained as a non-crystalline solid.

Preparation of Illustrative Compound (36)

Intermediate (R) (14.4 grams) was dissolved in 45 ml of trifluoroacetic acid. Water (2.25 ml) was added to the solution, and the mixture was stirred for 16 hours at 50° C. After cooling, 200 ml of ethyl acetate and 200 ml of water were added and the mixture was extracted. The organic layer was washed twice with 150 ml of saturated sodium bicarbonate solution and once with 150 ml of saturated salt water. After drying over anhydrous magnesium sulfate, the organic layer was concentrated under reduced pressure. The residue was refined using silica gel column chromatography (eluant: hexane/ethyl acetate/ethanol solvent mixture), and 8.1 grams (66%) of Illustrative Coupler (36) was obtained as a non-crystalline solid.

$^1$H-NMR Spectrum ($CDCl_3$) δ: 11.5 (br), 7.84 (d, 1H), 7.9–7.6 (br), 7.50 (m, 6H), 6.94 (d, 1H), 6.84 (brs, 1H), 5.75 (br, 1H), 4.10 (m, 4H), 3.18 (m, 3H), 2.08 (brs, 3H), 1.9–1.2 (m, 25H), 0.80 (m, 6H), 0.70 (s, 9H)

EXAMPLE OF SYNTHESIS 5

(The Preparation of Illustrative Coupler (40))

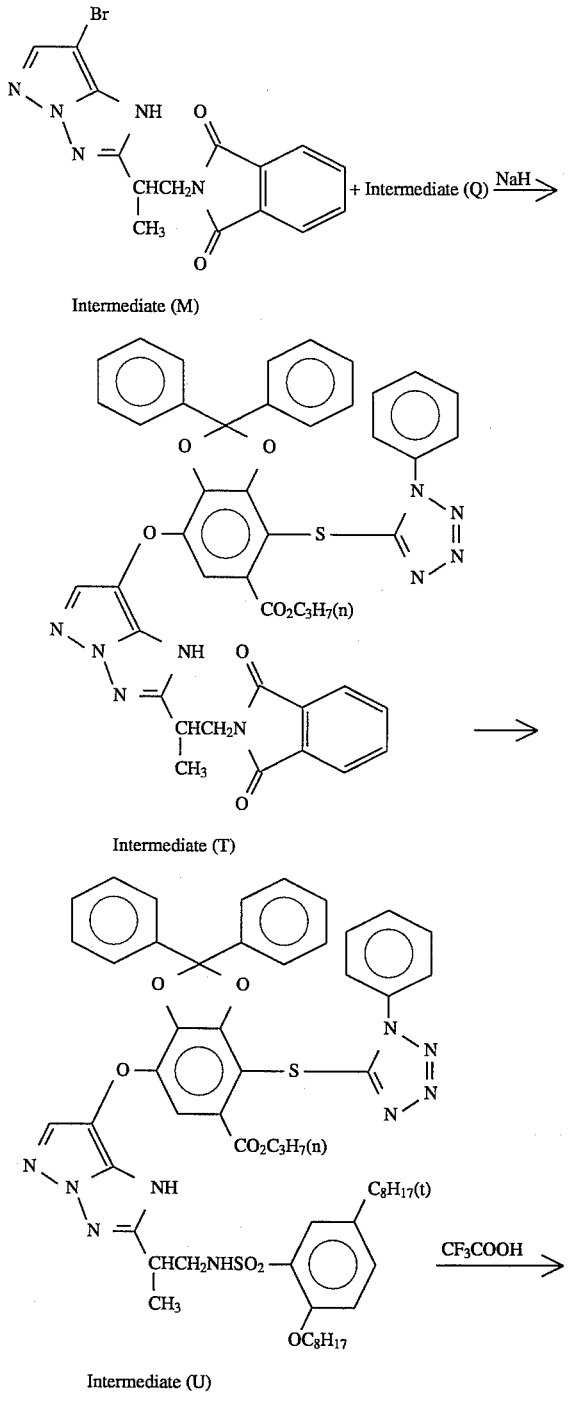

Preparation of Intermediate (T)

Intermediate (Q) (166 grams) was dissolved in 500 ml of 1,3-dimethyl-2-imidazolidone and cooled in an ice/water bath. Sodium hydride (12.0 grams) (dispersed in mineral acid content 60 wt %) was divided into several portions and added with vigorous stirring and then the ice/water bath was removed and the mixture was stirred for 30 minutes. Intermediate (M) (37.4 grams) was added to the mixture. After stirring for 10 minutes at room temperature, the mixture was stirred for 2 hours at 130° to 140° C. After cooling, 1.2 liters of ethyl acetate, 1.0 liter of water and 10 ml of concentrated hydrochloric acid were added and the mixture was extracted. The organic layer was washed with 1.0 liter of water and then washed twice with 1.0 liter of saturated salt water. The organic layer was then dried over anhydrous magnesium sulfate and concentrated under reduced pressure. The residue was refined using silica gel column chromatography (eluant: chloroform/ethyl acetate solvent mixture) and 27.6 grams (33%) of Intermediate (T) was obtained.

Preparation of Intermediate (U)

Intermediate (T) (27.6 grams) was dissolved in a mixed solvent comprised of 150 ml of isopropyl alcohol and 50 ml of acetonitrile, 3.16 ml of hydrazine hydrate was added, and the mixture was stirred for 4 hours at room temperature. After standing at room temperature, 20 ml of ethyl acetate was added, and the solvent was distilled off under reduced pressure. The residue was dissolved by adding 150 ml of ethyl acetate, washed twice with 150 ml of saturated sodium bicarbonate solution, and washed once with 150 ml of saturated salt water. The crystals which precipitated out on standing were recovered by filtration. The crystals obtained were dissolved in a solvent mixture comprised of 100 ml of ethyl acetate and 20 ml of N,N-dimethylacetamide and stirred at room temperature. 2-Octyloxy-5-tert-octylbenzenesulfonyl chloride (7.92 grams) was added to this solution, and then 2.65 ml of triethylamine was added dropwise over a period of 10 minutes. After stirring for a further period of 1 hour at room temperature, 50 ml of ethyl acetate, 150 ml of water and 2 ml of concentrated hydrochloric acid were added and the mixture was extracted. The organic layer was washed with saturated salt water and then dried over anhydrous magnesium sulfate. After concentration under reduced pressure, the mixture was refined using silica gel column chromatography (eluant: hexane/ethyl acetate solvent mixture) and 16.8 grams (47%) of Intermediate (U) was obtained as a non-crystalline solid.

Preparation of Illustrative Compound (40)

Intermediate (U) (16.2 grams) was dissolved in 32 ml of trifluoroacetic acid, 1.6 ml of water was added and the mixture was stirred at 50° C. for 10 hours. After being left to stand at room temperature, 100 ml of ethyl acetate and 100 ml of water were added and the mixture was extracted. The organic layer was washed twice with 100 ml of saturated sodium bicarbonate solution and once with 100 ml of saturated salt water. Then the organic solution was dried over anhydrous magnesium sulfate. After concentration under reduced pressure, the residue was crystallized out from ethyl acetate/hexane and 8.2 grams (59%) of Illustrative Compound (40) was obtained as colorless crystals. Melting point 150°–152° C.

$^1$H-NMR Spectrum ($CDCl_3$) δ: 11.5 (br, 1H), 8.5 (br), 7.84 (d. 1H), 7.6–7.4 (m, 6H), 7.33 (S, 1H), 6.99 (s, 1H), 6.92 (d, 1H), 5.71 (brt. 1H), 4.07 (m, 4H), 3.19 (m, 3H), 1.9–1.2 (m, 25H), 0.79 (m, 6H), 0.65 (s, 9H)

The compounds represented by formula (I) of the present invention can be used by addition to any layer, but they are preferably added to a green sensitive emulsion layer and/or a layer adjacent thereto, or to an intermediate layer. Furthermore, the compounds may be used individually or mixtures of two or more types may be used. Moreover, mixtures of the compounds with compounds which release development inhibitors or precursors thereof on reacting with one molecule or two molecules of the oxidized form of a developing agent, which are outside the scope of the present invention can also be used.

The amount of the compounds which are outside the scope of the present invention, when used in the same layer, is 1 to 200 mol %, preferably 5 to 100 mol % per mol of the ocmpounds of the present invention and, when used in the different layers, may be in any ratio relative to the amount of the compounds of the present invention but it is $1\times10^{-4}$ to 1 mol % per mol of silver halide present in the same layer or the adjacent layer.

A total amount added of the compounds represented by formula (I) of the present invention to the photographic material is 0.001 to 0.85 g/m$^2$, preferably 0.005 to 0.65 g/m$^2$ and more preferably 0.02 to 0.45 g/m$^2$.

The compounds of the present invention can be added to the photographic material in the same manner as a method of dispersing conventional couplers as described hereinafter.

The tabular silver halide emulsions used in the present invention are described in detail below.

For the tabular silver halide emulsions which are used in the present invention, the average aspect ratio signifies the average value of the ratio of the diameter with respect to the thickness of the silver halide grains. That is to say, it is the average value of the values obtained by dividing the diameter of each silver halide grain by its thickness. Here, the diameter is taken as the diameter of a circle which has the same area as the projected area of the grain when the silver halide emulsion is observed using a microscope or an electron microscope.

Furthermore, the thickness of the grain is represented by the distance between the two parallel planes with which the tabular silver halide grain is constructed. Hence, when the average aspect ratio is at least 2:1, the diameter of the corresponding circle is at least twice the thickness of the grain.

For the tabular silver halide grains which are used in the silver halide emulsions of the present invention, the grain diameter is at least twice the grain thickness, but it is preferably from 3 to 20 times, more desirably from 4 to 15 times, and most desirably from 5 to 10 times, the grain thickness. Furthermore, the proportion of the projected area of all of the silver halide grains accounted for by tabular silver halide grains is at least 50%, but it is preferably at least 70% and most desirably at least 85%.

It is possible to obtain silver halide photographic photosensitive materials which have excellent sharpness using emulsions of this type. Excellent sharpness is achieved because the light scattering by an emulsion layer in which such an emulsion has been used is very small when compared with that observed with a conventional emulsion layer. This fact can be confirmed easily using methods well known to those in the industry. The reason that the extent of light scattering in an emulsion layer in which a tabular silver halide emulsion has been used is so low is unclear, but it is thought that it may be due to the principal planes of the tabular silver halide emulsion being orientated in a direction parallel with the surface of the support.

In the present invention, the preferred tabular silver halide grains have a grain diameter of at least 0.3 μm but not more than 10.0 μm and a grain thickness of not more than 0.3 μm. Moreover, the average diameter/thickness ratio is at least 5 but not more than 10. If this value is exceeded anomalies arise in photographic performance when the photosensitive material is folded, wound up tightly or touched with a sharp object and this is undesirable. Silver halide photographic emulsions in which grains of a diameter of at least 0.4 μm but not more than 5.0 μm and of an average diameter/thickness ratio of at least 5 account for at least 85% of the total projected area of all the grains, are most desirable.

The tabular silver halide grains which are used in the present invention may comprise silver chloride, silver bromide, silver chlorobromide, silver iodobromide or silver chloroiodobromide, but silver bromide, silver iodobromide containing at least 7 mol % silver iodide or silver chlorobromide and silver chloroiodobromide which contains not more than 50 mol % silver chloride and not more than 2 mol % silver iodide are preferred. The composition distribution in a mixed silver halide may be uniform or localized.

Furthermore, an emulsion of the present invention may have a wide grain size distribution, but a narrow grain size distribution is preferred.

The tabular silver halide emulsions used in the present invention have been disclosed in a report by Cugnac and Chateau, in *Photographic Emulsion Chemistry* edited by Duffin (Focal Press, New York, pages 66–72, 1966) and by A. P. H. Trivelli and W. D. Smith in *Phot. Journal,* 80 (1940), page 285. They can be prepared easily with reference to the methods disclosed in JP-A-58-113927, JP-A-58-113928 and JP-A-58-127921.

For example, these emulsions can be obtained by forming seed crystals combined with tabular grains which are present in an amount of at least 40% under conditions of a pBr of not more than 1.3 at comparatively high pAg values and by growing the seed crystals by adding silver and halogen solutions simultaneously while maintaining them at a similar pBr value. It is desirable that the silver and halogen solutions should be added in such a way that no new crystal nuclei are formed in the grain growth process.

The size of the tabular silver halide grains can be controlled by controlling the temperature, selecting the type and nature of the solvents, and controlling the rate of addition of the silver salt and the halide which are used during grain growth.

The grain size, the form of the grains (diameter/thickness ratio for example), the grain size distribution and the growth rate of the grains can be controlled by using silver halide solvents, as required, during the manufacture of the tabular silver halide grains of the present invention. The amount of solvent used is preferably within the range from $10^{-3}$ to 1.0 wt %, and most desirably within the range from $10^{-2}$ to $10^{-1}$ wt %, of the reaction solution. In the present invention, the grain size distribution tends to become mono-disperse as the amount of solvent used is increased, and the growth rate can be increased. On the other hand the thickness of the grains tends to increase as the amount of solvent used is increased.

The known silver halide solvents can be used in the present invention. Frequently used silver halide solvents include ammonia, thioether, thioureas, thiocyanate and thiazoline thiones. Reference can be made to U.S. Pat. Nos. 3,271,157, 3,574,628 and 3,790,387 for example in connection with thioether. Furthermore reference can be made to JP-A-53-82408 and JP-A-55-77737 in connection with thioureas, to U.S. Pat. Nos. 2,222,264, 2,448,534 and 3,320,069 in connec-tion with thiocyanate and to JP-A-53-144319 in connection with thiazoline thiones.

Cadmium salts, zinc salts, lead salts, thallium salts, iridium salts and complex salts thereof, rhodium salts and complex salts thereof and iron salts and complex salts thereof, for example, may be present during the processes of formation or physical ripening of the silver halide grains.

The methods in which the rates of addition of the silver salt solution (for example, aqueous $AgNO_3$ solution) and halide solution (for example, aqueous KBr solution) which are added, the amounts added and the addition concentrations are increased in order to speed up grain growth are preferably used when manufacturing the tabular silver halide grains which are used in the present invention. Reference can be made, for example, to U.S. Pat. Nos. 1,335,925, 3,650,757, 3,672,900 and 4,242,445, JP-A-55-142329 and JP-A-55-158124 in connection with these methods.

The tabular silver halide grains of the present invention can be chemically sensitized as required. The methods described on pages 675–735 of *Die Grundlagen der Photographishen Prozesse mit Silberhalogeniden*, by H. Frieser, (published by Akademische Verlagsgesellschaft, 1968) can be used, for example, for chemical sensitization.

That is to say, sulfur sensitization methods involving active gelatin or compounds which contain sulfur which can react with silver (for example, thiosulfate, thioureas, mercapto compounds, rhodanines), selenium sensitization methods involving compounds which contain selenium (for example, colloidal metallic selenium, isoselenocyanates, selenoureas, selenoketones, selenoamides, selenocarboxylic acids and esters, selenides, selenophosphates); reduction sensitization methods in which reducing substances (for example, stannous salts, amines, hydrazine derivatives, formamidinesulfinic acid, silane compounds) are used; and precious metal sensitization methods involving precious metal compounds (for example, gold complex salts and complex salts of metals of group VIII of the periodic table such as Pt, Ir, Pd etc.), can be used either individually or in combination for this purpose.

Examples of the sulfur sensitization method have been disclosed, for example, in U.S. Pat. Nos. 1,574,944, 2,278,947, 2,410,689, 2,728,668 and 3,656,955, examples of the selenium sensitization method have been disclosed, for example, in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patents 2,693,038 and 2,093,209, JP-B-52-34491, JP-B-52-34492, JP-B-53-295, JP-B-57-022090, JP-A-59-180536, JP-A-59-185330, JP-A-59-181337, JP-A-59-187338, JP-A-59-192241, JP-A-60-150046, JP-A-60-151637, JP-A-61-246738, British Patents 255,846 and 861,984, and by H. E. Spencer et al. in *Journal of Photographic Science*, volume 31, pages 158–169 (1983); examples of reduction sensitization methods have been disclosed, for example, in U.S. Pat. Nos. 2,419,974, 2,983,609 and 4,054,458; and examples of precious metal sensitization have been disclosed, for example, in U.S. Pat. Nos. 2,399,083 and 2,448,060, and British Patent 618,061. (The term ("JB-B" as used herein signifies an "examined Japanese patent publication".)

From the viewpoint of silver economy, the tabular silver halide grains of the present invention are preferably subjected to gold sensitization, sulfur sensitization or selenium sensitization, or to a combination of these methods of sensitization.

The tabular silver halide grains of the present invention can be spectrally sensitized using methine dyes or by other means, as required. Furthermore, the tabular silver halide grains of the present invention are characterized by having a high spectral speed as well as having the improved sharpness mentioned earlier. The dyes which can be used include cyanine dyes, merocyanine dyes, complex cyanine dyes, complex merocyanine dyes, holopolar cyanine dyes, hemicyanine dyes, styryl dyes and dyes. Dyes classified as cyanine dyes, merocyanine dyes and complex merocyanine dyes are especially useful.

Useful sensitizing dyes have been disclosed, for example, in West German Patent 929,080, U.S. Pat. Nos. 2,493,748, 2,503,776, 2,519,001, 2,912,329, 3,656,959, 3,672,897 and 4,025,349, British Patent 1,242,588 and JP-B-44-14030.

These sensitizing dyes may be used individually, or they may be used in combinations. Such combinations of sensitizing dyes are often used with a view to achieving supersensitization. Typical examples have been disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Patent 1,344,281, JP-B-43-4936, JP-B-53-12375, JP-A-52-109925 and JP-A-52-110618.

Various compounds can be included in the photographic emulsions which are used in the present invention with a view to preventing the occurrence of fogging during the manufacture, storage or photographic processing of the sensitive material or with a view to stabilizing photographic performance. That is to say, many compounds which are known as anti-foggants or stabilizers, for example, azoles such as benzothiazolium salts, nitroimidazoles, triazoles, benzotriazoles, benzimidazoles (especially nitro- or halogen-substituted benzimidazoles); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; heterocyclic mercapto compounds as indicated above which have water solubilizing groups such as carboxyl groups or sulfo groups; thioketo compounds such as oxazolinethione; azaindenes, for example triazaindenes, tetrazaindenes (especially 4-hydroxy-substituted (1,3,3a,7)-tetraazaindenes); benzenethiosulfonic acids and benzenesulfinic acid, can be added. Reference can be made to U.S. Pat. Nos. 3,954,474, 3,982,947, 4,021,248 or JP-B-52-28660 for more details of examples and methods of using these materials.

Multilayer structure grains in which silver iodobromide which contains 15 to 45 mol % silver iodide is present with a distinct layer structure can also be used desirably for the aforementioned emulsions of the present invention.

A distinct layer-like structure as mentioned herein can be assessed by means of an X-ray diffraction method. An example of the application of an X-ray diffraction method to silver halide grains has been described by H. Hersh in *Journal of Photographic Science*, volume 10 (1962), page 129 et seq. If the lattice constant is determined by the halogen composition, diffraction peaks are produced at the diffraction angles which satisfy the Bragg conditions ($2d \sin \theta = n\lambda$).

The method of measurement with X-ray diffraction has been described in detail, for example, in *Fundamental Analytical Chemistry Course* 24, *"X-Ray Diffraction"*, (Kyoritsu Shuppan) and in *An Introduction to X-Ray Diffraction* (Rigaku Denki K.K.). The standard method of measurement involves obtaining the diffraction curve of the (220) plane of the silver halide using Cu for the target and the Cu $K_\beta$ line for the line source (tube voltage 40 KV, tube current 60 mA). The slit widths (scattering slit, light receiving slit etc.), the time constant of the apparatus, the goniometer scanning rate and the recording speed are selected in order to increase the resolving capacity of the apparatus, and the measuring accuracy must be confirmed using a standard sample such as silicon.

Two distinct layer structures in thdfe present invention are such that there are at least two diffraction maxima, namely a diffraction peak corresponding to the high iodine layer which contains 15 to 45 mol % silver iodide and a peak corresponding to the low iodine layer which contains less than 8 mol % silver iodide with one minimum value between them, and the ratio of diffraction intensity corresponding to the high iodine layer with respect to that of the peak corresponding to the low iodide layer is from 1/5 to 10/1. More desirably, the diffraction intensity ratio is from 1/3 to 5/1, and most desirably it is from 1/3 to 3/1.

An emulsion having substantially two distinct layer structures for use in the present invention has a minimum diffraction intensity between two peaks, the minimum diffraction intensity being preferably not more than 90%, more preferably not more than 60% of the weakest intensity of two or more maximum (peak) diffraction intensities.

It is well known how to analyze diffraction curves having two diffraction components. It is described, for example, in *Experimental Physics Course* 11, "*Latice Defects*" (Kyoritsu Shuppan).

Analysis can be carried out by a curve analyzer made by the DuPont company, for example, assuming that the curve is a Gaussian function of a Lorenz function.

In the case of an emulsion in which two types of grain which have different halogen compositions but which do not have a distinct layer structure are present, there are also two peaks when X-ray diffraction is carried out as described above.

Differentiation between an emulsion in which the silver halide emulsion is in accordance with the present invention. An emulsion in which two types of silver halide grain are present as mentioned above can be achieved using the EPMA method (electron probe microanalyzer method) as well as the X-ray diffraction method.

This method involves preparing a sample in which the emulsion grains are well scattered so that there is no contact between them and irradiating with an electron beam. An elemental analysis of microscopic parts is then carried out using X-ray analysis with electron beam excitation.

The halogen composition of individual grains can be determined by obtaining the intensities of the specific X-rays for silver and iodine which are being discharged from each grain.

If the halogen composition is verified using the EPMA method for at least 50 grains then it can be deduced whether the emulsion is an emulsion of the present invention.

An emulsion of the present invention is preferably such that the iodine content is relatively uniform from grain to grain. When the iodine content from grain to grain is measured using the EPMA method the relative standard deviation is preferably less than 50%, and most desirably less than 35%.

Another desirable inter-grain iodine distribution is that in which there is a positive correlation between the logarithm of the grain size and the iodine content. In this case large grains have a high iodine content and small grains have a low iodine content. A correlation which has a correlation coefficient of at least 40% is preferred.

The silver halide other than silver iodide in the core part may be either silver chlorobromide or silver bromide, but a higher proportion of silver bromide is preferred.

The composition of the outermost layer is that of a silver halide which contains not more than 8 mol % silver iodide, and preferably that of a silver halide which contains not more than 5 mol % silver iodide.

The silver halide other than silver iodide in the outermost layer may be silver chloride, silver chlorobromide or silver bromide, but a higher proportion of silver bromide is desirable.

The effect of the invention is pronounced when the average silver iodide content of the whole grain of the tabular silver halide emulsion is at least 7 mol %. An average silver iodide content of at least 10 mol % is preferred, and an average silver iodide content of at least 12 mol % is most desirable.

The aforementioned emulsions of the present invention are preferably mono-disperse.

A mono-disperse emulsion in the context of the present invention is an emulsion which has a grain size distribution such that the variation coefficient S/r relating to the grain size of the silver halide grains is not more than 0.25. Here, r is the average grain size and S is the standard deviation. That is to say, if the size of each individual grain is $R_i$ and the number of silver halide grains is $n_i$, the average grain size r is defined by the following equation:

$$r = \frac{\Sigma n_i \cdot r_i}{\Sigma n_i}$$

Moreover, the standard deviation S is defined by the following equation:

$$S = \sqrt{\frac{\Sigma (r - ri)^2 \cdot n_i}{\Sigma n_i}}$$

The size of the individual grains in the present invention is the projected area corresponding diameter corresponding to the area projected when the silver halide emulsion is subjected to microphotography (usually electron microscopic photography) using the methods well known in the industry, as described by T. E. James in *The Theory of the Photographic Process*, third edition, pages 36–43 (published by Macmillan, 1966). Here, the projected area corresponding diameter of a silver halide grain is defined as the diameter of a circle of which the area is equal to the projected area of the silver halide grain, as indicated in the above mentioned textbook. Hence, the average grain size r and its standard deviation S as mentioned above can also be obtained in cases where the form of the silver halide grains is other than spherical (for example when the grains are cubic, octahedral, tetradecahedral, tabular or potato shaped).

The variation coefficient of the grain size of the silver halide grains is not more than 0.25, but it is preferably not more than 0.20, and most desirably it is not more than 0.15.

The monodisperse hexagonal tabular silver halide emulsions disclosed in JP-A-63-151618 are especially desirable as tabular silver halide emulsions of the present invention.

Here, a hexagonal tabular silver halide grain is a grain such that the shape of its {1,1,1} plane is hexagonal, and it is characterized by the fact that the ratio of adjacent sides is not more than 2. Here, the ratio of adjacent sides is the ratio of the length of the longest side with respect to the length of the smallest side forming the hexagonal shape. If the ratio of adjacent sides is less than 2 with a hexagonal tabular silver halide grain of the present invention, the corners may be rather rounded. The edge length in cases where the corners are rounded is represented by the distance between the points of intersection of the lines extending from the straight line parts of the adjoining sides with the extension of the straight line part of the side under consideration. Each side of the hexagonal shape of a hexagonal tabular grain of the present invention is preferably such that at least ½ of its length is an essentially straight line, and most desirably such that at least 4/5 of its length is an essentially straight line. A ratio of adjacent sides of from 1 to 1.5 is desirable in the present invention.

Hexagonal tabular silver halide emulsions of the present invention are comprised of a dispersion medium and silver halide grains, and at least 50%, preferably at least 70%, and most desirably at least 90%, of the total projected area of the said silver halide grains is accounted for by the above mentioned hexagonal tabular silver halide grains. These grains have two parallel planes as external surfaces.

In the present invention the halogen composition of the hexagonal tabular silver halide grains may be that of silver bromide, silver iodobromide, silver chlorobromide or silver chloroiodobromide, but it is preferably that of silver bromide or silver iodobromide. In the case of silver iodobromide, the silver iodide content is from 0 to 30 mol %, preferably from 4 to 20 mol %, and most desirably from 7 to 15 mol %. The distribution of silver iodide within the grains may be uniform throughout the whole grain, or the silver iodide contents in the interior part and the surface layer of the grain may be different, or the grain may have a so-called multilayer structure in which there are layers which have different silver iodide contents within the grain. But so-called internal iodine type grains in which the silver iodide content at the grain surface is less than that within the grain are preferred.

Reference can be made to U.S. Pat. No. 4,797,354 in connection with methods for the manufacture of hexagonal tabular silver halide emulsions.

The preparation of monodisperse hexagonal tabular silver halide emulsions is divided into the processes of nuclei formation, Ostwald ripening and grain growth. During nuclei formation, the pBr value is maintained at 1.0 to 2.5, and nuclei formation is carried out under supersaturated conditions (temperature, gelatin concentration, addition rates of the aqueous silver salt solution and the aqueous alkali metal halide solution, the pBr value, the iodine ion content, the stirring rate, the pH, the silver halide solvent content and the salt concentration etc.) such that as many nuclei which have parallel twinned crystal planes (tabular grain nuclei) as possible are formed. During Ostwald ripening, the temperature, the pBr value, the pH value, the gelatin concentration and the amount of silver halide solvent, etc., are adjusted so that the grains other than the tabular grains which have been formed during nuclei formation disappear, only tabular nuclei grow, and nuclei which have good monodispersivity are obtained. Hexagonal tabular silver halide grains which have the prescribed aspect ratio and grain size can then be obtained by controlling the pBr value and the amounts of silver ion and halogen ion which are added during grain growth. The rate of addition of silver ion and halogen ion during grain growth is preferably from 30% to 100% of the limiting crystal growth rate.

The tabular silver halide emulsions of the present invention are generally subjected to chemical sensitization.

Chemical sensitization can be carried out after silver halide emulsion formation as described above, and the aforementioned emulsion may be washed with water after formation of the silver halide emulsion but before chemical sensitization.

Chemical sensitization has been described in *Research Disclosure* No. 17643 (December 1978, page 23) and in *Research Disclosure* No. 18716 (November 1979, page 648, righthand column). It can be carried out at a pAg value of from 5 to 10, a pH value of from 5 to 8 and at a temperature of from 30° C. to 80° C., using sulfur, selenium, tellurium, gold, platinum, palladium, iridium or a combination of these sensitizing agents.

The tabular silver halide emulsions of the present invention are preferably chemically sensitized in the presence of spectrally sensitizing dyes. Methods of chemical sensitization in the presence of spectrally sensitizing dyes have been disclosed, for example, in U.S. Pat. Nos. 4,425,426 and 4,442,201, JP-A-59-9658, JP-A-61-103149 and JP-A-61-133941. Spectrally sensitizing dyes generally used in silver halide photographic photosensitive materials can be used for this purpose. These spectrally sensitizing dyes have been described on pages 23–24 of *Research Disclosure* No. 17643 and from the righthand column on page 648 to the right hand column on page 649 of *Research Disclosure* No. 18716.

A single type of spectrally sensitizing dye may be used, or a mixture of a plurality of such dyes may be used.

The time of the addition of the spectrally sensitizing dyes may be before the commencement of chemical sensitization (during grain formation, after the completion of grain formation or after washing with water), during chemical sensitization or after the completion of chemical sensitization. But addition after the completion of grain formation and before the commencement of chemical sensitization or after the completion of chemical sensitization is preferred.

The amount of spectrally sensitizing dye added is optional, but from 30% to 100% of the amount on saturation absorption is preferred, and from 50% to 90% of the amount on saturated absorption is more preferred.

The tabular silver halide emulsions of the present invention are normally subjected to spectral sensitization. The spectrally sensitizing dyes described above and in the two *Research Disclosures* mentioned above can be used as spectrally sensitizing dyes. Emulsions in which spectrally sensitizing dyes are present at the time of chemical sensitization, as described above, may or may not have more of the same dye or a different type of dye added subsequently for spectral sensitization.

Emulsions of the present invention may be used individually in a photosensitive emulsion layer, or two or more emulsions which have different average grain sizes or two or more emulsions which have different silver iodide contents may be mixed and used in the same photosensitive layer. The use of mixed emulsions, as indicated above, is preferred from the viewpoint of gradation control, the control of graininess over the whole range from low exposure regions to high exposure regions, and control of color developer dependence (dependence on time and the composition in the developer in terms of sodium sulfite salts of the color developing agent for example, and dependence on pH).

Furthermore, emulsions of the present invention have been disclosed in JP-A-60-143332 and JP-A-60-254032, and the relative standard deviation of the silver iodide content between grains is most desirably not more than 20%.

The use of compounds which can be represented by formula (A) indicated below is most desirable in thfe present invention from the viewpoint of improving photographic speed, graininess and storage stability:

$$Q\text{-}SM^1 \qquad (A)$$

In this formula, Q represents a heterocyclic group which has at least one group selected from among $—SO_3M^2$, $—COOM^2$, —OH and $—NR^1R^2$ bonded directly or indirectly thereto, $M^1$ and $M^2$ each independently represents a hydrogen atom, an alkali metal, a quaternary ammonium or a quaternary phosphonium, and $R^1$ and $R^2$ each represents a hydrogen atoms or a substituted or unsubstituted alkyl group.

Examples of the heterocyclic group represented by Q in formula (A) include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring and a thiadiazine ring, and rings which are bonded with other carbocyclic or heterocyclic rings, such as a benzothiazole ring, a benzotriazole ring, a benzimidazole ring, a benzoxazole ring, a benzoselenazole ring, a naphthoxazole ring, a triazaindolidine ring, a diazaindolidine ring and a tetraazaindolidine ring.

Those compounds which can be represented by following formulae (B) and (C) are especially desirable from among the mercapto heterocyclic compounds which can be represented by formula (A):

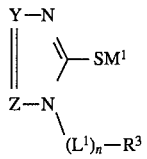

(B)

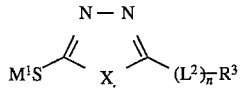

(C)

In formula (B), Y and Z each independently represents a nitrogen atom or $CR^4$ (where $R^4$ represents a hydrogen atom, a substituted or unsubstituted alkyl group, or a substituted or unsubstituted aryl group), and $R^3$ represents an alkyl or an aryl group which is substituted with at least one species selected from among $—SO_3M^2$, $—COOM^2$, —OH and $—NR^1R^2$, and examples include an alkyl group which has from 1 to 20 carbon atoms (for example, methyl, ethyl, propyl, hexyl, dodecyl, octadecyl) and an aryl group which has from 6 to 20 carbon atoms (for example, phenyl, naphthyl), $L^1$ represents a linking group selected from among —S—, —O—, —(N—)—, —CO—, —SO— and $—SO_2—$, and n is 0 or 1, wherein when $R^3$ has at least two substituents selected from $—SO_3M^2$, $—COOM^2$, —OH and $NR^1R^2$, the substituents may be the same or different, and $R^1$, $R^2$, $M^1$ and $M^2$ each has the same meaning as defined for formula (A).

These alkyl groups and aryl groups may be substituted with other substituent groups, such as halogen atoms (for example, F, Cl, Br), alkoxy groups (for example, methoxy, methoxyethoxy), aryloxy groups (for example, phenoxy), alkyl groups (when $R^2$ is an aryl groups), aryl groups (when $R^2$ is an alkyl group), amido groups (for example, acetamido, benzoylamino), carbamoyl groups (for example, unsubstituted carbamoyl, phenylcarbamoyl, methylcarbamoyl), sulfonamido groups (for example, methanesulfonamido, phenylsulfonamido), sulfamoyl groups (for example, unsubstituted sulfamoyl, methylsulfamoyl, phenylsulfamoyl), sulfonyl groups (for example, methylsulfonyl, phenylsulfonyl), sulfinyl groups (for example, methylsulfinyl, phenylsulfinyl), cyano groups, alkoxycarbonyl groups (for example, methoxycarbonyl), aryloxycarbonyl groups (for example, phenoxycarbonyl) and nitro groups.

In those cases where there are two or more of the substituent groups $—SO_3{}^2M$, $—COOM^2$, —OH and $—NR^1R^2$ on $R^3$, these groups may be the same or different.

$M^2$ has the same meaning as $M^2$ in formula (A).

In formula (C), X represents a sulfur atom, an oxygen atom or $—NR^5—$, and $R^5$ represents a hydrogen atom, a substituted or unsubstituted alkyl group or a substituted or unsubstituted aryl group.

$L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR_6CONR^7—$, $—NR^6COO—$, $—OCONR^6—$ or $—NR^6SO_2NR^7—$, and $R^6$ and $R^7$ each represents a hydrogen atom, a substituted or unsubstituted alkyl group or a substituted or unsubstituted aryl group.

$R^3$, $M^1$ and $M^2$ have the same meaning as those terms in formulae (A) and (B), and n represents 0 or 1.

Moreover, the substituent groups of the alkyl groups and aryl groups represented by $R^4$, $R^5$, $R^6$ and $R^7$ are the same as the substituent groups described in connection with $R^3$.

In these formulae, $R^3$ is most desirably $—SO_3M^2$ or $—COOM^2$.

Examples of preferred compounds which can be represented by formula (A) which can be used in the present invention are shown below:

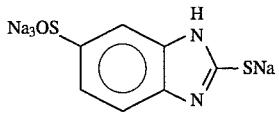

(A-1)

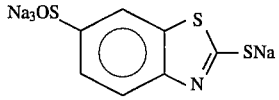

(A-2)

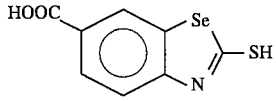

(A-3)

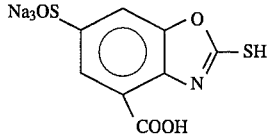

(A-4)

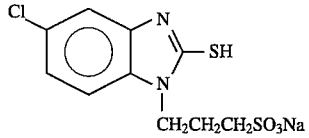

(A-5)

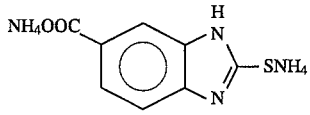

(A-6)

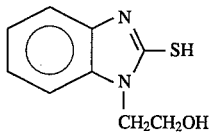

(A-7)

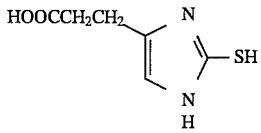

(A-8)

(A-9)
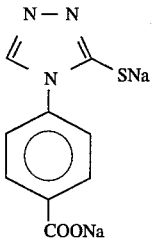
(A-10)
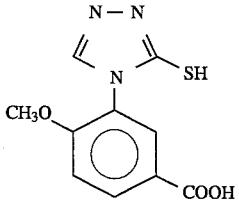
(A-11)
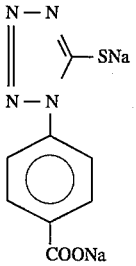
(A-12)
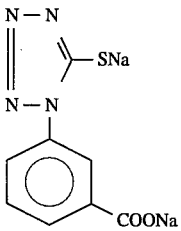
(A-13)
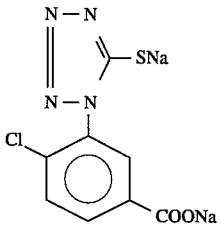
(A-14)
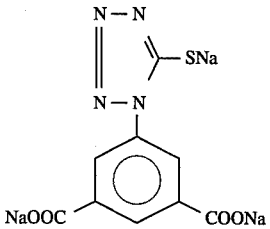
(A-15)
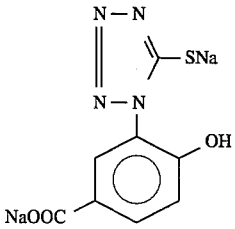
(A-16)
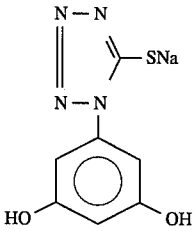
(A-17)
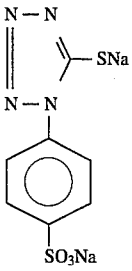
(A-18)
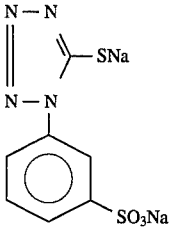
(A-19)
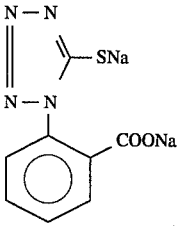
(A-20)
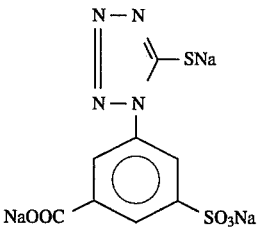
(A-21)
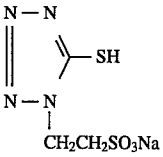
(A-22)
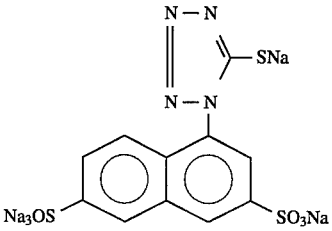

-continued (A-23)

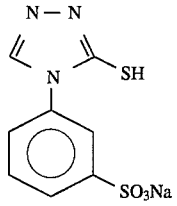

(A-24)

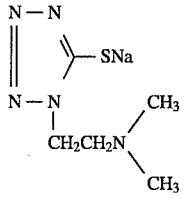

(A-25)

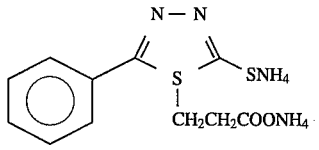

(A-26)

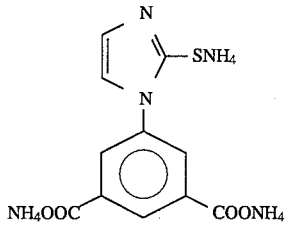

(A-27)

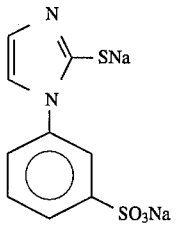

(A-28)

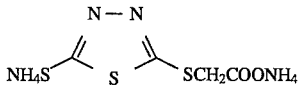

(A-29)

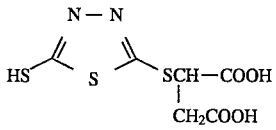

(A-30)

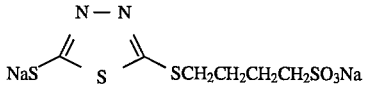

(A-31)

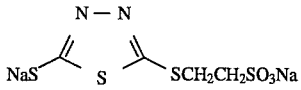

(A-32)

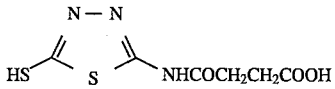

(A-33)

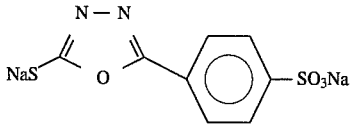

-continued (A-34)

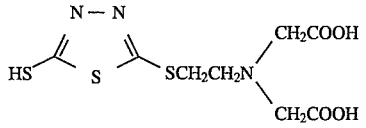

(A-35)

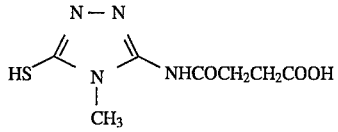

(A-36)

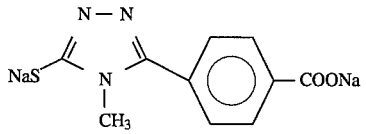

(A-37)

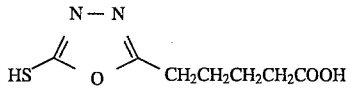

(A-38)

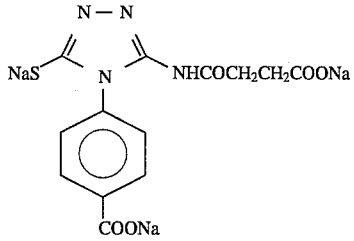

(A-39)

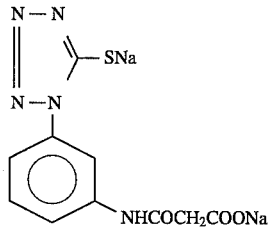

Compounds which can be represented by formula (A) are known, and they can be prepared using the methods disclosed in the literature shown below: U.S. Pat. Nos. 2,585,388 and 2,541,924, JP-B-42-21842, JP-A-53-50169, British Patent 1,275,701, D. A. Berges et al., *Journal of Heterocyclic* Chemistry, volume 15, No. 981 (1978), *The Chemistry of heterocyclic Chemistry, Imidazole and Derivatives part I*, pages 336–9, *Chemical Abstracts* 58, No. 7921 (1963), page 394, E. Hoggarth, *Journal of the Chemical Society*, pages 1160–7 (1949), S. R. Sandler and W. Karo, *Organic Functional Group Preparations*, Academic Press, pages 312–5 (1968), M. Chamdon et al., *Bulletin de la Société Chimique de France*, 723 (1954), D. A. Shirley and D. W. Alley, *J. Am. Chem. Soc.*, 79, 4922 (1954), A. Whol and W. Marchwald, *Berichte* (German Chemical Society Journal), volume 22, page 568 (1889), *J. Am. Chem. Soc.*, 44, 1502–10, U.S. Pat. No. 3,017,270, British Patent 940,169, JP-B-49-8334, JP-A-55-59463, *Advances in Heterocyclic Chemistry*, 9, 165–209 (1968), West German Patent 2,716,707, *The Chemistry of Heterocyclic Compounds Imidazole and Derivatives*, volume 1, page 384, *Organic Syntheses* IV, 569 (1963), *Berichte* 9, 465 (1976), *J. Am. Chem. Soc.*, 45, 2390 (1923), JP-A-50-89034, JP-A-53-28426, JP-A-55-21007 and JP-A-40-28496.

The compounds represented by formula (A) are included in a silver halide emulsion layer or a hydrophilic colloid layer (for example, intermediate layers, surface protective layers, yellow filter layers, anti-halation layers), but they are preferably included in a silver halide emulsion layer or in a layer adjacent thereto.

Furthermore, the amount added is from $1\times10^{-7}$ to $1\times10^{-3}$ mol/m$^2$, preferably from $5\times10^{-7}$ to $1\times10^{-4}$ mol/m$^2$, and most desirably from $1\times10^{-6}$ to $3\times10^{-5}$ mol/m$^2$.

A photosensitive material of the present invention should have, on a support, at least one of blue-sensitive silver halide emulsion layer, green-sensitive silver halide emulsion layer and red-sensitive silver halide emulsion layer. But no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have essentially the same color sensitivity but different degrees of photosensitivity, the photosensitive layer being a unit photosensitive layer which is color sensitive to blue light, green light or red light. In a multilayer silver halide color photographic material, the arrangement of the unit photosensitive layers generally involves their establishment in order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers, may be established between the above mentioned silver halide photosensitive layers, or as uppermost and lowermost layers.

These intermediate layers may contain couplers and DIR compounds such as those disclosed in the specifications of JP-A-61-43748, JP-A-59-113438, JP-A-59-113440, JP-A-61-20037 and JP-A-61-20038, and they may also contain anti-color mixing agents such as those generally used.

The plurality of silver halide emulsion layers constituting each unit photosensitive layer has preferably a double layer structure comprised of a high speed emulsion layer and a low speed emulsion layer as disclosed in West German Patent 1,121,470 or British Patent 923,045. Generally, arrangements in which the degree of photosensitivity is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and 62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. The layers can also be arranged in the order, from the side furthest away from the support, of blue sensitive layer/GL/RL/GH/RH, as disclosed in JP-A-56-25738 and JP-A-62-63936.

Moreover, there are arrangements in which there are three layers which have different speeds with the degree of photosensitivity falling towards the support with the silver halide emulsion layer of the highest photosensitivity at the top, a silver halide emulsion layer which has a lower photosensitivity than the aforementioned layer as an intermediate layer, and a silver halide emulsion layer which has an even lower photosensitivity than the intermediate layer as a bottom layer, as disclosed in JP-B-49-15495. In the case of structures of this type which have three layers with different degrees of photosensitivity, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer, for example. Furthermore, the arrangements may also be varied in the ways indicated above when there are four or more layers.

Arrangements in which a donor layer (CL) for a multilayer effect in which the spectral sensitivity distribution is different from that of the principal photosensitive layers such as the BL, GL, RL for example is established adjacent to, or in the proximity of, the principal photosensitive layers, as disclosed in U.S. Pat. Nos. 4,663,271, 4,705,744 and 4,707,436, JP-A-62-160448 and JP-A-63-89850 are desirable.

The various layer structures and arrangements can be selected respectively as described above according to the purpose of the photosensitive material.

The silver halide grains other than the tabular grains of the present invention are described below.

The preferred silver halides for inclusion in the photographic emulsion layers of a photographic photosensitive material used in the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at less than about 0.2 microns, or large with a projected area diameter of up to about 10 microns, and the emulsions may be polydisperse emulsions or monodisperse emulsions.

Silver halide photographic emulsions which can be used in the present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure*, No. 307105 (November 1989), pages 863–865, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964.

The monodisperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure. Moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type in which the latent image is formed principally on the surface, the internal latent image type in which the latent image is formed within the grains, or of a type in which the latent image is formed both at the surface and within the grains, but a negative type emulsion is essential. An example of the internal latent image type emulsions is a core/shell internal latent image type emulsion as disclosed in JP-A-63-264740. A method for the preparation of such a core/shell internal latent image type emulsion has been disclosed in JP-A-59-133542. The thickness of the shell of the emulsion differs according to the development processing for example but is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the photosensitive silver halide emulsion, the grain form or photographic speed can be used in the form of a mixture in the same layer in a photosensitive material of the present invention.

The presence of silver halide grains of which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable in the photosensitive silver halide emulsion layers and/or essentially non-photosensitive hydrophilic colloid layers. Silver halide grains in which the grain interior or surface has been fogged are silver halide grains which can be developed uniformly (not in the form of the image) irrespective of whether they are in an unexposed part or an exposed part of the photosensitive material. Methods for the preparation of silver halide grains in which the interior or surface has been fogged have been disclosed in U.S. Pat. No. 4,626,498 and JP-A-59-214852.

The silver halide which forms the internal nuclei of core/shell type silver halide grains in which the grain interior has been fogged may have the same halogen composition or different halogen compositions. The silver halide grains in which the grain interior or surface has been fogged may be silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains. They may be regular grains, and they may be polydisperse emulsions, but monodisperse emulsions (in which at least 95% in terms of the weight or number of silver halide grains have a grain size within ±40% of the average grain size) are preferred.

The use of non-photosensitive fine grained silver halides is desirable in the present invention. Non-photosensitive fine grained silver halides are fine grained silver halides which are not photosensitive at the time of the imagewise exposure for obtaining the dye image and which undergo essentially no development during development processing. Those which have not been pre-fogged are preferred.

The fine grained silver halide has a silver bromide content from 0 to 100 mol % and may contain silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as used in general for the preparation of photosensitive silver halides. In this case, the surface of the silver halide grains does not need to be optically sensitized, nor is there any need for spectral sensitization. However, the pre-addition of known stabilizers such as triazole, azaindene, benzothiazolium or mercapto based compounds or zinc compounds for example before addition to the coating liquid is desirable. Colloidal silver can also be included desirably in the layer which contains these fine grained silver halide grains.

The coated weight of silver in a photosensitive material of the present invention is preferably not more than 6.0 g/m$^2$, and most desirably not more than 4.5 g/m$^2$.

Known photographically useful additives which can be used in the present invention have also been disclosed in the three *Research Disclosures* referred to above, and the locations of these disclosures are also indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Supersensitizers | Pages 23–24 | Page 648 right hand column–page 649 right hand column | Pages 866–868 |
| 4. Bleaching Agents | Page 24 | Page 647, right hand column | Pages 868 |
| 5. Anti-foggants, Stabilizers | Pages 24–25 | Page 649, right hand column | Pages 868–870 |
| 6. Light Absorbers, | Pages 25–26 | Page 649, right hand | Page 873 |

-continued

| Type of Additive | RD17643 (December 1978) | RD18716 (November 1979) | RD307105 (November 1989) |
|---|---|---|---|
| Filter Dyes and Ultraviolet absorbers | | column–page 650, left hand column | |
| 7. Anti-staining Agents | Page 25, right hand column | Page 650, left hand column–right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors, Surfactants | Pages 26–27 | Page 650, right hand column | Pages 875–876 |
| 13. Antistatic agents | Page 27 | Page 650, right hand column | Pages 876–877 |
| 14. Matting Agents | | | Pages 878–879 |

Furthermore, addition of the compounds which can react with and fix formaldehyde disclosed in U.S. Pat. Nos. 4,411,987 and 4,435,503 to the photosensitive material is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 is desirable in a photosensitive material of the present invention.

The inclusion of compounds which release fogging agents, development accelerators, silver halide solvents or precursors of these materials irrespective of the amount of developed silver produced by development processing disclosed in JP-A-1-106052 is desirable in a photosensitive material of the present invention.

The inclusion of the dyes dispersed using the methods disclosed in International Patent laid open WO88/04794 and JP-A-1-502912, or the dyes disclosed in EP 317,308A, U.S. Pat. No. 4,420,555 and JP-A-1-259358 is desirable in a photosensitive material of the present invention.

Various color couplers can be used in the present invention, and examples have been disclosed in the patents cited in the aforementioned *Research Disclosure* No. 17643, sections VII-C–G, and *Research Disclosure* No. 307105, sections VII-C–G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795 are especially desirable.

Phenol and naphthol based couplers can be cited as cyan couplers. Those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A-64-553, JP-A-64-554, JP-A-64-555 and JP-A-64-556, and the imidazole based couplers disclosed in U.S. Pat. No. 4,818,672 can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers for which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 are also desirable.

The use of couplers which release photographically useful residual groups on coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The bleaching accelerator releasing couplers disclosed in *Research Disclosure* No. 11449, *Research Disclosure* No. 24241 and JP-A-61-201247 are effective for shortening the time of the processing operation which has a bleaching function. They are particularly effective in cases where they are added to photosensitive materials in which the aforementioned tabular silver halide grains are used. Furthermore, compounds which release fogging agents, development accelerators, silver halide solvents, etc., via a redox reaction with the oxidized form of a developing agent as disclosed in JP-A-60-107029, JP-A-60-252340, JP-A-1-44940 and JP-A-1-45687 are also desirable.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the couplers which release dyes in which the color is restored after elimination disclosed in European Patents 173,A and 313, 308A, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known methods.

Examples of high boiling point solvents which can be used in the oil in water dispersion method have been disclosed, for example, in U.S. Pat. No. 2,322,027. Examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C., can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and examples of latexes for loading purposes have been disclosed, for example, in U.S. Pat. No. 4,199,363, and in West German Patent Applications (OLS) 2,541,274 and 2,541,230.

The addition to the color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-272248 and JP-A-1-80941 is desirable.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105

The photosensitive materials of the present invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{1/2}$ is preferably not more than 30 seconds and most desirably not more than 20 seconds. Here, the film thickness signifies the film thickness measured under conditions of 25° C., 55% relative humidity (2 days) and the film swelling rate $T_{1/2}$ is that measured using the methods well known to those in the industry. For example, measurements can be made using a swellometer of the type described by A. Green in *Photogr. Sci. Eng.*, Volume 19, Number 2, pages 124–129, and $T_{1/2}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{1/2}$ can be adjusted by adding film hardening agents for the gelatin which is used as a binder, or by changing the ageing conditions after coating. Furthermore, a swelling factor of from 150% to 400% is preferred. The swelling factor can be calculated from the maximum swelled film thickness obtained under the conditions described above using the ratio (maximum swelled film thickness minus film thickness)/film thickness.

The establishment of a hydrophilic colloid layer (known as a backing layer) of total dry film thickness from 2 μm to 20 μm on the opposite side from the emulsion layers is desirable in a photosensitive material of the present invention. The inclusion of light absorbing agents, filter dyes, ultraviolet absorbers, anti-static agents, film hardening agents, binders, plasticizers, lubricants, coating promotors and surfactants for example, as described before, in this backing layer is desirable. The swelling factor of the backing layer is preferably from 150% to 500%.

Color photographic photosensitive materials which are in accordance with the present invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of the aforementioned *Research Disclosure* No. 307105.

The color developers used for the development processing of photosensitive materials of the present invention are preferably aqueous alkaline solutions which contain primary aromatic amine based color developing agent as the principal component. Aminophenol based compounds are also useful, but the use of p-phenylenediamine based compounds as color developing agents is preferred. Typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic, aminopolyphosphonic, alkylphosphonic and phosphonocarboxylic acids. Typical examples of these latter acids include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone and aminophenols such as N-methyl-p-aminophenol, for example, can be used individually, or in combinations, in the black and white developer. The pH of these color developers and black and white developers is generally from 9 to 12. Furthermore, the replenishment rate for these developers depends on the color photographic photosensitive material which is being processed but, in general, it is not more than 3 liters per square meter of photosensitive material. It can be set to not more than 500 ml by reducing the bromide ion concentration in the replenisher. In those cases where the replenishment rate is low, it is desirable that evaporation and airoxidation of the liquid be prevented by minimizing the area of contact with the air in the processing tank.

The contact area between the air and the photographic processing bath in a processing tank can be represented by the open factor which is defined below:

Open Factor=[Processing bath and Air Contact Area ($cm^2$)]÷[Processing Bath Volume ($cm^3$)]

The above mentioned open factor is preferably not more than 0.1, and most desirably from 0.001 to 0.05. In addition to the establishment of a shielding material such as a floating lid for example on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using certain means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as required. Compounds of multi-valent metals, such as iron(III) for example, peracids, quinones and nitro compounds can be used as bleaching agents. Typical bleaching agents include organic complex salts of iron(III), for example complex salts with aminopolycarboxylic acids such as ethylenediaminetetraacetic acid, diethylenetriaminepentaacetic acid, cyclohexanediaminetetraacetic acid, methylimino diacetic acid, 1,3-diaminopropanetetraacetic acid and glycol ether diaminetetraacetic acid, or citric acid, tartaric acid or malic acid. Among these materials, aminopolycarboxylic acid iron(III) complex salts, and principally of ethylenediaminetetraacetic acid iron(III) complex salts and 1,3-diaminopropanetetraacetic acid iron(III) salts, are preferred for the purposes of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix prebaths. Examples of useful bleach accelerators include: the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and a bromide ion. Among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive material. These bleaching accelerators are especially effective for bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids. In practice acetic acid, propionic acid and hydroxyacetic acid, for example, are preferred.

Thiosulfate, thiocyanate, thioether based compounds, thioureas and large amounts of iodide can be used, for example, as the fixing agent which is used in a fixing bath or bleach-fixing bath, but thiosulfate is generally used.

Ammonium thiosulfate in particular can be used in the widest range of applications. Furthermore, the conjoint use of thiosulfate and thiocyanate, thioether compounds, thiourea, etc., is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts of from 0.1 to 10 mol/liter to the fixing bath or bleach-fixing bath is desirable in the present invention.

A short total desilvering processing time within the range in which desilvering failure does not occur is preferred. The desilvering time is preferably from 1 to 3 minutes, and most desirably from 1 to 2 minutes. Furthermore, the processing temperature is from 25° C. to 50° C., and preferably from 35° C. to 45° C. The desilvering rate is improved and the occurrence of staining after processing is effectively prevented within the preferred temperature range.

Agitation as strongly as possible during the desilvering process is desirable. Examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the desilvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced. This is very effective for preventing deterioration in processing bath performance. These effects are especially effective for shortening the processing time in each process and for reducing the replenishment rate of each processing bath.

The silver halide color photographic photosensitive materials of the present invention are generally subjected to a water washing process and/or stabilizing process after the desilvering process. The amount of wash water used in the washing process can be fixed within a wide range, depending on the application and the nature (depending on the materials such as couplers which have been used for example) of the photosensitive material, the wash water temperature, the number of water washing tanks (the number of water washing stages) and the replenishment system, i.e., whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers*, Volume 64 (May 1955). The amount of wash water used can be greatly reduced by using the multi-stage counter-flow system noted in the aforementioned literature. But bacteria proliferate due to the increased residence time of the water in the tanks, and problems arise with the suspended matter which is produced becoming attached to the photosensitive material. The method disclosed in JP-A-62-288838 in which the calcium ion and magnesium ion concentrations are reduced is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Microorganisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of the present invention is from 4 to 9, and preferably from 5 to 8. The washing water temperature and the washing time can be set variously in accordance with the nature and application of the photosensitive material. But, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of the present invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process. The stabilizing baths which contain dye stabilizing agents and surfactants which are used as final baths with camera color photosensitive materials are examples of such a process. Aldehydes such as formaldehyde and glutaraldehyde, N-methylol compounds, hexamethylenetetramine and aldehyde/bisulfite addition compounds can be used, for example, as dye stabilizing agents. Various chelating agents and fungicides can also be added to these stabilizing baths.

The overflow which accompanies replenishment of the above mentioned water washing or stabilizing baths can be reused in other processes, such as the desilvering process.

Concentration correction with the addition of water is desirable in cases where the above mentioned processing baths become concentrated due to evaporation when processing in an automatic processor for example.

Color developing agents can be incorporated into a silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of the present invention with a view to accelerate color development. Typical compounds have been disclosed, for example, in JP-A-56-64339, JP-A-57-144547 and JP-A-58-115438.

The various processing baths in the present invention are used at a temperature of from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide photosensitive materials of the present invention can also be used in the heat developable photosensitive materials disclosed, for example, in U.S. Pat. No. 4,500,626, JP-A-60-133449, JP-A-59-218443, JP-A-61-238056 and European Patent 210,660A2.

ILLUSTRATIVE EXAMPLES

The invention is described in more detail below by means of illustrative examples, but the invention is not limited to these examples.

Example 1

Emulsions 1–5

An aqueous solution obtained by dissolving 30 grams of gelatin and 6 grams of potassium bromide in 1 liter of distilled water was stirred at 75° C. After adding 35 cc of an aqueous solution which contained 5.0 of silver nitrate and 35 cc of an aqueous solution which contained 3.2 grams of potassium bromide and 0.98 gram of potassium iodide over a period of 10 seconds at flow rates of 70 cc/min, a seed emulsion was obtained by raising the pAg value to 10 and ripening for 30 minutes.

The prescribed amount out of 1 liter of an aqueous solution which contained 145 grams of silver nitrate and an equimolar amount of an aqueous solution which contained potassium bromide and potassium iodide were added at a rate close to the critical growth rate at the prescribed temperature and pAg value, and tabular core emulsions were obtained. Moreover, the remainder of the aqueous silver nitrate solution and an equimolar amount of an aqueous solution of potassium bromide and potassium iodide which had a different composition to that used when preparing the core emulsion were added at a rate close to the critical growth rate, the cores were covered, and core/shell type silver iodobromide tabular emulsions 1–5 were obtained.

Control of the aspect ratio was achieved by selecting the pAg value during the preparation of the core and the shell. The results obtained are shown in Table 1.

TABLE 1

| Emulsion | Average Aspect Ratio[1)] | Average Average Aspect Ratio[2)] | Average Grain Size (μm) | Average Grain Thickness (μm) | Iodine Content (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |

TABLE 1-continued

| Emulsion | Average Aspect Ratio[1)] | Average Average Aspect Ratio[2)] | Average Grain Size (μm) | Average Grain Thickness (μm) | Iodine Content (mol %) |
|---|---|---|---|---|---|
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

[1)]The aspect ratio was measured for 1000 individual emulsion grains, the grains corresponding to 50% of the total projected area were selected from the grains of large aspect ratio and the average value for the aspect ratio of these grains was taken.

[2)]The average value of the aspect ratio of the grains corresponding to 85% of the total projected area in the same way as in 1) above.

Sample 101, a multi-layer color photosensitive material, was prepared by lamination coating of each of the layers of which the compositions are indicated below on a cellulose triacetate film on which an under-layer had been established.

Composition of the Photosensitive Layer

The numerical value corresponding to each component indicates the coated weight in units of g/m$^2$, the coated weight being shown as the calculated weight of silver in the case of the silver halides. However, with the sensitizing dyes the coated weight is indicated in units of mol per mol of silver halide in the same layer.

| Sample 101 | |
|---|---|
| First Layer (Anti-halation Layer) | |
| Black colloidal silver | as silver 0.18 |
| Gelatin | 1.40 |
| Second Layer (Intermediate Layer) | |
| 2,5-Di-tert-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer (First Red-Sensitive Emulsion Layer) | |
| Emulsion A | as silver 0.25 |
| Emulsion B | as silver 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.17 |
| Ex-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth Layer (Second Red-Sensitive Emulsion Layer) | |
| Emulsion E | as silver 1.10 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.20 |
| EX-3 | 0.050 |
| Ex-10 | 0.020 |
| EX-14 | 0.20 |
| EX-15 | 0.050 |

| Sample 101 | |
|---|---|
| U-1 | 0.070 |
| U-2 | 0.050 |
| U-3 | 0.070 |
| Gelatin | 1.30 |
| Fifth Layer (Third Red-Sensitive Emulsion Layer) | |
| Emulsion 1 | as silver 1.65 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-2 | 0.097 |
| EX-3 | 0.010 |
| EX-4 | 0.080 |
| Illustrative Compound (A-11) | $3.5 \times 10^{-4}$ |
| HBS-1 | 0.22 |
| HBS-2 | 0.10 |
| Gelatin | 1.63 |
| Sixth Layer (Intermediate Layer) | |
| EX-5 | 0.040 |
| HBS-1 | 0.020 |
| Gelatin | 0.80 |
| Seventh Layer (First Green-Sensitive Emulsion Layer) | |
| Emulsion A | as silver 0.15 |
| Emulsion B | as silver 0.15 |
| Sensitizing Dye IV | $3.0 \times 10^{-5}$ |
| Sensitizing Dye V | $1.0 \times 10^{-4}$ |
| Sensitizing Dye IV | $3.8 \times 10^{-4}$ |
| EX-1 | 0.010 |
| EX-6 | 0.25 |
| EX-7 | 0.020 |
| EX-16 | 0.090 |
| HBS-1 | 0.10 |
| HBS-3 | 0.010 |
| Gelatin | 0.63 |
| Eighth Layer (Second Green-Sensitive Emulsion Layer) | |
| Emulsion C | as silver 0.45 |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| EX-6 | 0.090 |
| EX-7 | 0.020 |
| EX-8 | 0.009 |
| EX-16 | 0.018 |
| HBS-1 | 0.16 |
| HBS-3 | $8.0 \times 10^{-3}$ |
| Gelatin | 0.50 |
| Ninth Layer (Third Green-Sensitive Emulsion Layer | |
| Emulsion 1 | as silver 1.40 |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| EX-1 | 0.013 |
| EX-11 | 0.065 |
| EX-13 | 0.015 |
| EX-16 | $4.0 \times 10^{-3}$ |
| Illustrative Compound (A-18) | $7.5 \times 10^{-4}$ |
| HBS-1 | 0.25 |
| HBS-2 | 0.10 |
| Gelatin | 1.54 |

| Sample 101 | |
|---|---|
| Tenth Layer (Yellow Filter Layer) | |
| Yellow colloidal silver | as silver 0.050 |
| EX-5 | 0.080 |
| HBS-1 | 0.030 |
| Gelatin | 0.95 |
| Eleventh Layer (First Blue-Sensitive Emulsion Layer) | |
| Emulsion A | as silver 0.080 |
| Emulsion B | as silver 0.070 |
| Emulsion D | as silver 0.070 |
| Sensitizing Dye VII | $3.5 \times 10^{-4}$ |
| EX-8 | 0.030 |
| EX-9 | 0.74 |
| HBS-1 | 0.28 |
| Gelatin | 1.10 |
| Twelfth Layer (Second Blue-Sensitive Emulsion Layer) | |
| Emulsion E | as silver 0.45 |
| Sensitizing Dye VII | $2.1 \times 10^{-4}$ |
| EX-9 | 0.16 |
| EX-10 | $8.0 \times 10^{-3}$ |
| HBS-1 | 0.050 |
| Gelatin | 0.78 |
| Thirteenth Layer (Third Blue-Sensitive Emulsion Layer) | |
| Emulsion F | as silver 0.78 |
| Sensitizing Dye VII | $2.2 \times 10^{-4}$ |
| EX-9 | 0.20 |
| HBS-1 | 0.070 |
| Gelatin | 0.69 |
| Fourteenth Layer (First Protective Layer) | |
| Emulsion G | as silver 0.20 |
| Illustrative Compound (A-18) | $8.0 \times 10^{-5}$ |
| U-4 | 0.11 |
| U-5 | 0.17 |
| HBS-1 | $5.0 \times 10^{-2}$ |
| Gelatin | 1.00 |
| Fifteenth Layer (Second Protective Layer) | |
| H-1 | 0.40 |
| B-1 (Diameter 1.7 μm) | $5.0 \times 10^{-2}$ |
| B-2 (Diameter 1.7 μm) | 0.10 |
| B-3 | 0.10 |
| S-1 | 0.20 |
| Gelatin | 1.20 |

Furthermore, W-1, W-2, W-3, B-4, B-5, F-1, F-2, F-3, F-4, F-5, F-6, F-7, F-8, F-9, F-10, F-11, F-12 and F-13, and iron salts, lead salts, gold salts, platinum salts, iridium salts and rhodium salts were included in all of the layers with a view to improving storage properties, processing properties, pressure resisting properties, fungicidal and biocidal properties, antistatic properties and coating properties.

The structural formula or chemical name of each compound used in the present invention is indicated below.

TABLE 2

| Emulsion | Average AgI Content (%) | Average Grain Size (μm) | Variation Coefficient of the Grain Size (%) | Diameter/ Thickness Ratio | Silver Weight Ratio (AgI Content %) |
|---|---|---|---|---|---|
| A | 4.0 | 0.45 | 27 | 1 | Core/Shell = 1/3 (13/1), Double Layer Structure Grains |
| B | 8.9 | 0.70 | 14 | 1 | Core/Shell = 3/7 (25/2), Double Layer Structure Grains |
| C | 10 | 0.75 | 30 | 2 | Core/Shell = 1/2 (24/3), Double Layer Structure Grains |
| D | 4.0 | 0.25 | 28 | 1 | Core/Shell = 1/3 (13/1), Double Layer Structure Grains |
| E | 14.0 | 0.75 | 25 | 2 | Core/Shell = 1/2 (42/0), Double Layer Structure Grains |
| F | 14.5 | 1.30 | 25 | 3 | Core/Shell = 37/63 (34/3), Double Layer Structure Grains |
| G | 1 | 0.07 | 15 | 1 | Uniform Grains |

EX-1

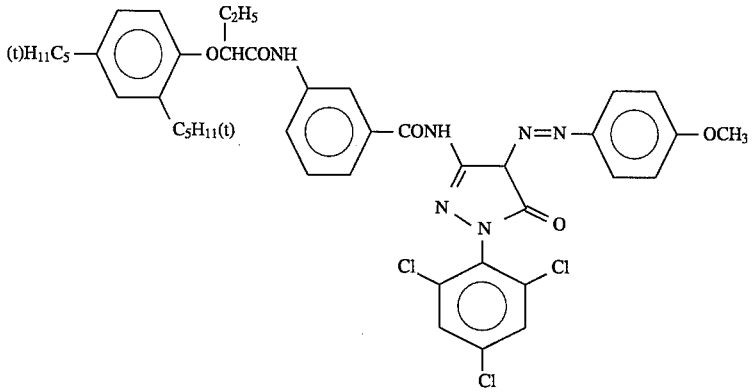

EX-2

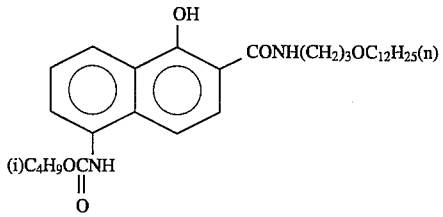

EX-3

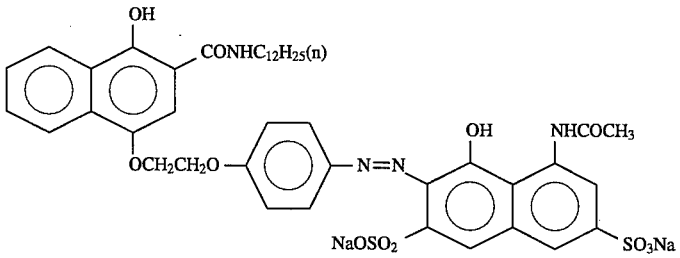

EX-4

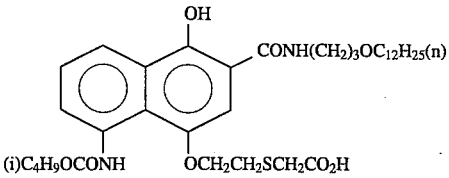

EX-5

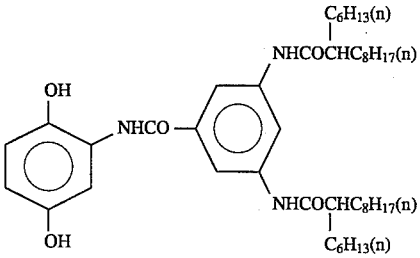

-continued
EX-6
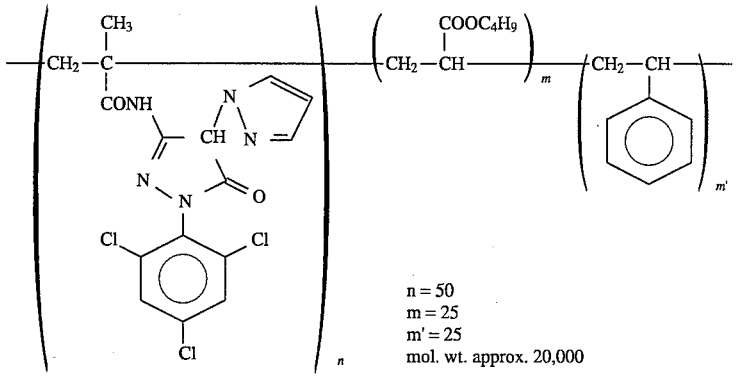
n = 50
m = 25
m' = 25
mol. wt. approx. 20,000
EX-7
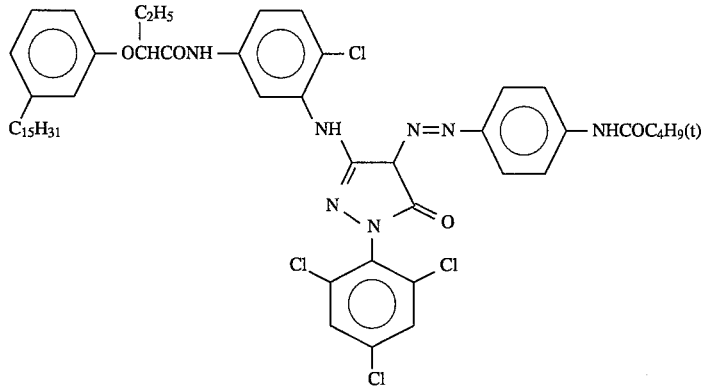
EX-8
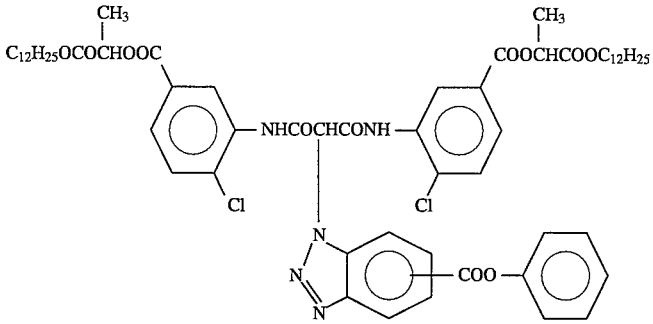
EX-9
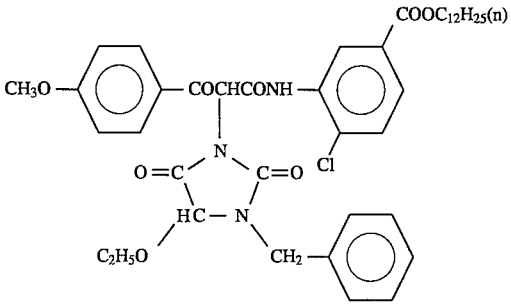
EX-10
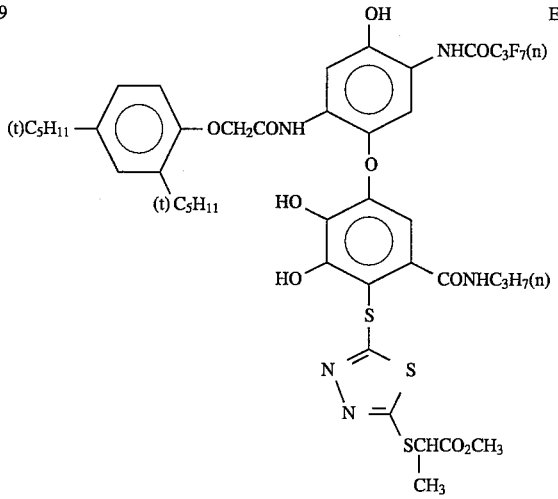

-continued
EX-11
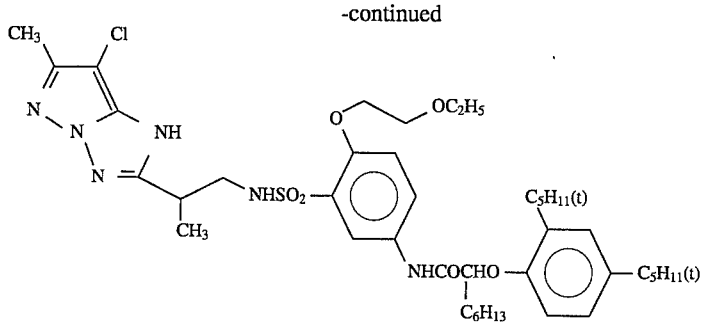
EX-12
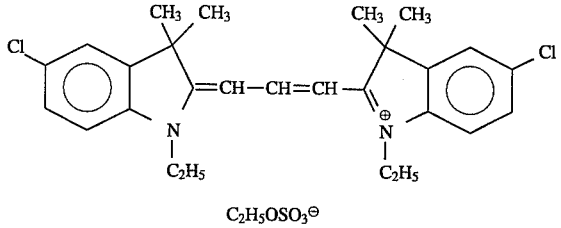
EX-13
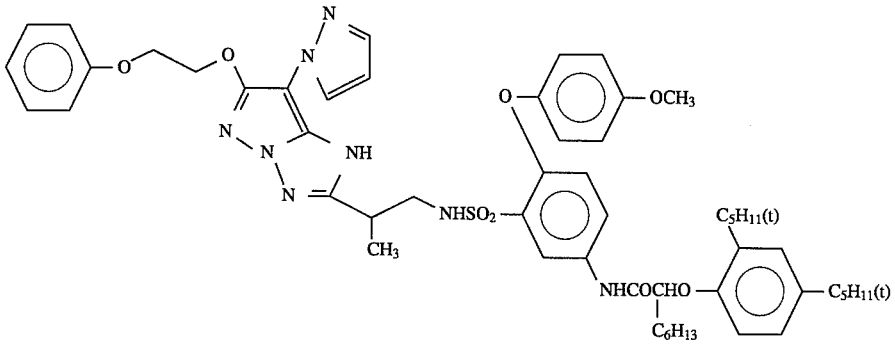
EX-14
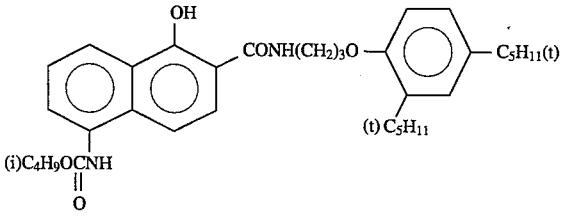
EX-15
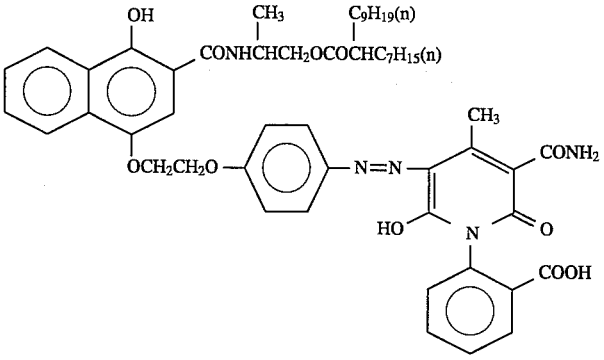

-continued
EX-16
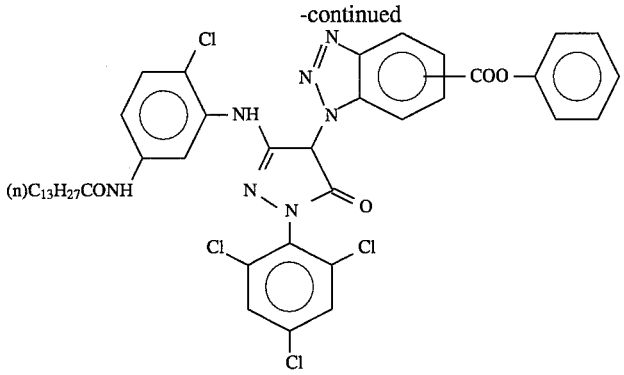
EX-17
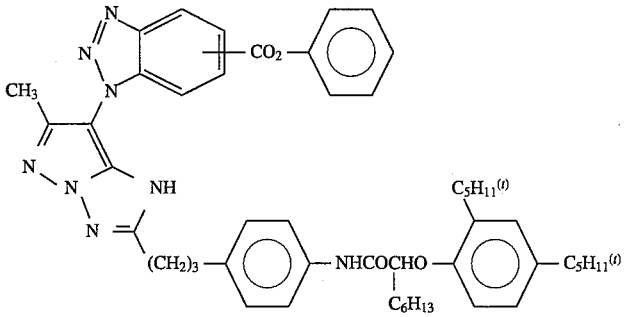
EX-18
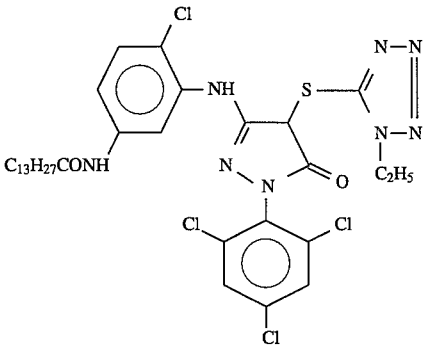
EX-19
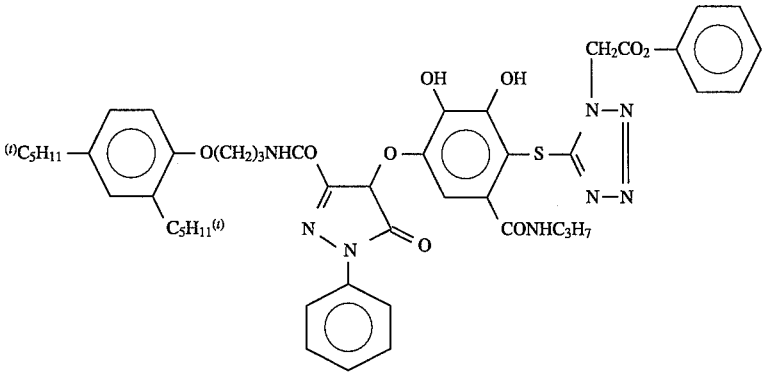
F-1
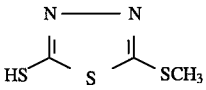
F-2
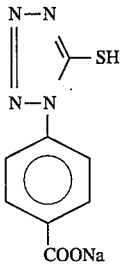

-continued
F-3
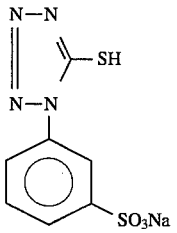
F-4
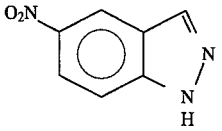
F-5
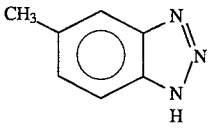
F-6
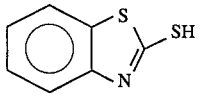
F-7
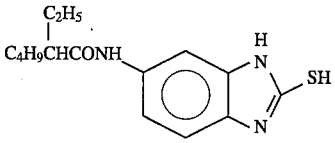
F-8
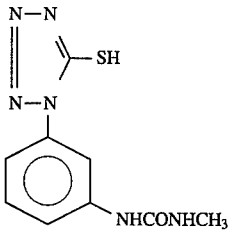
F-9
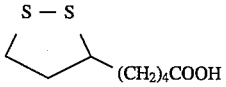
F-10
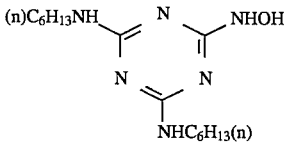
F-11
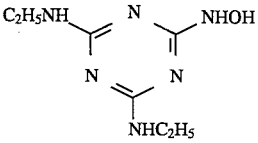
F-12
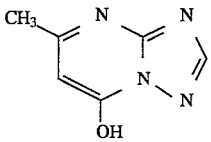
F-13
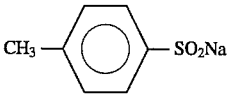
U-1
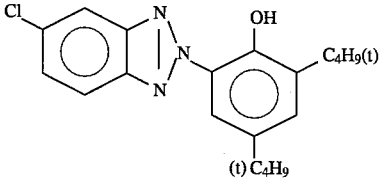
U-2
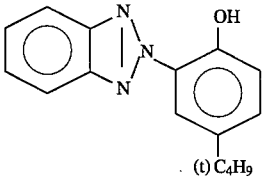
U-3
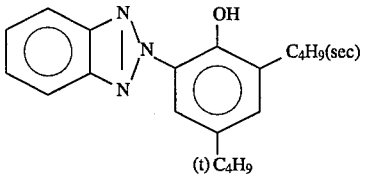
U-4
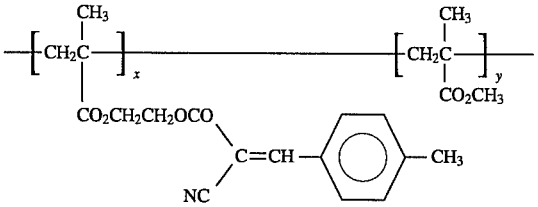
x:y = 70:30 (wt %)
U-5
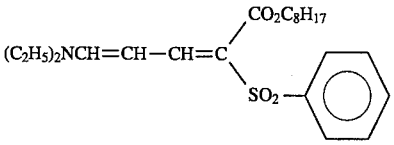
Dicresyl phosphate HBS-1
Di-N-Butyl phthalate HBS-2

-continued
HBS-3
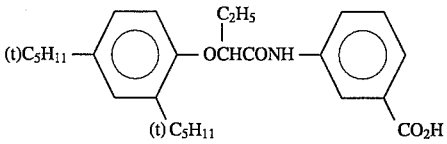
Sensitizing Dye I
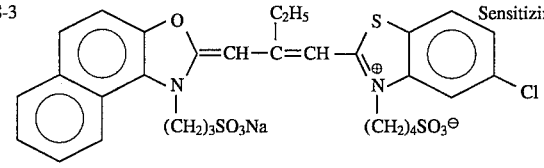
Sensitizing Dye II
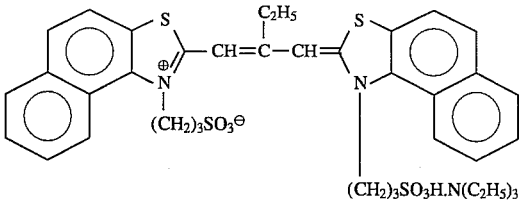
Sensitizing Dye III
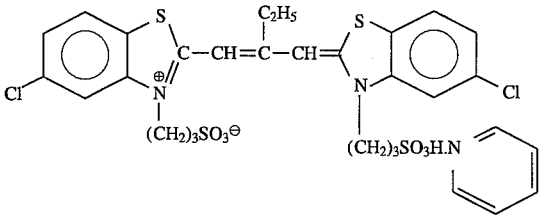
Sensitizing Dye IV
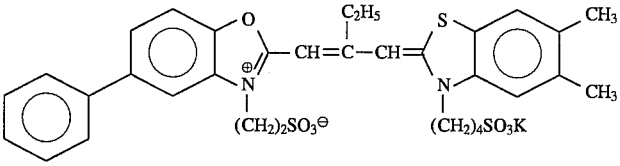
Sensitizing Dye V
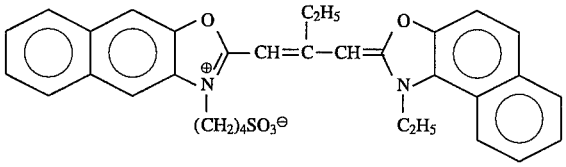
Sensitizing Dye VI
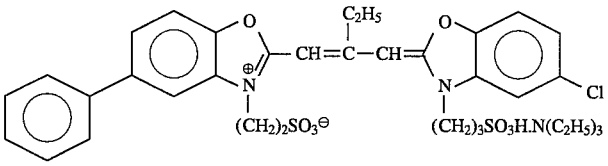
Sensitizing Dye VII
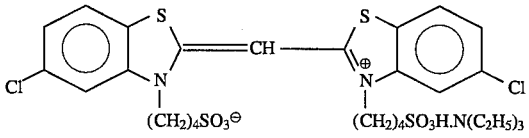
S-1
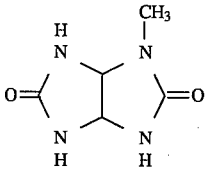
H-1
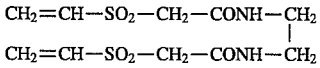
B-1
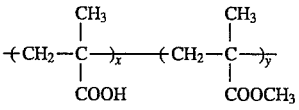
x/y = 10/90
B-2
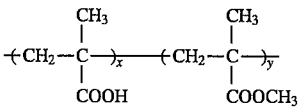
x/y = 40/60

-continued

B-3

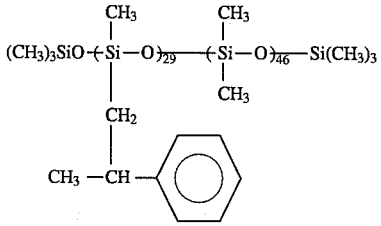

B-4

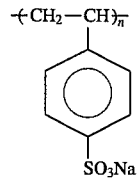

B-5

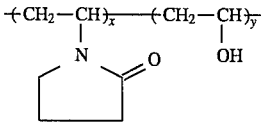

x/y = 70/30

W-1

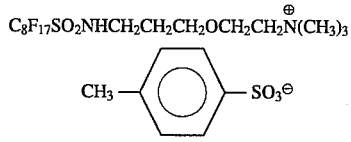

W-2

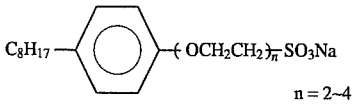

n = 2~4

W-3

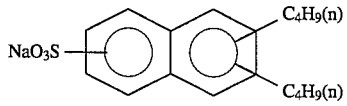

Samples 102 to 105

Samples 102 to 105 were prepared by replacing Emulsion 1 in the fifth and ninth layers of Sample 101 with Emulsions 2 to 5 (Table 3).

Samples 106 to 125

Samples 106 to 125 were prepared by changing the compound EX-16 in the seventh, eighth and ninth layers of Samples 101 to 105 as shown in Tables 3 and 4.

Samples 126 to 130

Samples 125 to 130 were prepared by omitting the Compounds (A-11) and (A-18) which can be represented by formula (A) of the present invention which were added to the fifth, ninth and fourteenth layers of samples 111 to 115 (Table 4).

The Samples 101 to 130 so obtained were subjected to a white imagewise exposure and then subjected to color development processing in accordance with the method indicated below using an automatic processor (processing was continued until the cumulative amount of replenishment reached three times the parent tank capacity).

Processing Operations

| Process | Processing Time | Processing Temp | Replenishment Rate | Tank Capacity |
|---|---|---|---|---|
| Color development | 3 min. 15 sec. | 38° C. | 33 ml | 20 liters |
| Bleach | 6 min. 30 sec. | 38° C. | 25 ml | 40 liters |
| Water Wash | 2 min. 10 sec. | 24° C. | 1200 ml | 20 liters |
| Fix | 4 min. 20 sec. | 38° C. | 25 ml | 30 liters |
| Water Wash (1) | 1 min. 05 sec. | 24° C. | Counter flow from (2) to (1) | 10 liters |
| Water Wash (2) | 1 min. 00 sec. | 24° C. | 1200 ml | 10 liters |
| Stabilizer | 1 min. 05 sec. | 38° C. | 25 ml | 10 liters |
| Drying | 4 min. 20 sec. | 55° C. | | |

Replenishment rate per meter length of width 35 mm

The compositions of the processing baths are indicated below.

| | Parent Bath (grams) | Replenisher (grams) |
|---|---|---|
| Color Development Bath | | |
| Diethylenetriaminepenta-acetic acid | 1.0 | 1.1 |
| 1-Hydroxyethylidine-1,1-di-phosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethyl-amino]-2-methylaniline sulfate | 4.5 | 5.5 |
| Water to make | 1.0 liter | 1.0 liter |
| pH | 10.05 | 10.10 |
| Bleach | | |
| Ethylenediaminetetraacetic acid, ferric sodium salt, trihydrate | 100.0 | 120.0 |
| Ethylenediaminetetraacetic acid, disodium salt | 10.0 | 10.0 |
| Ammonium bromide | 140.0 | 160.0 |
| Amonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| Fixer | | |
| Ethylenediaminetetraacetic acid, disodium salt | 0.5 | 0.7 |
| Sodium sulfite | 7.0 | 8.0 |
| Sodium bisulfite | 5.0 | 5.5# |
| Aqueous ammonium thio-sulfate solution (70%) | 170.0 ml | 200.0 ml |
| Water to make | 1.0 liter | 1.0 liter |
| pH | 6.7 | 6.6 |
| Stabilizer | | |
| Formaldehyde (37%) | 2.0 ml | 3.0 ml |
| Polyoxyethylene p-monononyl- | 0.3 | 0.45 |

-continued

| | Parent Bath (grams) | Replenisher (grams) |
|---|---|---|
| phenyl ether (average degree of polymerization 10) | | |
| Ethylenediaminetetraacetic acid, disodium salt | 0.05 | 0.08 |
| Water to make | 1.0 liter | 1.0 liter |
| pH | 5.0–8.0 | 5.0–8.0 |

The fog densities ($D_G$) in the magenta images of the samples obtained and the 20 cycle/mm magenta image MTF values were shown in Tables 5 and 6. The method described in *The Theory of the Photographic Process,* 3rd ed. (published by MacMillan, edited by Mees) was used for the measurement of the MTF values.

Furthermore, the value obtained by subtracting the yellow density at the magenta fog density from the yellow density at the exposure which gave a magenta density of (fog+1.2) after subjecting the sample to a uniform blue exposure followed by a green imagewise exposure was taken for the degree of color mixing ($\Delta D_B$) and the results are shown in Tables 5 and 6.

Moreover, two sheets of the same sample were subjected to a white imagewise exposure at the same time and one was stored in a freezer and one was stored under conditions of 50° C., relative humidity 80% for 7 days and then they were developed and processed under the same conditions as before and the change in the relative speed at a magenta density of (fog+0.5) was read off as the sensitive material storage property ($\Delta S_{0.5}$) and the results are shown in Tables 5 and 6.

TABLE 3

| Sample | Emulsion Used[1)] | Compound of Formula (1) Used: Compound[2)] | Compound of Formula (1) Used: Amount Added[3)] | Compound of Formula (A) Used |
|---|---|---|---|---|
| 101 (Comparative Example) | 1 | EX-16 | 1.0 | (A-11)/(A-18) |
| 102 (Comparative Example) | 2 | " | " | " |
| 103 (Comparative Example) | 3 | " | " | " |
| 104 (Comparative Example) | 4 | " | " | " |
| 105 (Comparative Example) | 5 | " | " | " |
| 106 (Comparative Example) | 1 | (37)[4)] | 1.2 | " |
| 107 (Invention) | 2 | " | " | " |
| 108 " | 3 | " | " | " |
| 109 " | 4 | " | " | " |
| 110 " | 5 | " | " | " |
| 111 (Comparative Example) | 1 | (5) | 1.1 | " |
| 112 (Invention) | 2 | " | " | " |
| 113 " | 3 | " | " | " |
| 114 " | 4 | " | " | " |
| 115 " | 5 | " | " | " |

[1)]Emulsion used in the fifth and ninth layers.
[2)]Compound added in place of EX-16 in the seventh, eighth and ninth layers.
[3)]Mol ratio when the amount of EX-16 added is taken to be 1.0
[4)]Same compound as compound (51) disclosed in JP-A-62-24252 and JP-A-63-19654

TABLE 4

| Sample | Emulsion Used[1)] | Compound of Formula (1) Used: Compound[2)] | Compound of Formula (1) Used: Amount Added[3)] | Compound of Formula (A) Used |
|---|---|---|---|---|
| 116 (Comparative Example) | 1 | (24) | 1.0 | (A-11)/(A-18) |
| 117 (Invention) | 2 | " | " | " |
| 118 " | 3 | " | " | " |
| 119 " | 4 | " | " | " |
| 120 " | 5 | " | " | " |
| 121 (Comparative Example) | 1 | (52) | 0.9 | " |
| 122 (Invention) | 2 | " | " | " |
| 123 " | 3 | " | " | " |
| 124 " | 4 | " | " | " |
| 125 " | 5 | " | " | " |
| 126 (Comparative Example) | 1 | (5) | 1.1 | — |
| 127 (Invention) | 2 | " | " | — |
| 128 " | 3 | " | " | — |
| 129 " | 4 | " | " | — |
| 130 " | 5 | " | " | — |

[1)]Emulsion used in the fifth and ninth layers.
[2)]Compound added in place of EX-16 in the seventh, eighth and ninth layers.
[3)]Mol ratio when the amount of EX-16 added is taken to be 1.0.

TABLE 5

| Sample | Fog Density ($D_g$) | MTF Value | Degree of Color Mixing ($\Delta D_B$) | Sensitive Material Storage Properties ($\Delta D_{0.5}$) |
|---|---|---|---|---|
| 101 (Comparative Ex.) | 0.63 | 0.85 | −0.05 | −0.08 |
| 102 (Comparative Ex.) | 0.62 | 0.90 | −0.04 | −0.07 |
| 103 (Comparative Ex.) | 0.62 | 0.91 | −0.04 | −0.06 |
| 104 (Comparative Ex.) | 0.61 | 0.92 | −0.05 | −0.06 |
| 105 (Comparative Ex.) | 0.61 | 0.94 | −0.05 | −0.06 |
| 106 (Comparative Ex.) | 0.58 | 0.90 | −0.07 | −0.05 |
| 107 (Invention) | 0.57 | 0.94 | −0.07 | −0.03 |
| 108 " | 0.57 | 0.96 | −0.06 | −0.02 |
| 109 " | 0.56 | 0.98 | −0.06 | −0.02 |
| 110 " | 0.56 | 1.00 | −0.07 | −0.02 |
| 111 (Comparative Ex.) | 0.57 | 0.92 | −0.11 | −0.02 |
| 112 (Invention) | 0.57 | 0.96 | −0.11 | ±0.0 |
| 113 " | 0.56 | 0.97 | −0.12 | ±0.0 |
| 114 " | 0.56 | 0.99 | −0.12 | +0.01 |
| 115 " | 0.56 | 1.01 | −0.13 | ±0.0 |

TABLE 6

| Sample | Fog Density ($D_g$) | MTF Value | Degree of Color Mixing ($\Delta D_B$) | Sensitive Material Storage Properties ($\Delta D_{0.5}$) |
|---|---|---|---|---|
| 116 (Comparative Ex.) | 0.57 | 0.91 | −0.10 | −0.02 |
| 117 (Invention) | 0.56 | 0.95 | −0.11 | +0.01 |
| 118 " | 0.56 | 0.97 | −0.12 | ±0.0 |
| 119 " | 0.55 | 1.00 | −0.12 | ±0.0 |
| 120 " | 0.55 | 1.02 | −0.12 | ±0.0 |
| 121 (Comparative Ex.) | 0.56 | 0.91 | −0.12 | −0.03 |
| 122 (Invention) | 0.56 | 0.96 | −0.13 | ±0.0 |
| 123 " | 0.55 | 0.98 | −0.13 | +0.01 |
| 124 " | 0.55 | 0.99 | −0.14 | ±0.0 |

TABLE 6-continued

| Sample | Fog Density ($D_g$) | MTF Value | Degree of Color Mixing ($\Delta D_B$) | Sensitive Material Storage Properties ($\Delta D_{0.5}$) |
|---|---|---|---|---|
| 125 " | 0.55 | 1.02 | −0.14 | ±0.0 |
| 126 (Comparative Ex.) | 0.60 | 0.91 | −0.10 | −0.04 |
| 127 (Invention) | 0.60 | 0.96 | −0.11 | −0.02 |
| 128 " | 0.59 | 0.96 | −0.11 | −0.01 |
| 129 " | 0.58 | 0.97 | −0.12 | −0.01 |
| 130 " | 0.58 | 0.99 | −0.12 | −0.01 |

It is clear from Tables 5 and 6 that the samples in which compounds of the present invention have been used have excellent sensitive material storage properties with low fog when compared with comparative Samples 101 to 105 in which compounds outside the scope of the present invention had been used, and they also had superior color reproduction as represented by the extent of color mixing. Moreover, they were superior in terms of sharpness and color reproduction when compared with Comparative Samples 106, 111, 116 and 121 which contained emulsion 1 which had an aspect ratio outside the scope of the present invention.

Furthermore, Samples 112 to 115 in which the compounds represented by formula (A) had been used had excellent sensitive material storage properties with low fog when compared with Samples 127 to 130 in which no such compound had been used.

Example 2

Emulsions 6 to 9

Silver iodobromide core/shell type tabular emulsions 6 to 9 which had different average iodine contents were prepared by varying the mixing ratio of potassium bromide and potassium iodide but otherwise using the same procedure as used for Emulsions 1 to 5 described earlier. The results are shown in Table 7.

TABLE 7

| Emulsion | Average Aspect Ratio[1] (μm) | Average Aspect Ratio[2] (μm) | Average Grain Size (mol %) | Average Grain Thickness | Average Iodine Content |
|---|---|---|---|---|---|
| 4 | 6.7/1 | 5.2/1 | 1.74 | 0.30 | 7.6 |
| 6 | 6.8/1 | 5.2/1 | 1.74 | 0.31 | 4.2 |
| 7 | 6.9/1 | 5.4/1 | 1.75 | 0.30 | 6.8 |
| 8 | 6.8/1 | 5.3/1 | 1.75 | 0.29 | 10.2 |
| 9 | 7.0/1 | 5.5/1 | 1.77 | 0.29 | 12.4 |

[1]The aspect ratio was measured for 1000 individual emulsion grains, the grains corresponding to 50% of the total projected area were selected from the grains of large aspect ratio and the average value for the aspect ratio of these grains was taken.
[2]The average value of the aspect ratio of the grains corresponding to 85% of the total projected area in the same way as in 1) above.

Samples 201 to 205

Samples 201 to 205 were prepared by replacing Emulsion 1 in the ninth layer of Sample 101 with Emulsions 6 to 9 and 4 (Table 8).

Samples 206 to 220

Samples 206 to 220 were prepared by changing the compound EX-16 in the seventh, eighth and ninth layers of Samples 201 to 205 as shown in Tables 8 and 9.

Samples 221 to 225

Samples 221 to 225 were prepared by omitting the compounds (A-11) and (A-18) represented by formula (A) of the present invention which were added to the fifth, ninth and fourteenth layers of samples 211 to 225 (Table 9)

The samples obtained were subjected to a white image-wise exposure and the color development processing aforementioned, and the logarithm of the reciprocal of the exposure which gave a magenta density of (fog+0.2) was taken for the relative speed and the results were shown in Tables 10 and 11.

Furthermore, the RMS values at a magenta density of (fog+1.0) measured with an aperture of diameter 48 μm were shown in Tables 10 and 11.

TABLE 8

| Sample | Emulsion Used[1] | Compound of Formula (1) Used: Compound[2] | Compound of Formula (1) Used: Amount Added[3] | Compound of Formula (A) Used |
|---|---|---|---|---|
| 201 (Comparative Example) | 6 | EX-16 | 1.0 | (A-11)/(A-18) |
| 202 (Comparative Example) | 7 | " | " | " |
| 203 (Comparative Example) | 4 | " | " | " |
| 204 (Comparative Example) | 8 | " | " | " |
| 205 (Comparative Example) | 9 | " | " | " |
| 206 (Invention) | 6 | EX-17[4] | 1.2 | " |
| 207 " | 7 | " | " | " |
| 208 " | 4 | " | " | " |
| 209 " | 8 | " | " | " |
| 210 " | 9 | " | " | " |
| 211 " | 6 | (14) | 1.0 | " |
| 212 " | 7 | " | " | " |
| 213 " | 4 | " | " | " |
| 214 " | 8 | " | " | " |
| 215 " | 9 | " | " | " |

[1]Emulsion used in the ninth layer.
[2]Compound added in place of EX-16 in the seventh, eighth and ninth layers.
[3]Mol ratio when the amount of EX-16 added is taken to be 1.0.
[4]Same compound as compound (5) disclosed in JP-A-61-28947, see page 160 herein.

TABLE 9

| Sample | Emulsion Used[1] | Compound of Formula (1) Used: Compound[2] | Compound of Formula (1) Used: Amount Added[3] | Compound of Formula (A) Used |
|---|---|---|---|---|
| 216 (Invention) | 6 | (12) | 1.1 | (A-11)/(A-18) |
| 217 " | 7 | " | " | " |
| 218 " | 4 | " | " | " |
| 219 " | 8 | " | " | " |
| 220 " | 9 | " | " | " |
| 221 " | 6 | (36) | 0.9 | " |
| 222 " | 7 | " | " | " |
| 223 " | 4 | " | " | " |
| 224 " | 8 | " | " | " |
| 225 " | 9 | " | " | " |
| 226 " | 6 | (12) | 1.1 | — |
| 227 " | 7 | " | " | — |
| 228 " | 4 | " | " | — |
| 229 " | 8 | " | " | — |
| 230 " | 9 | " | " | — |

[1]Emulsion used in the ninth layer.
[2]Compound added in place of EX-16 in the seventh, eighth and ninth layers.
[3]Mol ratio when the amount of EX-16 added is taken to be 1.0.

TABLE 10

| Sample | Relative Speed | RMS Value ×100 | Extent of Color Mixing ($\Delta D_B$) | Sensitive Material Storage Properties ($\Delta S_{0.5}$) |
|---|---|---|---|---|
| 201 (Comparative Example) | 0.00 | 20.7 | −0.04 | −0.07 |
| 202 (Comparative Example) | 0.01 | 19.8 | −0.05 | −0.06 |
| 203 (Comparative Example) | 0.02 | 19.0 | −0.05 | −0.06 |
| 204 (Comparative Example) | 0.03 | 18.7 | −0.07 | −0.05 |
| 205 (Comparative Example) | 0.03 | 18.2 | −0.08 | −0.05 |
| 206 (Invention) | 0.03 | 15.0 | −0.10 | −0.02 |
| 207 " | 0.04 | 14.3 | −0.11 | −0.01 |
| 208 " | 0.04 | 13.7 | −0.13 | −0.01 |
| 209 " | 0.06 | 13.1 | −0.13 | ±0.0 |
| 210 " | 0.06 | 12.8 | −0.04 | ±0.0 |
| 211 " | 0.03 | 14.5 | −0.13 | −0.01 |
| 212 " | 0.05 | 14.1 | −0.13 | −0.01 |
| 213 " | 0.05 | 13.5 | −0.14 | ±0.0 |
| 214 " | 0.07 | 13.0 | −0.14 | ±0.0 |
| 215 " | 0.07 | 12.7 | −0.15 | ±0.0 |

TABLE 11

| Sample | Relative Speed | RMS Value ×100 | Extent of Color Mixing ($\Delta D_B$) | Sensitive Material Storage Properties ($\Delta S_{0.5}$) |
|---|---|---|---|---|
| 216 (Invention) | 0.04 | 14.4 | −0.13 | −0.01 |
| 217 " | 0.05 | 14.0 | −0.13 | ±0.0 |
| 218 " | 0.06 | 13.3 | −0.14 | ±0.0 |
| 219 " | 0.07 | 12.9 | −0.15 | ±0.0 |
| 220 " | 0.08 | 12.6 | −0.15 | ±0.0 |
| 221 " | 0.03 | 14.6 | −0.13 | −0.02 |
| 222 " | 0.04 | 14.1 | −0.14 | −0.01 |
| 223 " | 0.06 | 13.5 | −0.15 | −0.01 |
| 224 " | 0.06 | 13.0 | −0.15 | ±0.0 |
| 225 " | 0.07 | 12.6 | −0.16 | ±0.0 |
| 226 " | 0.03 | 14.7 | −0.10 | −0.03 |
| 227 " | 0.03 | 14.4 | −0.11 | −0.02 |
| 228 " | 0.05 | 13.6 | −0.12 | −0.01 |
| 229 " | 0.06 | 13.1 | −0.13 | −0.01 |
| 230 " | 0.06 | 12.7 | −0.14 | −0.01 |

It is clear from Tables 10 and 11 that the samples in which the compounds of the present invention had been used were superior in terms of color reproduction with high speed when compared with the comparative samples in which compounds outside the scope of the present invention had been used. They also had superior sensitive material storage properties. Furthermore, it is clear that in those cases where Emulsions 6, 7, 4, 8 and 9 which had more or less the same aspect ratio had been used, the relative speed increased as the average iodine content increased and the graininess also increased.

Furthermore, Samples 216 to 220 in which compounds represented by formula (A) had been used were clearly superior in terms of graininess with high speed and sensitive material storage properties when compared with Samples 226 to 230 in which no such compound was used.

Example 3

Emulsion 10M

A 2M aqueous solution of silver nitrate which contained gelatin and a 2M aqueous solution of potassium bromide which contained gelatin (25 cc of each solution) were mixed simultaneously over a period of 1 minute with vigorous agitation in 1 liter of 0.7 wt % gelatin solution which contained 0.04M potassium bromide. Subsequently, the temperature was raised to 75° C., and 300 cc of 10 wt % gelatin solution was added. Next, 30 cc of 1M aqueous silver nitrate was added over a period of 5 minutes, and then 10 cc of 25 wt % aqueous ammonia was added, and the mixture was ripened at 75° C. After ripening had been completed and the ammonia had been neutralized, 1M aqueous silver nitrate solution and 1M aqueous potassium bromide solution were admixed simultaneously with an accelerating flow rate (the final flow rate was 5 times the initial flow rate) while maintaining a pBr value of 2.3. (the amount of aqueous silver nitrate solution used was 600 cc.) This emulsion was washed with water using the normal flocculation method, dispersed gelatin was added and 800 grams of a hexagonal tabular silver halide emulsion was obtained (Emulsion A). This Emulsion A was comprised of monodisperse hexagonal tabular grains of average corresponding circle diameter (grain size) 1.0μ, average thickness 0.18 μm and variation coefficient 11%.

Next, 250 grams of Emulsion A was taken, 800 cc of distilled water, 30 grams of gelatin and 6.5 grams of potassium bromide were added and the mixture was heated to 78° C. A 1M aqueous silver nitrate solution and a 1M aqueous potassium halide solution (90 mol % potassium bromide and 10 mol % potassium iodide) were admixed simultaneously, with stirring, with an accelerating flow rate (the final flow rate was 3 times the initial flow rate) while maintaining a pBr value of 1.6. (The amount of aqueous silver nitrate solution used was 600 cc). Moreover, 1M aqueous silver nitrate solution and 1M aqueous potassium bromide solution were then admixed simultaneously at an accelerating flow rate (the final flow rate was 1.5 times the initial flow rate) while maintaining a pBr value of 1.6. (The amount of aqueous silver nitrate solution used here was 200 cc.)

This emulsion was washed with water in the way described earlier, dispersed gelatin was added, and a monodisperse hexagonal tabular silver halide emulsion (Emulsion 10M) was obtained. Emulsion 10M so obtained was such that 92% of the total projected area was accounted for by hexagonal tabular grains, the average grain size of the hexagonal tabular grains was 1.75 μm, the average thickness was 0.29 μm and the average aspect ratio was 16%.

Emulsion 11M

Seed Emulsion B was obtained in the same way as for Emulsion 10M except that the amount of 1M aqueous silver nitrate solution on the second occasion was 20 cc and the amount of aqueous ammonia added was 8 cc. Then, this seed Emulsion B was grown in the same way as Emulsion 10M. However, the pBr value during growth was maintained at 1.5. The Emulsion 11M so obtained was such that 90% of the total projected area was accounted for by hexagonal tabular grains, the average size of the hexagonal tabular grains was 2.1 μm, the average thickness was 0.21 μm, the average aspect ratio was 10:1, and the variation coefficient was 19%.

Emulsion 12M

The amount of 1M aqueous silver nitrate solution added on the second occasion in the method of preparation used for Emulsion 10M was changed from 30 cc to 10 cc and no aqueous ammonia was added. Moreover, the pBr value on the third occasion was changed from 2.3 to 1.7 for the preparation of Emulsion C. Next, this seed Emulsion C as grown using the same method as for Emulsion 6 and Emulsion 12M was obtained.

Emulsion 12M so obtained was such that 62% of the total projected area was accounted for by hexagonal tabular grains, the average grain size of these hexagonal tabular grains was 2.0 μm, the average thickness was 0.17 μm, the average aspect ratio was 12:1, and the variation coefficient was 37%.

A mixture of Sensitizing Dyes IV, V and VI of mol ratio 0.1:0.3:1.0 was added to each of Emulsions 10M, 11M, 12M and 1 in an amount equal to 70% of the saturation adsorption amount for each emulsion and, maintained at 60° C. for 20 minutes. They were chemically sensitized optimally at 60° C., pH 6.5 using sodium thiosulfate, chloroauric acid and potassium thiocyanate, and Emulsions 10, 11, 12 and 13 were obtained. The results are shown in Table 12.

TABLE 12

| Emulsion | Average Aspect Ratio[1)] | Average Aspect Ratio[2)] | Average Aspect Ratio[3)] | Average Grain Size (μm) | Average Grain Thickness (μm) | Variation Coefficient of Grain Size | Hexagonal Tabular Fraction[4)] (%) | Relative Standard Deviation of Silver Iodide Content from Grain to Grain[5)] (%) |
|---|---|---|---|---|---|---|---|---|
| 10 | 7.9/1 | 7.2/1 | 6.0/1 | 1.75 | 0.29 | 0.15 | 92 | 13 |
| 11 | 13/1 | 11/1 | 10/1 | 2.10 | 0.21 | 0.19 | 90 | 16 |
| 12 | 21/1 | 17/1 | 12/1 | 2.00 | 0.17 | 0.37 | 62 | 24 |
| 13 | 1.5/1 | 1.2/1 | 1.1/1 | 0.86 | 0.67 | 0.25 | 10 | 22 |

[1)], [2)]Values measured in the same way as in Table 1.
[3)]Average value for all grains.
[4)]Proportion of projected area of hexagonal grains with respect to total projected area for all emulsion grains.
[5)]Measured values in accordance with specifications of JP-A-60-143332.

Samples 301 to 304

Samples 301 to 304 were prepared by replacing Emulsion 1 in the ninth layer of Sample 101 with Emulsions 10, 11, 12 and 13 (Table 13).

Samples 305 to 328

Samples 305 to 308 prepared by changing the Compound EX-16 in the seventh, eight and ninth layers of Samples 301 to 304 as shown in Tables 13 and 14.

Samples 329 to 332

Samples 329 to 332 were prepared by replacing Emulsions 10 to 13 of the ninth layer of Samples 313 to 316 with a mixed emulsion with Emulsion B at a ratio of 8:1 in each case (Table 14).

The relative speeds, MFT values, RMS values, degrees of color mixing ($\Delta D_B$) and sensitive material stabilities ($\Delta S_{0.5}$) were obtained on the basis of Examples 1 and 2, and the results obtained are shown in Tables 15 and 16.

Moreover, the developed and processed samples were stored for 7 days under conditions of 80° C., 70% relative humidity. The colored image storage properties were read as the change in the minimum magenta density ($\Delta D_G$), and these values are also shown in Tables 15 and 16.

In this case the color development processing was carried out using the processing operations and processing bath compositions indicated below.

Processing Operations

| Process | Processing Time | Processing Temperature | Replenishment Rate | Tank Capacity |
|---|---|---|---|---|
| Color development | 3 min. 15 sec. | 37.8° C. | 25 ml | 10 liters |
| Bleach | 45 sec. | 38.0° C. | 5 ml | 4 liters |
| Bleach-Fix (1) | 45 sec. | 38.0° C. | — | 4 liters |
| Bleach-Fix (2) | 45 sec. | 38.0° C. | 30 ml | 4 liters |
| Water Wash (1) | 20 sec. | 38.0° C. | — | 2 liters |
| Water Wash (2) | 20 sec. | 38.0° C. | 30 ml | 2 liters |
| Stabilizing | 20 sec. | 38.0° C. | 20 ml | 2 liters |
| Drying | 1 min. | 55° C. | | |

Replenishment rate per meter length of width 35 mm

In the bleach-fixing and water washing processes a counter-flow system from (2) to (1) was used, and the overflow from the bleach bath was all introduced into bleach-fixer (2).

Moreover, the carry-over of bleach-fixer into the water washing process in the above mentioned process was 2 ml per 1 meter length of photosensitive material of width 35 ml.

| | Parent Bath (grams) | Replenisher (grams) |
|---|---|---|
| Color Development | | |
| Diethylenetriaminepenta-acetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-Ethyl-N-β-hydroxyethyl-amino]-2-methylaniline sulfate | 4.7 | 6.2 |
| Water to make | 1.0 liter | 1.0 liter |
| pH | 10.00 | 10.15 |
| Bleach | | |
| 1,3-Diaminopropanetetra-acetic acid, ferric ammonium salt, monohydrate | 144.0 | 206.0 |
| 1,3-Diaminopropanetetra-acetic acid | 2.8 | 4.0 |
| Ammonium bromide | 84.0 | 120.0 |

-continued

| | Parent Bath (grams) | Replenisher (grams) |
|---|---|---|
| Ammonium nitrate | 17.5 | 25.0 |
| Aqueous ammonia (27%) | 10.0 | 1.8 |
| Acetic acid (98%) | 51.1 | 73.0 |
| Water to make | 1.0 liter | 1.0 liter |
| pH | 4.3 | 3.4 |
| Bleach-Fixer | | |
| Ethylenediaminetetraacetic acid, ferric ammonium salt dihydrate | 50.0 | — |
| Ethylenediaminetetraacetic acid, disodium salt | 5.0 | 25.0 |
| Ammonium sulfite | 12.0 | 20.0 |
| Aqueous ammonium thiosulfate solution (700 g/liter) | 290.0 ml | 320.0 ml |
| Aqueous ammonia (27%) | 6.0 ml | 15.0 ml |
| Water to make | 1.0 liter | 1.0 liter |
| pH | 6.8 | 8.0 |

Water Washing Water (Parent Bath=Replenisher)

Tap water was passed through a mixed bed column which had been packed with an H-type strongly acidic cation exchange resin ("Amberlite IR-120B", made by the Rohm & Haas Co.) and an OH-type strongly basic anion exchange resin ("Amberlite IRA-400", made by the same company), and treated in such a way that the calcium and magnesium ion concentrations each was less than 3 mg/liter, and then 20 mg/liter of chlorinated sodium isocyanurate and 150 mg/liter of sodium sulfate were added. The pH of this liquid was within the range from 6.5 to 7.5.

| Stabilizer (Parent Bath = Replenisher) | (Units: Grams) |
|---|---|
| Formaldehyde (37%) | 1.2 ml |
| Surfactant $[C_{10}H_{21}—O—(CH_2CH_2O)_{10}—H]$ | 0.4 |
| Ethylene glycol | 1.0 |
| Water to make | 1 liter |
| pH | 5.0–7.0 |

TABLE 13

| Sample | Emulsion Used[1)] | Compound of Formula (I) Used: Amount Compound[2)] | Compound of Formula (I) Used: Added[3)] |
|---|---|---|---|
| 301 (Comparative Example) | 10 | EX-16 | 1.0 |
| 302 (Comparative Example) | 11 | " | " |
| 303 (Comparative Example) | 12 | " | " |
| 304 (Comparative Example) | 13 | " | " |
| 305 (Comparative Example) | 10 | Ex-18[4)] | 1.2 |

TABLE 13-continued

| Sample | Emulsion Used[1)] | Compound of Formula (I) Used: Amount Compound[2)] | Compound of Formula (I) Used: Added[3)] |
|---|---|---|---|
| 306 (Comparative Example) | 11 | " | " |
| 307 (Comparative Example) | 12 | " | " |
| 308 (Comparative Example) | 13 | " | " |
| 309 (Comparative Example) | 10 | EX-19[5)] | 0.9 |
| 310 (Comparative Example) | 11 | " | " |
| 311 (Comparative Example) | 12 | " | " |
| 312 (Comparative Example) | 13 | " | " |
| 313 (Invention) | 10 | (16) | 1.1 |
| 314 " | 11 | " | " |
| 315 " | 12 | " | " |
| 316 (Comparative Example) | 13 | " | " |

[1)]Emulsion used in the ninth layer.
[2)]Compound added in place of EX-16 in the seventh, eighth and ninth layers.
[3)]Mol ratio when the amount of EX-16 added is taken to be 1.0
[4)]Same compound as compound (D-10) disclosed in JP-A-59-129849 and compound (3) disclosed in JP-A-61-14635, see page 161 herein.
[5)]Same compound as compound (74) disclosed in JP-A-63-19564, see page 161 herein.

TABLE 14

| Sample | Emulsion Used[1)] | Compound of Formula (I) Used: Amount Compound[2)] | Compound of Formula (I) Used: Added[3)] |
|---|---|---|---|
| 317 (Invention) | 10 | (18) | 1.0 |
| 318 " | 11 | " | " |
| 319 " | 12 | " | " |
| 320 (Comparative Example) | 13 | " | " |
| 321 (Invention) | 10 | (42) | 1.0 |
| 322 " | 11 | " | " |
| 323 " | 12 | " | " |
| 324 (Comparative Example) | 13 | " | " |
| 325 (Invention) | 10 | (48) | 0.9 |
| 326 " | 11 | " | " |
| 327 " | 12 | " | " |
| 328 (Comparative Example) | 13 | " | " |
| 329 (Invention) | 10/B | (16) | 1.1 |
| 330 " | 11/B | " | " |
| 331 " | 12/B | " | " |
| 332 (Comparative Example) | 13/B | " | " |

[1)]Emulsion used in the ninth layer.
[2)]Compound added in place of EX-16 in the seventh, eighth and ninth layers.
[3)]Mol ratio when the amount of EX-16 added is taken to be 1.0.

TABLE 15

| Sample | Relative Speed | MTF Value | RMS Value ×100 | Extent of Color Mixing ($\Delta D_B$) | Sensitive Material Storage Properties ($\Delta S_{0.5}$) | Sensitive Material Storage Properties ($\Delta D_G$) |
|---|---|---|---|---|---|---|
| 301 (Comparative Example) | 0.00 | 0.90 | 19.4 | −0.06 | −0.08 | +0.14 |
| 302 (Comparative Example) | 0.02 | 0.92 | 19.5 | −0.05 | −0.08 | +0.14 |
| 303 (Comparative Example) | 0.04 | 0.94 | 19.8 | −0.05 | −0.09 | +0.14 |
| 304 (Comparative Example) | −0.03 | 0.84 | 20.5 | −0.04 | −0.10 | +0.16 |
| 305 (Comparative Example) | 0.01 | 0.89 | 19.5 | −0.05 | −0.07 | +0.13 |
| 306 (Comparative Example) | 0.02 | 0.91 | 19.6 | −0.06 | −0.07 | +0.14 |
| 307 (Comparative Example) | 0.03 | 0.93 | 19.9 | −0.07 | −0.08 | +0.14 |
| 308 (Comparative Example) | −0.04 | 0.83 | 20.4 | −0.03 | −0.09 | +0.15 |
| 309 (Comparative Example) | 0.01 | 0.91 | 19.4 | −0.05 | −0.09 | +0.12 |
| 310 (Comparative Example) | 0.03 | 0.93 | 19.6 | −0.07 | −0.09 | +0.12 |
| 311 (Comparative Example) | 0.04 | 0.94 | 20.0 | −0.07 | −0.10 | +0.14 |
| 312 (Comparative Example) | −0.03 | 0.85 | 20.4 | −0.05 | −0.12 | +0.16 |
| 313 (Invention) | 0.04 | 0.97 | 12.5 | −0.12 | ±0.0 | ±0.0 |
| 314 " | 0.05 | 0.99 | 12.7 | −0.13 | ±0.0 | +0.01 |
| 315 " | 0.07 | 1.03 | 13.2 | −0.14 | −0.01 | +0.01 |
| 316 (Comparative Example) | 0.01 | 0.92 | 15.0 | −0.09 | −0.01 | +0.02 |

TABLE 16

| Sample | Relative Speed | MTF Value | RMS Value ×100 | Extent of Color Mixing ($\Delta D_B$) | Sensitive Material Storage Properties ($\Delta S_{0.5}$) | Sensitive Material Storage Properties ($\Delta D_G$) |
|---|---|---|---|---|---|---|
| 317 (Invention) | 0.05 | 0.97 | 12.7 | −0.11 | ±0.0 | ±0.0 |
| 318 " | 0.05 | 0.99 | 12.9 | −0.12 | ±0.0 | ±0.0 |
| 319 " | 0.07 | 1.02 | 13.3 | −0.14 | −0.01 | +0.01 |
| 320 (Comparative Example) | 0.02 | 0.91 | 15.3 | −0.08 | −0.02 | +0.01 |
| 321 (Invention) | 0.05 | 0.98 | 12.4 | −0.14 | ±0.0 | ±0.0 |
| 322 " | 0.06 | 1.00 | 12.7 | −0.15 | ±0.0 | ±0.0 |
| 323 " | 0.08 | 1.03 | 13.1 | −0.17 | −0.01 | +0.01 |
| 324 (Comparative Example) | 0.01 | 0.92 | 15.0 | −0.10 | −0.02 | +0.01 |
| 325 (Invention) | 0.04 | 0.98 | 12.6 | −0.12 | −0.01 | ±0.0 |
| 326 " | 0.06 | 1.01 | 12.8 | −0.14 | −0.01 | ±0.0 |
| 327 " | 0.07 | 1.04 | 13.2 | −0.15 | −0.02 | +0.01 |
| 328 (Comparative Example) | 0.00 | 0.91 | 15.4 | −0.11 | −0.03 | +0.02 |
| 329 (Invention) | 0.04 | 0.96 | 12.2 | −0.12 | ±0.0 | ±0.0 |
| 330 " | 0.04 | 0.98 | 12.3 | −0.14 | ±0.0 | ±0.0 |
| 331 " | 0.06 | 1.01 | 12.9 | −0.15 | −0.01 | +0.01 |
| 332 (Comparative Example) | 0.00 | 0.90 | 14.8 | −0.10 | −0.02 | +0.02 |

It is clear from Tables 15 and 16 that the samples of the present invention have superior sharpness and graininess with high speed when compared with the samples in which Emulsion 13 which is outside the scope of the present invention had been used. Also superior color reproduction and sensitive material storage properties are obtained with high speed when compared with the samples in which no compound of the present invention had been used. The samples of the present invention had particularly excellent colored image stability after processing.

Furthermore, the samples in which Emulsions 10 and 11 in which the hexagonal tabular fraction was high and the variation coefficient of the grain size was small had been used, were desirable with respect to speed, graininess and sensitive material storage properties. Moreover, Samples 329 to 331 in which mixtures of Emulsion B which is outside the scope of the invention and emulsion of the present invention were used clearly had improved graininess with virtually no deterioration in relative speed when compared with samples 313 to 315.

It is clear from the results described above that samples in accordance with the present invention have excellent speed, sharpness, graininess and color reproduction, and that in particular they have excellent sensitive material storage properties and post processing colored image storage properties.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising a support, having thereon at least one photosensitive silver halide emulsion layer, wherein at least 50% of the total projected area of the silver halide grains in said emulsion layer is accounted for by tabular grains of an aspect ratio at least 2:1, wherein at least 50% of the total projected area of the silver halide grains in said emulsion layer is accounted for by hexagonal tabular silver halide grains which have two parallel planes as external surfaces and for which the ratio of the length of the longest side with respect to the length of the shortest side is not more than 2, and wherein a compound which can be represented by formula (III) indicated below is in at least one layer:

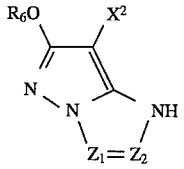

(III)

wherein $R_6$ represents an alkyl or aryl group; $X^2$ represents a group which may be eliminated by a coupling reaction with the oxidized form of a developing agent during development to form a development inhibitor, or a group which after elimination, reacts during development with another molecule of the oxidized form of the developing agent to form a development inhibitor, provided that $X^2$ does not contain a group according to formula (B-1) below;

$Z_1$ and $Z_2$ each represents a nitrogen atom or $=C(R_2)$- and when $Z_1$ is a nitrogen atom, $Z_2$ is $=C(R_2)$- and when $Z_1$ is $=C(R_2)$- $Z_2$ is a nitrogen atom, wherein $R_2$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, sulfonamido group, a carbamoyl group, a sulfamoyl group, a sulfonyl group, an alkoxycarbonyl group, a heterocyclic oxy group, an azo group, an acyloxy group, carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group;

$$-X_1-(X_2=X_3)_b-X_4—H \quad \text{(B-1)}$$

wherein $X_1$ and $X_4$ each represents an oxygen atom or $—N(—SO_2R_{71})$- in which $R_{71}$ represents an aliphatic, an aromatic or a heterocyclic group, $X_2$ and $X_3$ each represents a methine group or a nitrogen atom, b represents an integer of 1 to 3, at least one of the $X_2$ groups and $X_3$ groups is a methine group, when b is greater than 1, the $X_2$ groups and the $X_3$ groups may be the same or different, and when $X_2$ and $X_3$ are methine groups which have substituent groups, these substituent groups may be joined together to form a ring structure.

2. A silver halide color photographic photosensitive material as in claim 1, wherein $X^2$ is a group represented by formula (X-1) below:

$$-\{(L_1)_a-(B)_m\}_p-(L_2)_n-DI \quad \text{(X-1)}$$

wherein $L_1$ represents a group which is cleaved from B after cleavage of the bond on the left hand side of $L_1$; B represents a group which reacts with the oxidized form of a developing agent and to cleave the bond on the right hand side of B shown in formula (X-1); $L_2$ represents a group with which the bond on the right hand side (the bond to DI) is cleaved after cleavage of the bond on the left hand side of $L_2$ in formula (X-1); DI represents a development inhibitor; and a, m and n each represent 0 or 1, and p represents an integer from 0 to 2 provided the individual $(L_1)_a$-$(B)_m$ moieties may be the same or different when p is greater than 1.

3. A silver halide color photographic photosensitive material as in claim 2, in which the group represented by formula (X-1) is a group represented by formula (X-2), (X-3) or (X-4):

$$-(L_1)-(B)-DI \quad \text{(X-2)}$$

$$-(L_2)-DI \quad \text{(X-3)}$$

$$-DI \quad \text{(X-4)}$$

wherein $L_1$, $L_2$, B and DI have the same meaning as $L_1$, $L_2$, B and DI in formula (X-1), respectively.

4. A silver halide color photographic photosensitive material as in claim 2, in which $L_1$ and $L_2$ in formula (X-1) each represents a group represented by formula (T-1), (T-2), (T-3), (T-5), or (T-6):

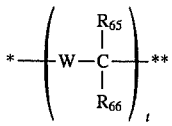

(T-1)

wherein W represents an oxygen atom, a sulfur atom, or $—N(R_{67})$-; $R_{65}$ and $R_{66}$ each represents a hydrogen atom, $R_{69}$, $R_{69}CO—$, $R_{69}SO_2—$, $R_{69}NR_{70}SO_2—$;

$R_{67}$ represents $R_{69}$, $R_{69}CO—$, $R_{69}SO_2—$, $R_{69}NR_{70}CO—$ or $R_{69}NR_{70}SO_2—$;

wherein $R_{69}$ represents an aliphatic group, an aromatic group or a heterocyclic group, and $R_{70}$ represents a hydrogen atom, an aliphatic group, an aromatic group or a heterocyclic group;

t represents 1 or 2, and when t is 2, the $(-W—C(R_{65})(R_{66})-)$ groups are the same or different; and the symbol (*) indicates the left-side bond of $L_1$ or $L_2$ in formula (X-1), and the symbol (**) indicates the right-side bond of $L_1$ or $L_2$ in formula (X-1);

$$* \text{-Nu-Link-E-}** \quad \text{(T-2)}$$

wherein the symbols (*) and (**) have the same meaning as in formula (T-1);

Nu represents a nucleophilic group;

E represents an electrophilic group, which is a group nucleophilically attacked by Nu to cleave the bond (**); and Link represents a linking group for sterically linking Nu and E with each other so that an intramolecular nucleophilic substitution reaction may occur there-between;

$$*\text{-W-}(V_1{=}V_2)_t\text{—}CH_2\text{—}** \quad \text{(T-3)}$$

wherein $V_1$ and $V_2$ each represents $\equiv C—R_{65}$ or a nitrogen atom; and (*), (**), W, $R_{65}$ and t have the same meaning as in formula (T-1);

$$*\text{—O—CO—}** \quad \text{(T-4)}$$

$$*\text{—S—CS—}** \quad \text{(T-5)}$$

wherein (*) and (**) have the same meaning as in formula (T-1);

$$*\text{—W—C(=N—}R_{68}\text{)—}** \quad \text{(T-6)}$$

wherein (*), (**) and W have the same meaning as in formula (T-1); and $R_{68}$ has the same meaning as $R_{67}$ as defined in formula (T-1).

5. A silver halide color photographic photosensitive material as in claim 2, in which B in formula (X-1) is represented by formula (B-2), (B-3) or (B-4):

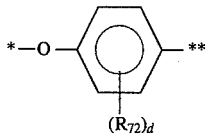

(B-2)

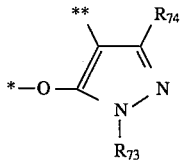

(B-3)

wherein the symbol (*) represents the bond on the left side of B in formula (X-1); the symbol () represents the bond on the right side of B in formula (X-1); $R_{72}$, $R_{73}$ and $R_{74}$ are groups which enable the groups represented by (B-2) and (B-3) to function as couplers which have a coupling leaving group at  after cleavage at *; and d represents an integer of from 0 to 4; provided that when d is a plural number, the $(R_{72})$'s may be the same or different and where plural $(R_{72})$'s are present, they are bonded to each other to form a cyclic structure;

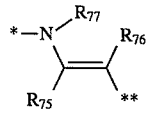

(B-4)

wherein the symbols (*) and (**) have the same meaning as in formulas (B-2) and (B-3); and $R_{75}$, $R_{76}$ and $R_{77}$ each represents a substituent, and $R_{77}$ and $R_{76}$ or $R_{77}$ and $R_{75}$ may be bonded to each other to form a nitrogen-containing heterocyclic ring.

6. A silver halide color photographic photosensitive material as in claim 1, wherein a compound which is represented by formula (A) below is included:

$$Q\text{-}SM^1 \quad \text{(A)}$$

wherein Q represents a heterocyclic group which has at least one group selected from among $—SO_3M^2$, $—COOM^2$, —OH and $—NR^1R^2$ bonded directly or indirectly thereto, $M^1$ and $M^2$ each independently represent a hydrogen atom, an alkali metal, a quaternary ammonium or quaternary phosphonium, and $R^1$ and $R^2$ represent hydrogen atoms or alkyl groups.

7. A silver halide color photographic photosensitive material as in claim 1, wherein the average silver iodide content of the grains of the tabular silver halide emulsion is at least 7 mol %.

8. A silver halide color photographic photosensitive material as in claim 7, wherein two or more different types of silver halide grains are included in the same photosensitive layer.

9. A silver halide color photographic photosensitive material as in claim 1, wherein the variation coefficient of the grain size of the silver halide grains is not more than 0.25.

10. A silver halide color photographic photosensitive material as in claim 9, wherein two or more different types of silver halide grains are included in the same photosensitive layer.

11. A silver halide color photographic photosensitive material as in claim 1, wherein two or more different types of silver halide grains are included in the same photosensitive layer.

* * * * *